US008813406B1

(12) United States Patent
Sullivan et al.

(10) Patent No.: US 8,813,406 B1
(45) Date of Patent: Aug. 26, 2014

(54) HIGH CAPACITY MAGAZINE WITH MULTIPLE SPRINGS

(71) Applicant: ArmWest, LLC, Prescott, AZ (US)

(72) Inventors: Leroy James Sullivan, Prescott, AZ (US); Robert Lloyd Waterfield, Prescott, AZ (US); Hyunjung Samuel Eyssautier, Anthem, AZ (US)

(73) Assignee: ArmWest, LLC, Prescott, AZ (US)

( * ) Notice: Subject to any disclaimer, the term of this patent is extended or adjusted under 35 U.S.C. 154(b) by 0 days.

(21) Appl. No.: 14/092,861

(22) Filed: Nov. 27, 2013

Related U.S. Application Data

(62) Division of application No. 13/071,990, filed on Mar. 25, 2011.

(60) Provisional application No. 61/317,396, filed on Mar. 25, 2010.

(51) Int. Cl.
*F41A 9/65* (2006.01)
*F41A 9/69* (2006.01)

(52) U.S. Cl.
CPC .... *F41A 9/65* (2013.01); *F41A 9/69* (2013.01)
USPC ..... 42/50

(58) Field of Classification Search
CPC ..... F41A 9/61; F41A 9/64; F41A 9/65; F41A 9/69; F41A 9/70
USPC ..... 42/50, 49.01, 49.02, 106; 89/33.01, 89/33.04, 33.1
See application file for complete search history.

(56) References Cited

U.S. PATENT DOCUMENTS

| | | | |
|---|---|---|---|
| 804,986 | A | 11/1905 | Stamm |
| 904,986 | A | 11/1908 | Pindstofte |
| 980,980 | A | 1/1911 | Maggio |
| 1,202,707 | A | 10/1916 | Grieco et al. |
| 1,227,439 | A | 5/1917 | Hilgendorf |
| 1,402,459 | A | 1/1922 | Swebilius |
| 1,413,409 | A | 4/1922 | Lackman |
| 1,476,657 | A | 12/1923 | Tawney |
| 1,500,580 | A | 7/1924 | Ferrero |

(Continued)

FOREIGN PATENT DOCUMENTS

| | | |
|---|---|---|
| CH | 146031 | 3/1931 |
| CH | 199224 | 8/1938 |

(Continued)

OTHER PUBLICATIONS

Anonymous: "Magazine Feed Liptool," Internet Article, http://www.brownelfs.com/asgx/Qid=25049/Product/Magazine-Feed-Liptool, Retrieved from the Internet on Jul. 03, 2012.

*Primary Examiner* — Jonathan C Weber
(74) *Attorney, Agent, or Firm* — Haynes and Boone, LLP

(57) ABSTRACT

A high capacity box magazine is provided. A plurality of nested followers may be adapted to nest one within another and a plurality of springs may be configured to nest one within another to facilitate the advancement of cartridges within the box magazine to a firearm. A spring cup or cups may be used to nest additional springs that work in series and are nested within each other to further reduce the required height of the springs. The reliability of a conventional lower capacity box magazine may be maintained or exceeded without requiring significantly greater length in order to accommodate the increased capacity. The high capacity box magazine typically requires less frequent magazine changes than conventional lower capacity box magazines.

24 Claims, 45 Drawing Sheets

(56) References Cited

U.S. PATENT DOCUMENTS

| | | | |
|---|---|---|---|
| 1,588,887 | A | 6/1926 | Haubroe |
| 1,907,164 | A | 5/1933 | White |
| 1,946,388 | A | 2/1934 | Chevallier |
| 2,088,268 | A | 7/1937 | Lauf |
| 2,096,028 | A | 10/1937 | Burton et al. |
| 2,147,208 | A | 2/1939 | Nolan |
| 2,217,848 | A | 10/1940 | Schillström |
| 2,345,031 | A | 3/1944 | Carithers |
| 2,365,306 | A | 12/1944 | Swebilius |
| 2,365,392 | A | 12/1944 | Cooley |
| 2,376,466 | A | 5/1945 | Williams |
| 2,391,756 | A | 12/1945 | Vesely |
| 2,462,119 | A | 2/1949 | Moore |
| 2,482,880 | A | 9/1949 | Sefried, II |
| 2,488,233 | A | 11/1949 | Pelo |
| 2,503,116 | A | 4/1950 | Maillard |
| 2,756,640 | A | 7/1956 | Maillard |
| 2,791,944 | A | 5/1957 | Harvey |
| 2,910,332 | A | 10/1959 | Madsen |
| 2,981,154 | A | 4/1961 | Sweeney |
| 3,043,198 | A | 7/1962 | Darsie et al. |
| 3,090,148 | A | 5/1963 | Smith |
| 3,090,149 | A | 5/1963 | Marlas |
| 3,198,076 | A | 8/1965 | Stoner |
| 3,226,869 | A | 1/1966 | Musgrave |
| 3,318,192 | A | 5/1967 | Sullivan |
| 3,330,183 | A | 7/1967 | Löffler |
| 3,333,510 | A | 8/1967 | Mühlemann |
| 3,345,771 | A | 10/1967 | Silsby |
| 3,346,982 | A | 10/1967 | Löffler et al. |
| 3,366,011 | A | 1/1968 | Stutervant |
| 3,440,751 | A | 4/1969 | Fremont |
| 3,604,142 | A | 9/1971 | Silsby |
| 3,672,089 | A | 6/1972 | Silsby |
| 3,688,641 | A | 9/1972 | Curtis et al. |
| 3,795,173 | A | 3/1974 | Freymond |
| 3,977,114 | A | 8/1976 | Poor |
| 3,990,348 | A | 11/1976 | Vesamaa |
| 4,020,740 | A | 5/1977 | Schirneker |
| 4,127,954 | A | 12/1978 | Hausmann |
| 4,416,186 | A | 11/1983 | Sullivan |
| 4,428,137 | A | 1/1984 | Johnson |
| 4,433,611 | A | 2/1984 | Baumann |
| 4,446,645 | A | 5/1984 | Kelsey, Jr. et al. |
| 4,505,182 | A | 3/1985 | Sullivan |
| 4,524,672 | A | 6/1985 | Balsavage |
| 4,589,218 | A | 5/1986 | Teppa |
| 4,765,224 | A | 8/1988 | Morris |
| 5,168,648 | A | 12/1992 | Brandl et al. |
| 5,386,657 | A | 2/1995 | Racheli |
| 5,448,940 | A | 9/1995 | Schuetz et al. |
| 5,495,687 | A | 3/1996 | Waiser |
| 5,561,933 | A | 10/1996 | Czekalski |
| 5,634,288 | A | 6/1997 | Martel |
| 5,827,992 | A | 10/1998 | Harris et al. |
| 5,909,002 | A | 6/1999 | Atchisson |
| 6,340,161 | B1 | 1/2002 | Zitting et al. |
| 6,484,430 | B1 | 11/2002 | Robinson et al. |
| 6,722,255 | B2 | 4/2004 | Herring |
| 6,829,974 | B1 | 12/2004 | Gwinn, Jr. |
| 6,848,351 | B1 | 2/2005 | Davies |
| 6,898,888 | B2 | 5/2005 | Greenhut |
| 7,117,626 | B1 | 10/2006 | Alzamora et al. |
| 7,293,385 | B2 | 11/2007 | McCormick |
| 7,627,974 | B2 | 12/2009 | Olson |
| 7,823,314 | B1 | 11/2010 | Wheatley |
| 7,832,326 | B1 | 11/2010 | Barrett |
| 7,886,470 | B1 | 2/2011 | Doiron |
| 7,938,055 | B2 | 5/2011 | Hochstrate et al. |
| 8,061,071 | B2 | 11/2011 | Fitzpatrick et al. |
| 8,087,194 | B1 | 1/2012 | Vuksanovich |
| 8,141,285 | B2 | 3/2012 | Brown |
| 8,205,373 | B1 | 6/2012 | Ubl et al. |
| 8,210,089 | B2 | 7/2012 | Brown |
| 8,261,653 | B2 | 9/2012 | Crommett |
| 8,316,756 | B1 | 11/2012 | Woodell et al. |
| 8,365,454 | B2 | 2/2013 | Hogan, Jr. |
| 2003/0188567 | A1 | 10/2003 | Garrett, Jr. |
| 2005/0262752 | A1 | 12/2005 | Robinson et al. |
| 2008/0028661 | A1 | 2/2008 | Bubits |
| 2008/0092733 | A1 | 4/2008 | Leitner-Wise et al. |
| 2008/0134557 | A1 | 6/2008 | Wossner et al. |
| 2010/0095833 | A1 | 4/2010 | Gavage et al. |
| 2010/0126053 | A1 | 5/2010 | Fitzpatrick et al. |
| 2010/0163250 | A1 | 7/2010 | Schultz et al. |
| 2010/0186582 | A1 | 7/2010 | Juarez |
| 2010/0269389 | A1 | 10/2010 | Lopez Laparra |
| 2010/0275770 | A1 | 11/2010 | Noveske |
| 2011/0005384 | A1 | 1/2011 | Lewis et al. |
| 2011/0023699 | A1 | 2/2011 | Barrett |
| 2011/0173857 | A1 | 7/2011 | Hogan, Jr. |
| 2012/0131831 | A1 | 5/2012 | Sullivan et al. |
| 2012/0152105 | A1 | 6/2012 | Gomez et al. |
| 2013/0098235 | A1 | 4/2013 | Reinken |

FOREIGN PATENT DOCUMENTS

| | | |
|---|---|---|
| DE | 569280 | 2/1933 |
| DE | 203574 | 8/1938 |
| DE | 664926 | 9/1938 |
| DE | 712084 | 12/1941 |
| DE | 858944 | 12/1952 |
| DE | 3707925 | 9/1988 |
| DE | 102006011278 | 9/2007 |
| DE | 102007011502 | 9/2008 |
| DE | 102007034670 | 1/2009 |
| EP | 0055690 | 7/1982 |
| EP | 1479997 | 11/2004 |
| EP | 1596151 | 11/2005 |
| EP | 2045561 | 4/2009 |
| FR | 1362361 | 5/1964 |
| GB | 166579 | 7/1921 |
| GB | 525429 | 8/1940 |
| GB | 536728 | 12/1944 |
| GB | 604348 | 7/1948 |
| GB | 1227706 | 4/1971 |
| GB | 1338189 | 11/1973 |
| GB | 2231943 | 11/1990 |
| JP | 2003/287127 | 10/2003 |
| WO | WO 97/25581 | 7/1997 |

HIGH CAPACITY MAGAZINE WITH MULTIPLE SPRINGS

CROSS-REFERENCE TO RELATED APPLICATIONS

This patent application is a divisional of U.S. patent application Ser. No. 13/071,990, filed Mar. 25, 2011, which claims priority to U.S. Provisional Patent Application No. 61/317,396, filed on Mar. 25, 2010 and entitled HIGH CAPACITY MAGAZINE WITH MULTIPLE SPRINGS, which are all hereby expressly incorporated by reference in their entirety.

BACKGROUND

1. Technical Field

The present disclosure relates generally to firearms and relates more particularly to high capacity box magazines for feeding cartridges to firearms.

2. Related Art

Removable magazines for feeding cartridges to firearms are well known. There are generally two main types of magazines, i.e., box magazines and drum magazines. Box magazines are generally limited to about 30 cartridges, so as to maintain reliability. Drum magazines typically hold 50-150 cartridges. Because of their lower capacity, box magazines must generally be changed more often than drum magazines. Box magazines are much lighter, simpler, and more compact. A person may carry more cartridges loaded in box magazines than drum magazines. Drum magazines are generally preferred over box magazines for high capacity applications.

It is desirable to provide magazines having high capacities. The use of magazines having high capacities requires less frequent magazine changes than the use of magazines having low capacities. The use of high capacity magazines better assures that the firearm will be ready to use when needed.

Because of their higher capacities, drum magazines require less frequent magazine changes as compared to box magazines, but drum magazines are much heavier, more complicated, and are comparatively bulky. Although drum magazines initially provide greater firepower, their weight and bulk reduce the amount of ammunition (held in magazines) that a person may carry. One option is for a person to carry a drum magazine (such as a 100-shot drum magazine) on the firearm for initial firepower and to carry the rest of the ammunition in box magazines (such as 30 cartridge box magazines). However, such an approach is often impractical due to the bulk of the drum magazine and due to the number of box magazines required, for example.

It is desirable to combine the large capacity of a drum magazine with the light compact size and portability of a box magazine, so as to obtain both the greater initial fire power of the drum magazine and the greater sustained firepower of a plurality of box magazines. However, as the size of a magazine is increased to accommodate more cartridges, a longer, higher force spring must generally be used to move the cartridges within the magazine. As the capacity of a magazine is increased, each added cartridge tends to reduce the reliability of the magazine. For example, the higher force provided by the higher force spring, particularly when fully compressed, may cause undesirable feed problems that render the firearm temporarily inoperable.

According to conventional methodology, increasing the capacity of a conventional double column box magazine from the 30 cartridges common today to 100 cartridges would undesirably more than triple the length of the magazine and would also require three and one third times the force to accelerate the three and one third times the weight of cartridges in order to lift the top cartridge up into the feed path of the firearm as fast as is accomplished when using a conventional 30 cartridge magazine (such as a 30 cartridge magazine for which most automatic firearms are commonly designed). Such conventional firearms would often be unable to strip the top cartridge forward out of the magazine and into the chamber if the output force lifting and holding the top cartridge in a feed position were increased three and one third fold. The use of such force would often thus undesirably interfere with the automatic firearm's operational cycle.

U.S. Pat. No. 2,217,848 discloses a four column magazine having a dividing wall that passes completely through the fore and aft interior space of the magazine (thus vertically dividing the magazine in two). Such a magazine uses two separate followers and springs so that each follower and spring must separately advance their respective two sets of cartridges with no positive connection between the two followers to synchronize their motion. Such separate, non-synchronized movement of the two sets of cartridges may result in the undesirable jamming of the magazine.

U.S. Pat. No. 4,589,218 discloses a four column magazine that has a fore and aft dividing wall and uses a single follower to advance all four columns, including advancing the last cartridge, to the feed position. However, a single follower that will advance all four columns of cartridges cannot readily be made to continue upwardly through a double column portion of a magazine. Such double column magazines or portions of magazines are required so as to fit the magazine well of a firearm within the M4/M16 family of weapons, whose interface dimensions for the magazine fit have been recommended as a NATO standard.

In view of the foregoing, it would be beneficial to provide an improved box magazine, such as a box magazine that has increased capacity and/or enhanced reliability with respect to contemporary magazines.

SUMMARY

According to an embodiment, a high capacity box magazine is provided. The high capacity box magazine typically requires less frequent magazine changes than conventional lower capacity box magazines. A plurality of nested followers that are adapted to nest one within another and a plurality of springs that are configured to nest one within another may facilitate the advancement of cartridges within the box magazine to a firearm in a manner that substantially maintains the reliability of a conventional lower capacity box magazine without requiring significantly greater length of the magazine in order to accommodate the increased capacity. For example, two followers and a plurality of springs may facilitate the advancement of cartridges within the box magazine. A spring cup or cups may be used to nest additional springs that work in series and are nested within each other to further reduce the required height of the springs.

The scope of the disclosure is defined by the claims, which are incorporated into this section by reference. A more complete understanding of embodiments of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
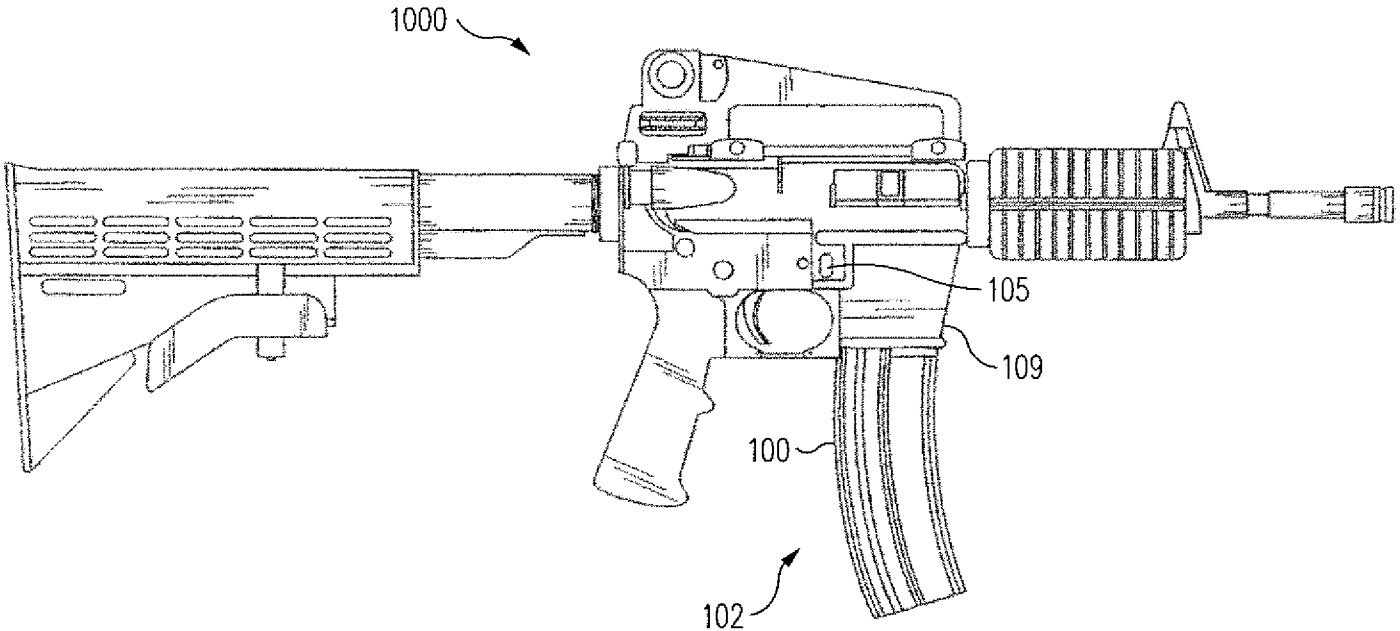
FIG. 1 shows a weapon system that comprises a firearm and a high capacity magazine, in accordance with an embodiment of the disclosure.
Figure 2:
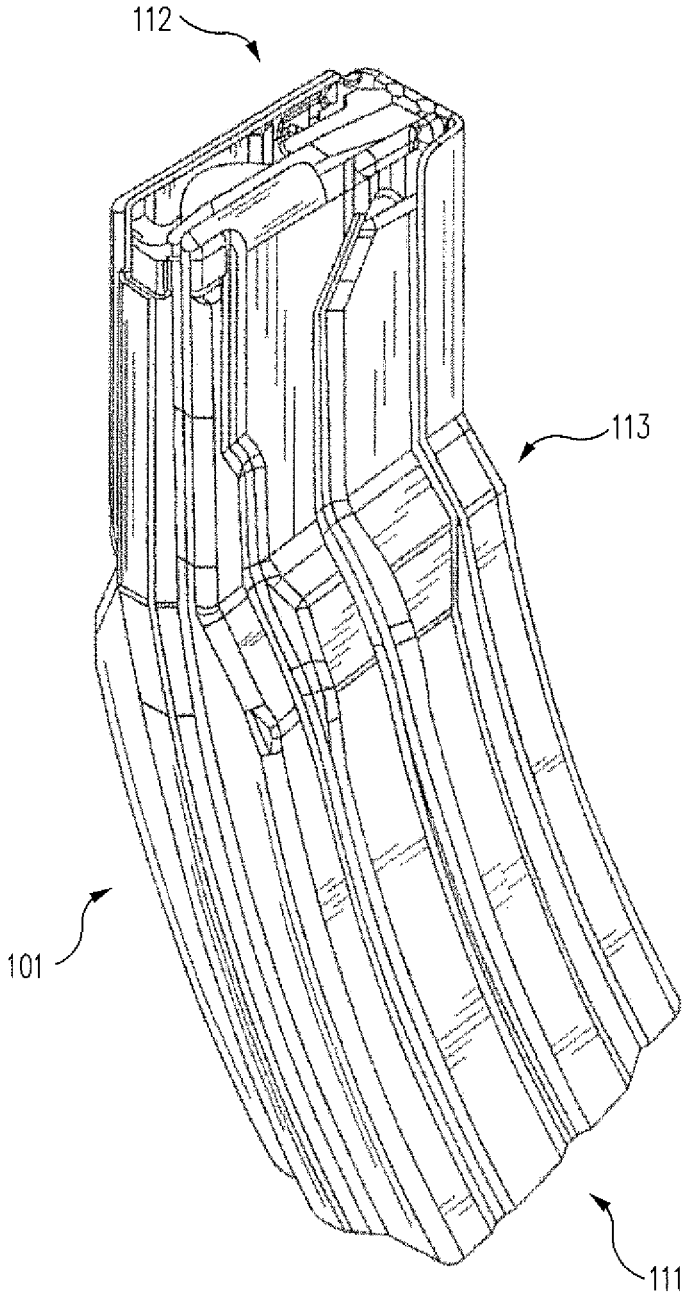
FIGS. 2-9 are various views of a 60 cartridge magazine, according to an embodiment of the disclosure.
Figure 3:
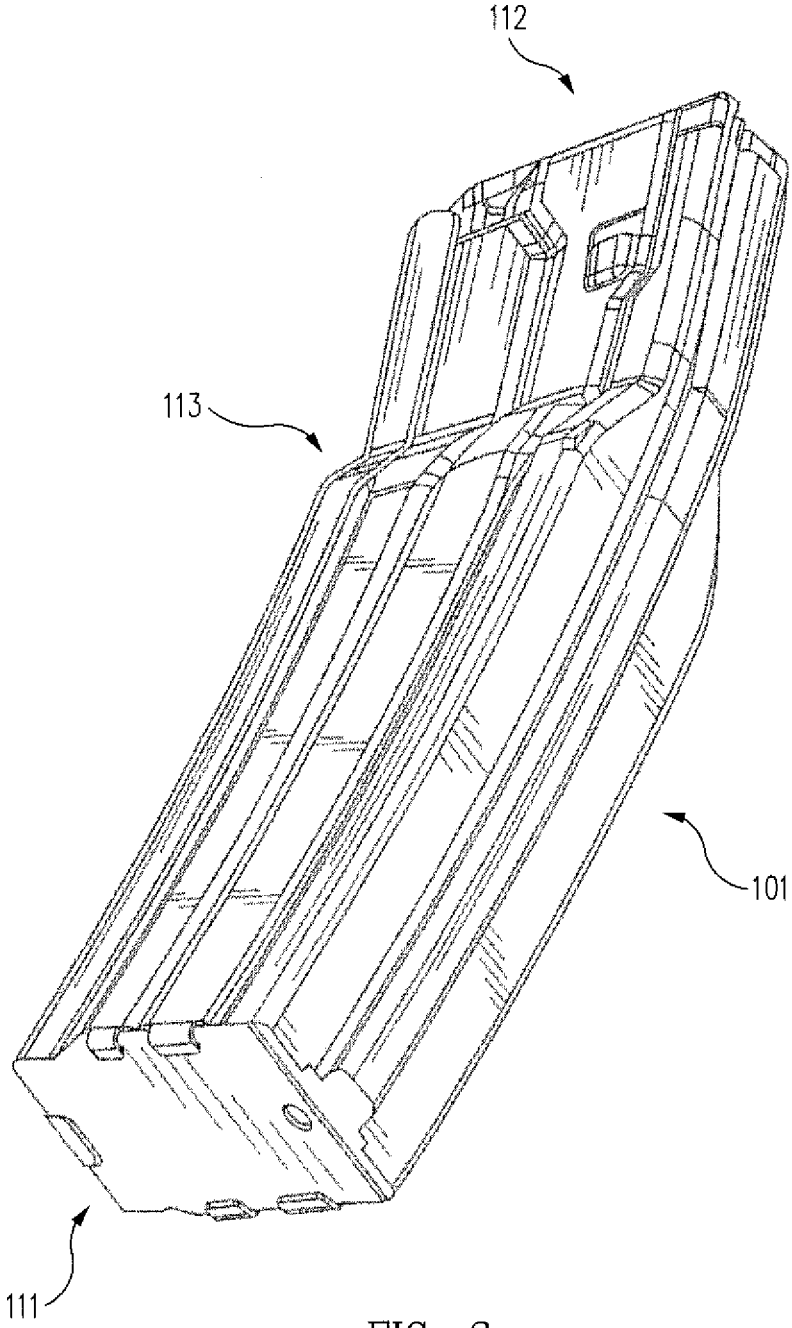
Figure 4:
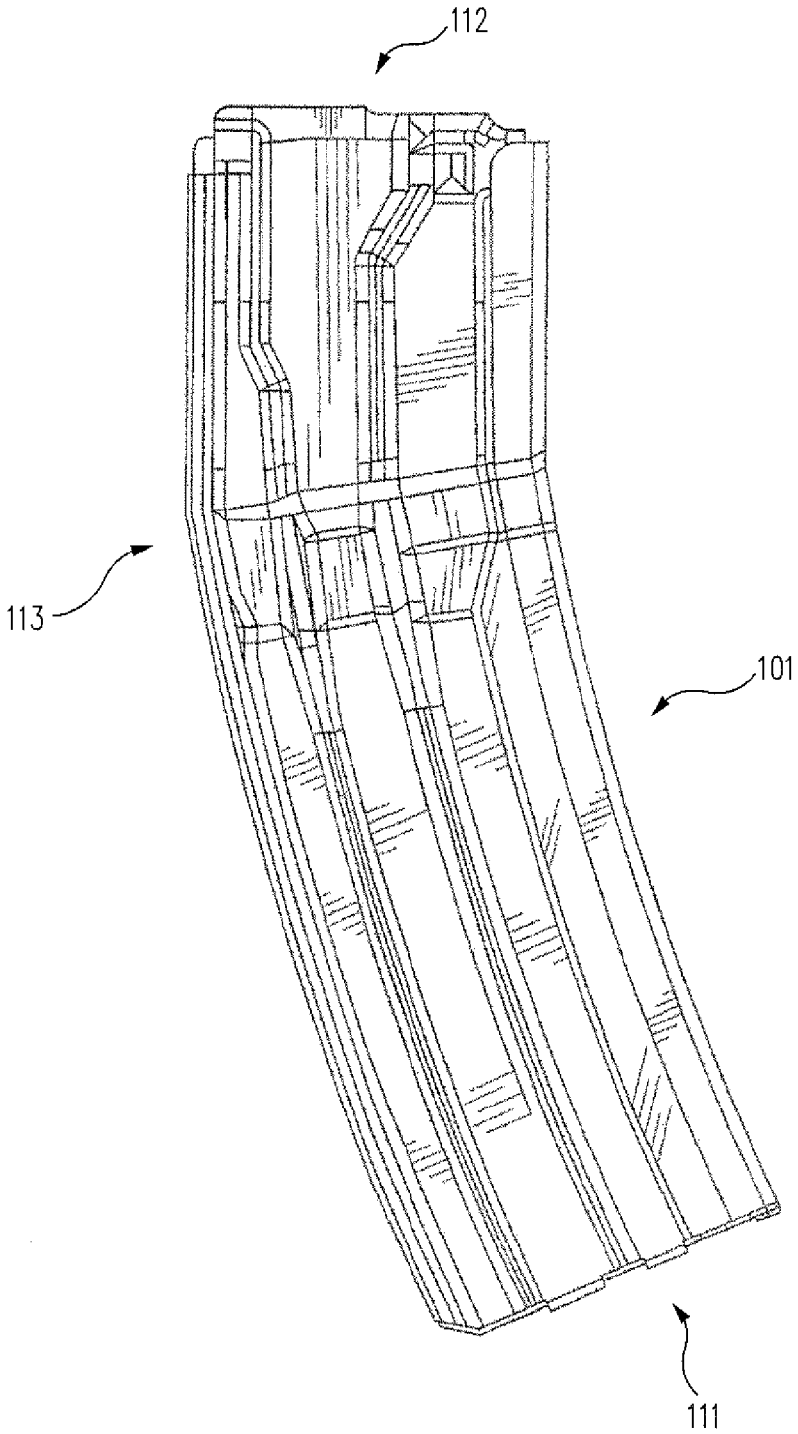
Figure 5:
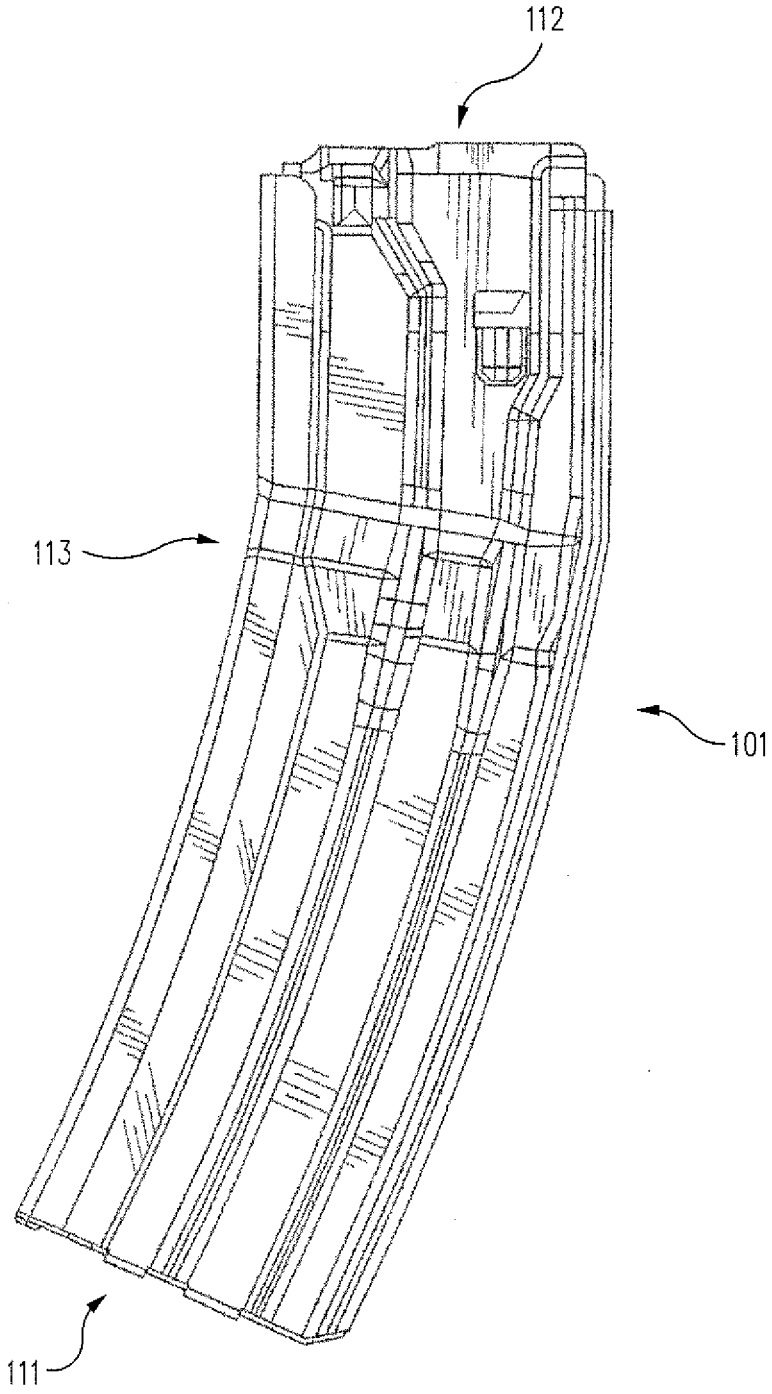
Figure 6:
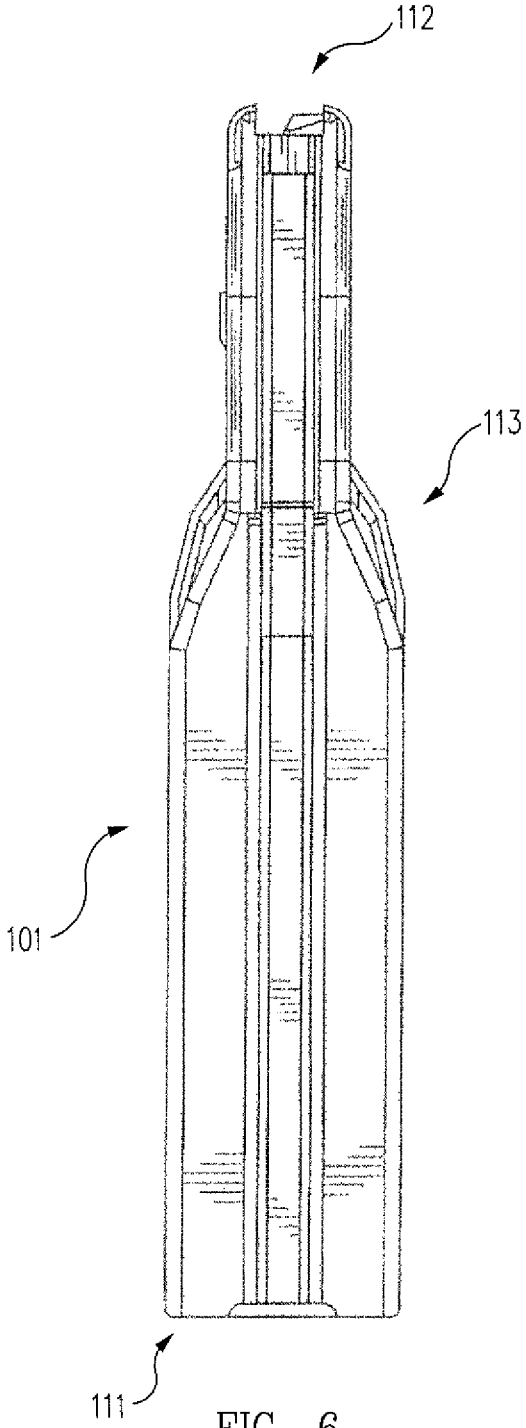
Figure 7:
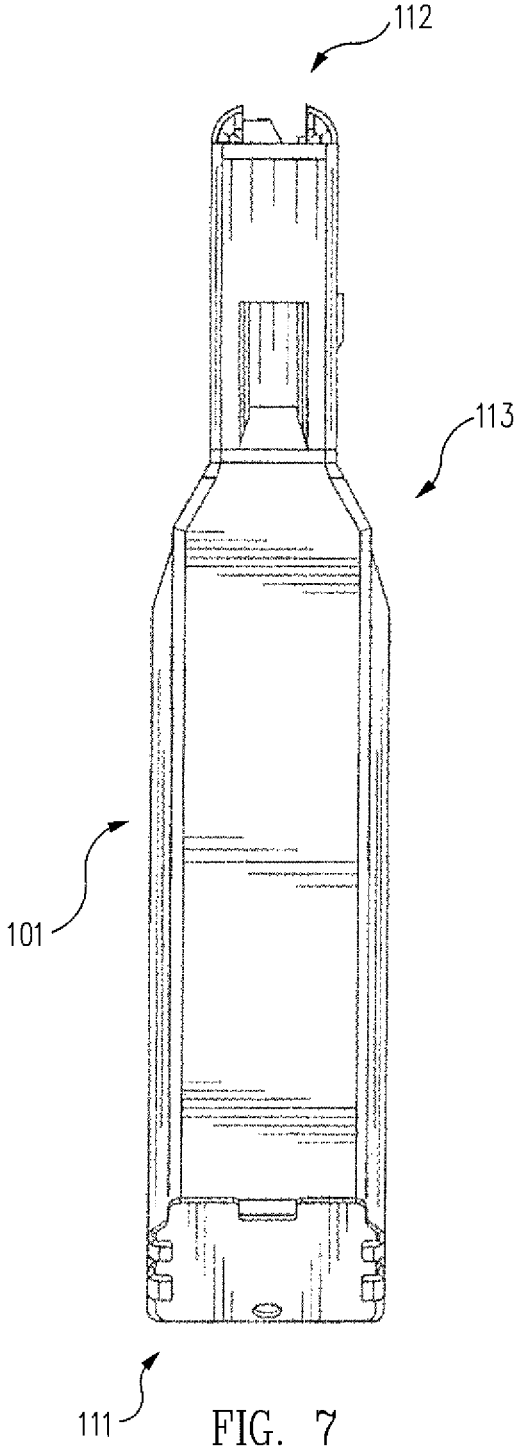
Figure 8:
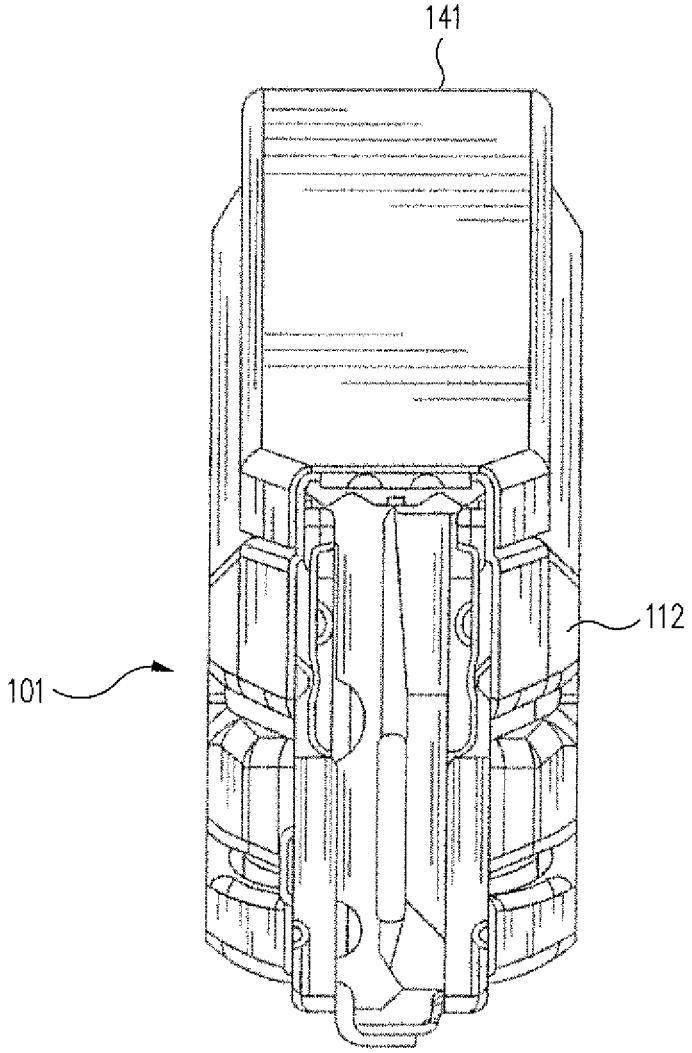
Figure 9:
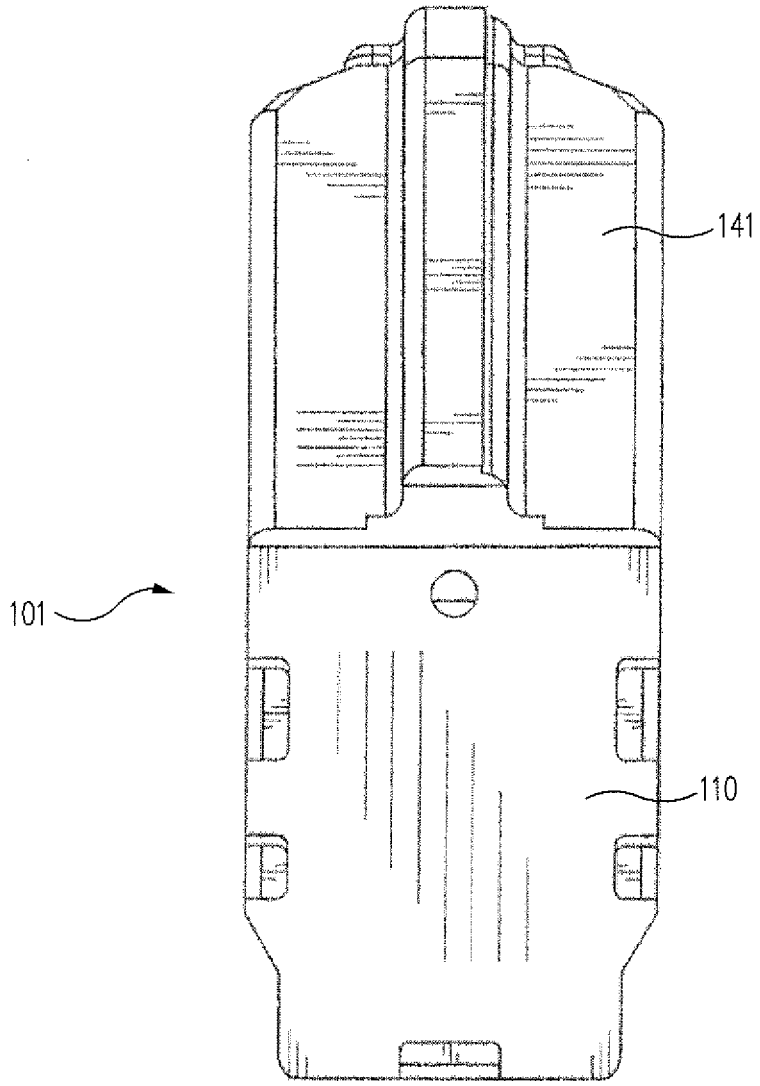
Figure 10:
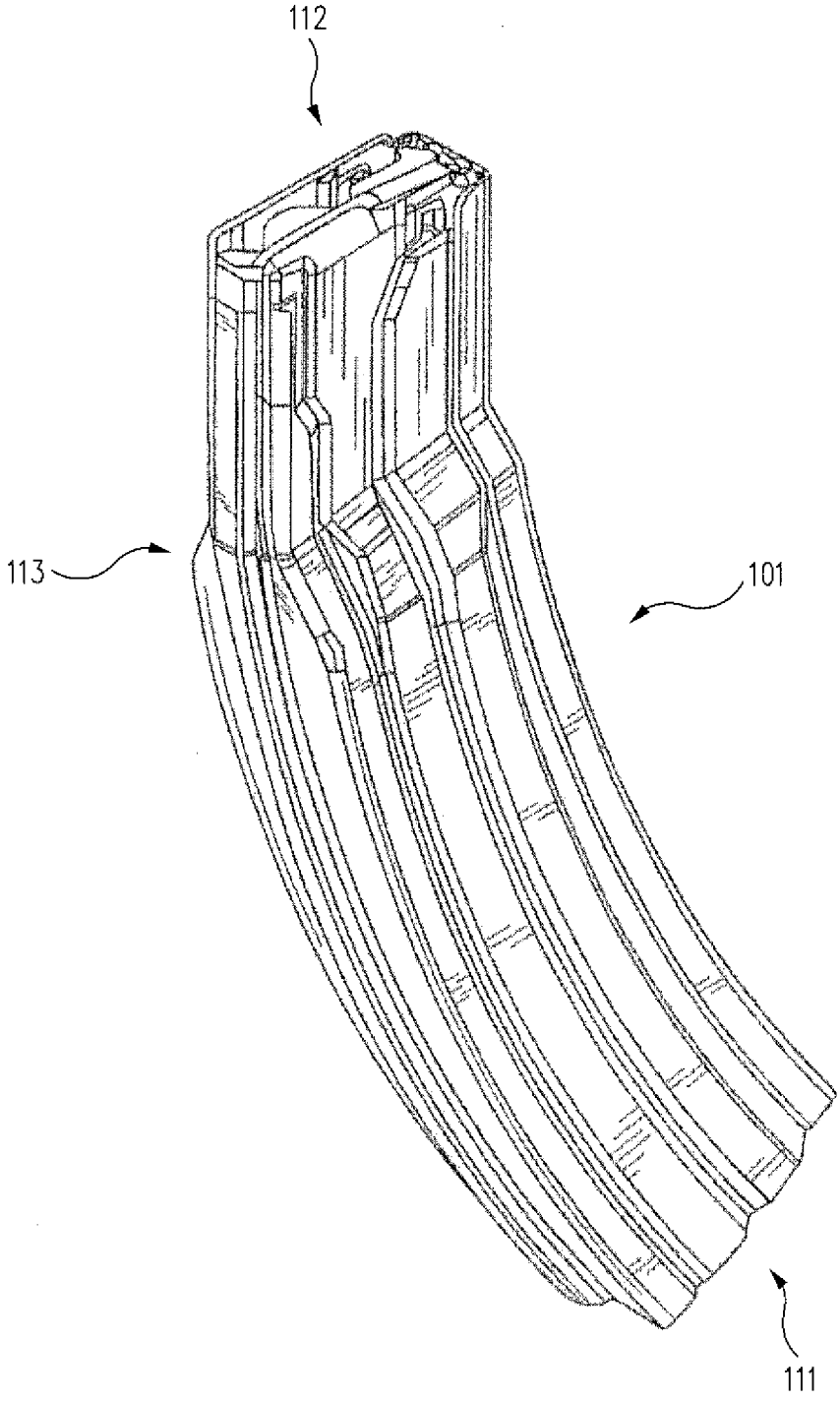
FIGS. 10-17 are various views of a 100 cartridge, magazine, according to an embodiment of the disclosure.
Figure 11:
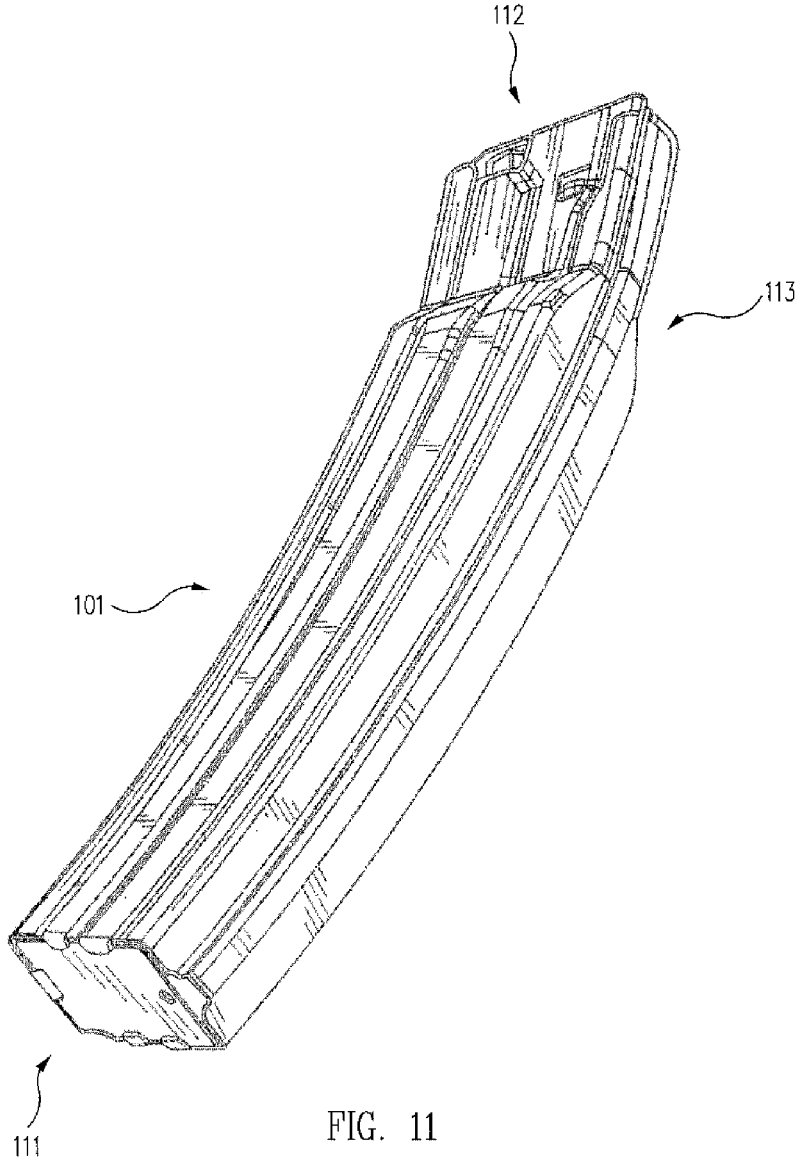
Figure 12:
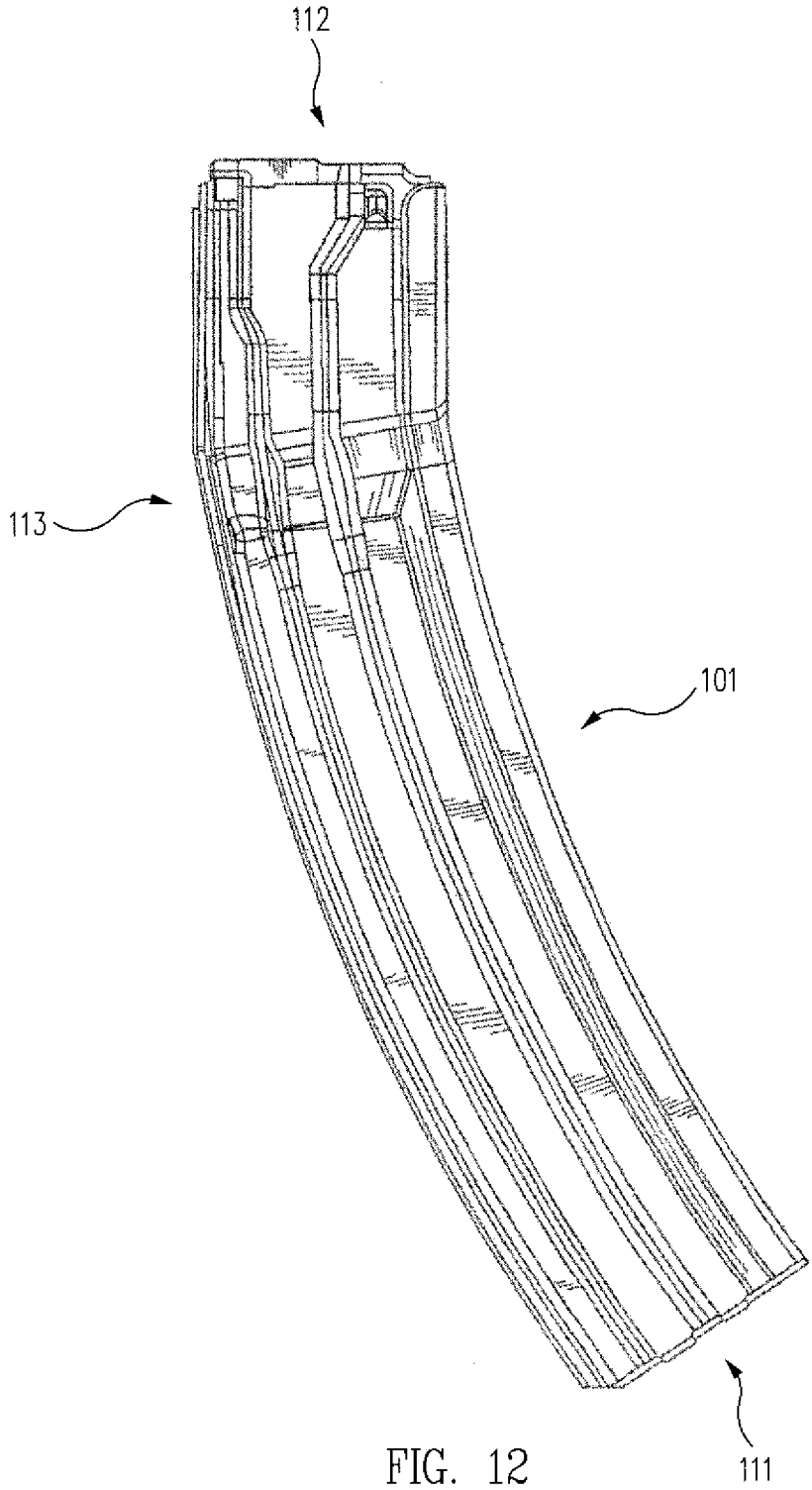
Figure 13:
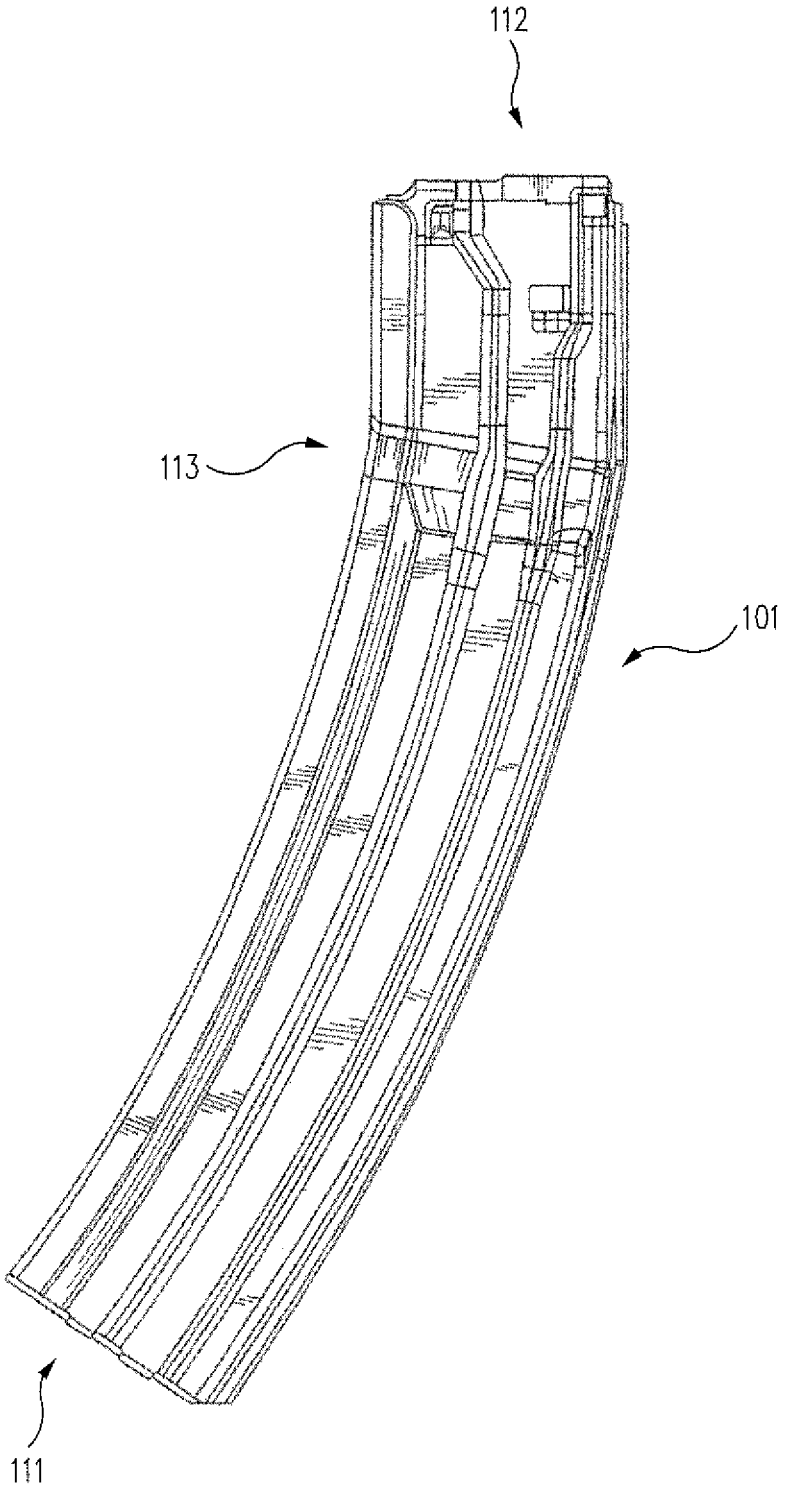
Figure 14:
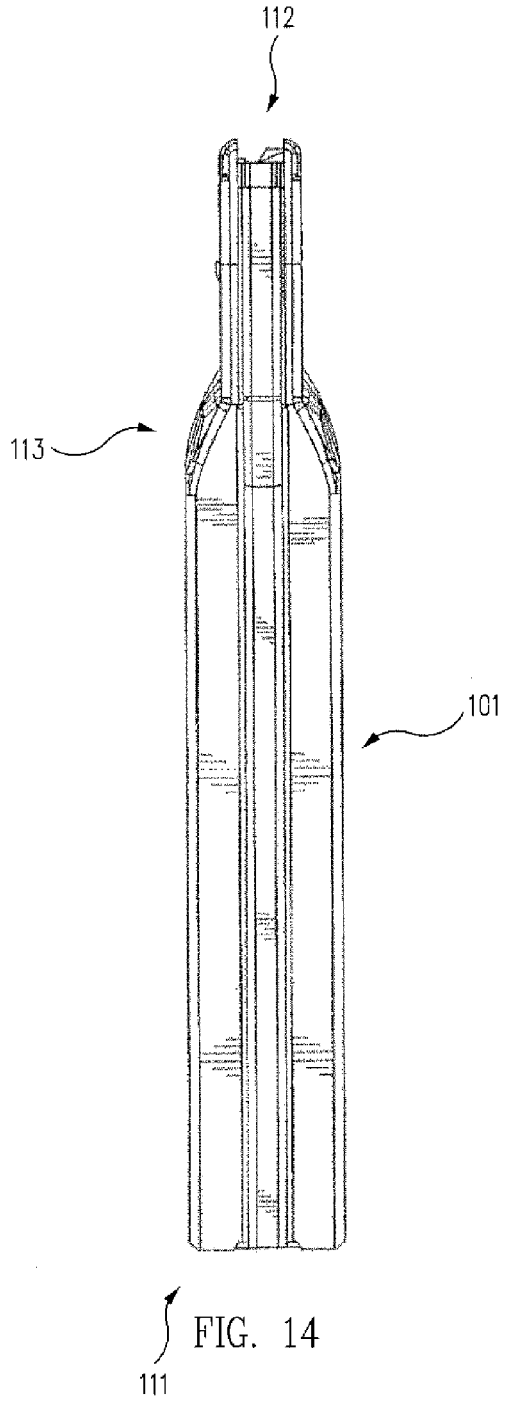
Figure 15:
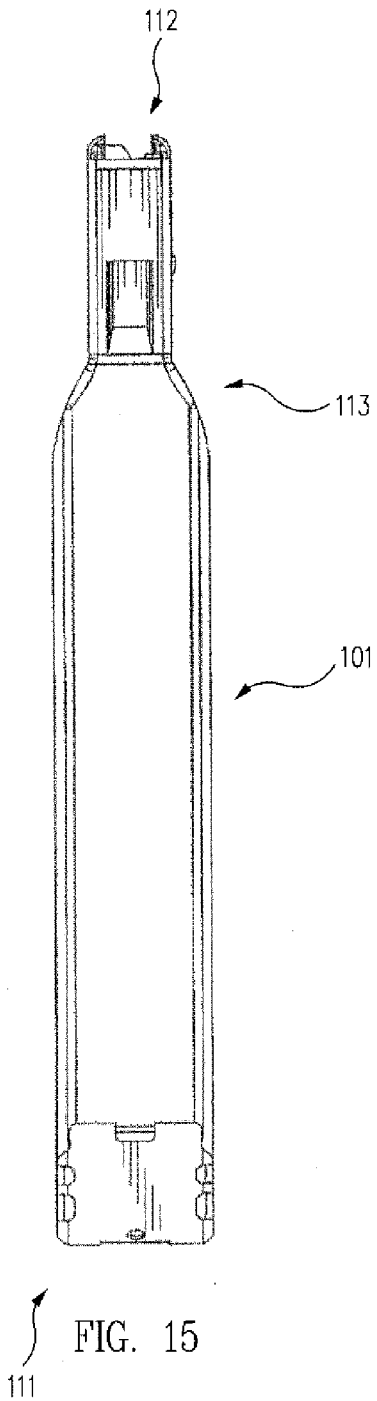
Figure 16:
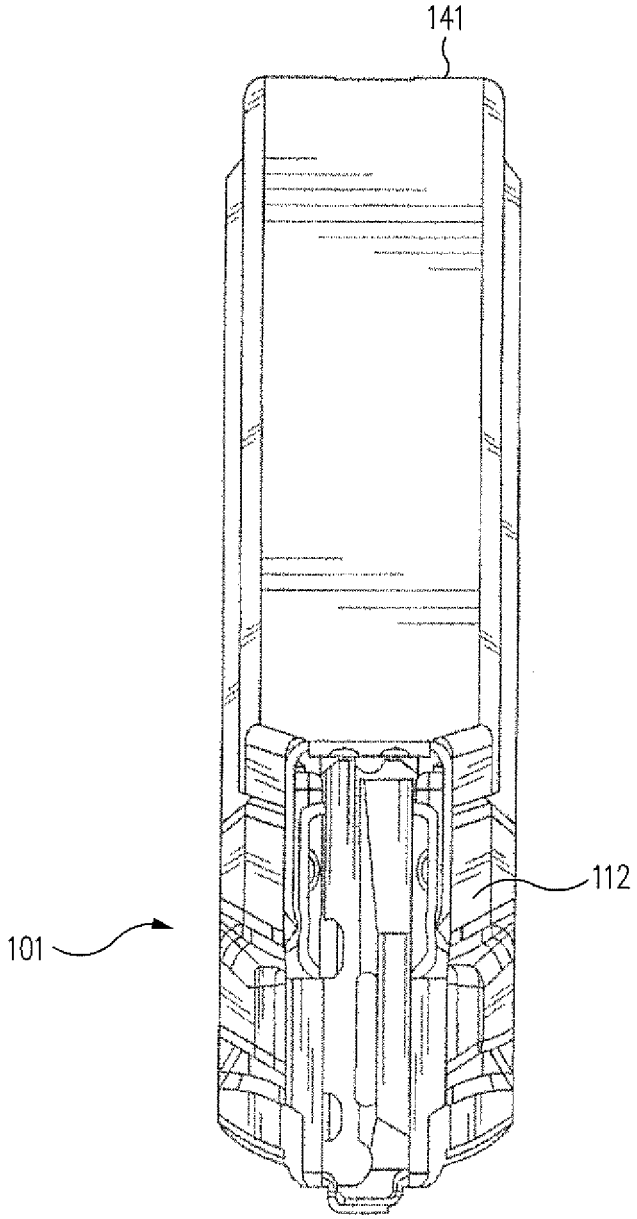
Figure 17:
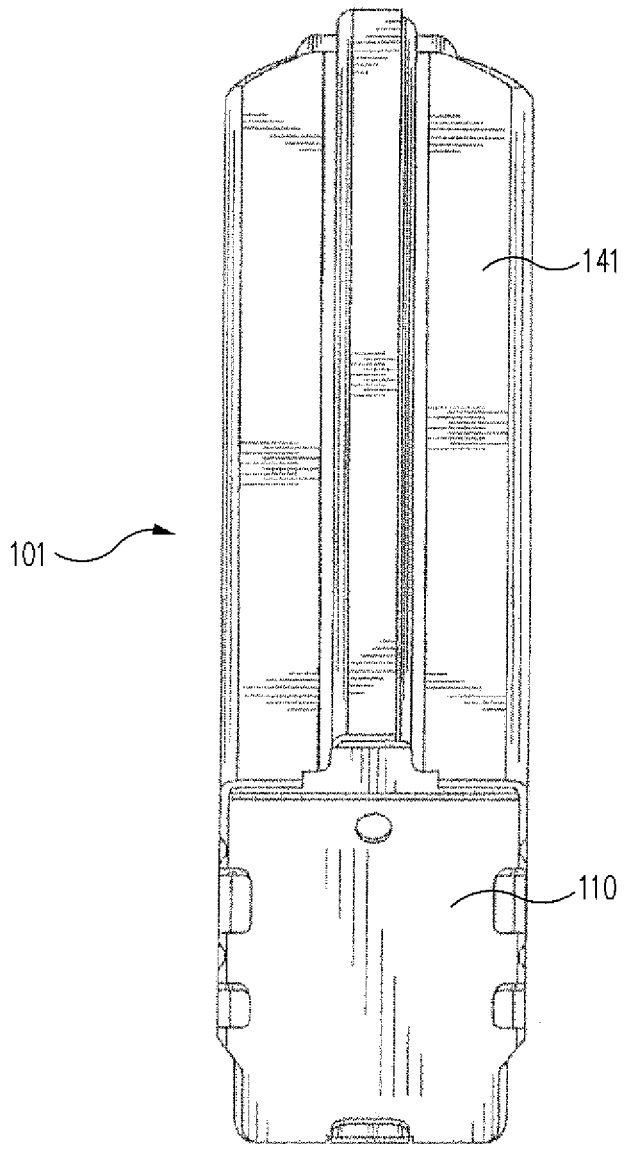

Examples of embodiments of high capacity magazines are disclosed herein. One or more embodiments of the present invention use four or more columns of cartridges that are transitioned into fewer columns (such as two columns, for example). This is done in a manner that controls the cartridges as they are transitioned into fewer columns so that each of the cartridges reliably meshes and coordinates with the other cartridges.

Such embodiments generally require less frequent magazine changes than conventional lower capacity magazines. Higher capacities may be provided without sacrificing reliability. Thus, a more effective weapon system is provided for use in battlefield, police, and other situations.

In an embodiment, a high capacity magazine may be implemented with a four column width that reduces the overall length of the magazine. However, since the NATO countries have generally agreed to use the same staggered double column magazine that their firearms are made to fit, an upper region of the high capacity magazine may use a staggered double column configuration to fit the recommended standard NATO rifle's magazine well. Thus, in such an embodiment the length reduction of the magazine is limited to that amount that is facilitated by the increased capacity that is contributed by the four column section of the magazine.

In an embodiment, the greater width of the four columns may increase the potential width of spring coils that are used to force cartridges upward in the magazine. This allows the springs to be adapted in a full circle coil (to define round springs) instead of the conventional elongated, e.g., rectangular, coil configuration that is used in conventional two column width magazine. Such conventional elongated coil springs are so highly stressed even in 30 shot magazines it is common practice to load only 28 cartridges to ensure that the spring does not set and consequently fail to correctly feed the last cartridges. Advantageously, round coils have less stress per load than any other coil shape because they are equally stressed throughout the length of the wire and thus tend to lack the concentrated high stress points of conventional elongated coil springs.

Round coils (which may be substantially concentric or which may be eccentric with respect to one another) of different diameters may be made to telescope or nest within one another to reduce the compressed stack height of the spring coils and the resulting magazine height. A free standing dividing wall may then fit inside the approximate center of a plurality of such springs without interfering or limiting the space available for the coil springs. The dividing wall may effectively provide a dividing wall or partition so as to limit undesirable movement of the springs, such as lateral movement thereof. The dividing wall may also divide the cartridges into two sets thereof and may help position the cartridges for proper merging of the two sets.

A transition or tapered portion of the magazine between the four column region and the two column region thereof may accelerate the cartridges as they move so as to substantially reduce the output force on the top cartridge while increasing the input force needed to advance three and one third times the weight (for example, the weight of 100 cartridges according to an embodiment versus the weight of 30 cartridges for a conventional magazine) the equivalent distance in the same time as in the conventional 30 shot magazine. This may be done while still stopping and restarting cartridge movement during each gun firing cycle.

This acceleration is the result of a principle analogous to the relationship of force, area, and speed in hydraulics. The four columns of cartridges act like a larger piston driving the smaller double column of cartridges. The double column of cartridges is thus driven at twice the speed with one half of the output force.

The result is that only about one half of the otherwise three and one third times greater force is needed in such an embodiment to lift the top cartridge in the desired amount of time (the portion of the automatic gun cycle between when the bolt's rearward motion uncovers the top cartridge, then reverses motion and starts to drive the cartridge forward). Because of this acceleration, only about one half of the force that would otherwise be transferred to and applied by the uppermost cartridge to the top (lips) of the magazine is actually applied. Thus, instead of the output force of the 100 cartridge magazine being 333% of the output force of a conventional 30 cartridge magazine, the output force is only about 83% thereof (which provides a 4 to 1 gain). In this manner, the stripping force is substantially and desirably reduced as compared to that of a conventional 30 cartridge magazine.

As those skilled in the art will appreciate, the stripping force of a spring driven automatic firearm is the force that the bolt must apply to the uppermost cartridge of a magazine in order to drive (strip) the cartridge forward out of the magazine and into the chamber of the barrel of the firearm. Excessive stripping resistance (which opposes stripping force) may cause an interrupted feed or jam, wherein the firearm cannot be used until the misfeed is corrected. Such a misfeed may result in a soldier or police officer being endangered and possibly killed. Therefore, it is important to maintain the stripping resistance below that which the firearm was designed to accommodate.

In order to reliably control and coordinate the meshing of the cartridges transitioning from four columns into two columns, it is important to maintain the pattern and relative position of every cartridge on one side of the dividing wall with respect to those cartridges on the opposite side of the dividing wall that they will eventually mesh with. If one set (on one side of the dividing wall) of the cartridges were to move slower than the other set of cartridges (on the other side of the dividing wall), then the cartridge that reaches the double column section first may cross over into the empty space of the delayed cartridge and the magazine could become jammed.

In an embodiment, to ensure that the cartridge motion on both sides of the dividing wall stays synchronized, a four column follower assembly may be adapted as one piece that surrounds the dividing wall, as do the springs, so that everything advances together or does not advance at all. In such an embodiment, the four column follower assembly may be adapted as one piece by nesting two followers, which then combine to define a one piece follower assembly.

As discussed above, U.S. Pat. No. 2,217,848 discloses a four column magazine having a dividing wall that passes completely through the fore and aft interior space of the magazine (thus vertically dividing the magazine substantially in two). Such a magazine uses two separate followers and springs so that each follower and spring must separately advance their respective two sets of cartridges with no positive connection between the two to synchronize motion. As discussed above, such separate, non-synchronized movement of the two sets of cartridges may result in undesirable jamming of the magazine.

By way of contrast with respect to U.S. Pat. No. 2,217,848 and according to an embodiment, the two followers disclosed herein may be nested in a manner that provides a positive connection therebetween, at least during a portion of their travel within the magazine housing, as described in detail below. Such positive connection facilitates the synchronization of the two sets of cartridges so as to substantially mitigate the likelihood of the magazine jamming.

As discussed above, U.S. Pat. No. 4,589,218 discloses a four column magazine that has a fore and aft dividing wall and uses a single follower to advance all four columns including advancing the last cartridge to the feed position. A single follower that will advance all four columns of cartridges cannot readily be made to continue upwardly through a double column magazine, which is the required configuration to fit the magazine well of a firearm within the M4/M16 family of weapons. This single follower design also requires a ½ cartridge diameter stagger (non-symmetrical) transition section as described in referenced patent to maintain the pattern and relative position of every cartridge on one side of the dividing wall with respect to those cartridges on the opposite side of the dividing wall that they will eventually mesh with.

By way of contrast with respect to U.S. Pat. No. 4,589,218 and according to an embodiment, the follower assembly disclosed herein comprises nested followers such that the combined followers cooperate to advance all four columns in the four column region of the magazine and such that one of the followers may separately continue upward through a two column region of the magazine as required to fit the magazine well of a firearm within the M4/M16 family of weapons. The magazine may use the ½ cartridge diameter stagger in the transition section or alternately may use a symmetrical transition section combined with followers that will work together with the symmetrical transition zone and telescope an additional ¼ cartridge diameter to insure the cartridges mesh correctly as they pass through the transition zone.

According to an embodiment, a box magazine for a firearm has a housing with two substantially different widths. The wider lower region (which defines the four column region) may accommodate four columns of cartridges thereacross. A transition defined by converging or tapered surfaces at one end of the lower region lead into a narrower upper region (which defines the two column region) which may accommodate an interlocked staggered double column of cartridges. Cartridges in the lower region may be separated into two staggered double columns by a free standing dividing wall and may be advanced by an inner contoured follower and outer contoured follower that are at least partially nested together to form a single follower assembly surrounding the freestanding wall and driven by the outer follower's spring.

According to an embodiment, an inner follower spring that is weaker than the combined outer follower springs remains telescoped in, i.e., substantially compressed, and inoperable within the outer follower to facilitate the definition of combined contoured steps of the two followers. The contoured steps support the cartridges at somewhat staggered positions that facilitate their merging at the transition. The two followers may cooperate to coordinate the advance of the two separated double columns of cartridges toward the tapered surfaces that guide and transition, i.e., merge, the two double columns into a staggered interlocked double column just above the top most end of the dividing wall. Thus, the two staggered double columns may form one staggered double column as they enter the narrower upper region of the housing.

As the last of the cartridges are advanced out of the wider lower region, the motion of the outer follower may be arrested by stops. The stopping of the outer follower may relieve the inner spring of the greater force of the outer spring which had held the inner spring inoperable and may act to release the inner follower, which may thereafter be driven independently by the inner spring so as to advance the remaining double column of cartridges through the narrower upper region of the housing.

Thus, according to an embodiment, the same configuration that is used to increase the capacity of the magazine may help to mitigate feed problems. That is, the use of four columns that merge into two columns may reduce the stripping force required such that problems caused by the firearm having insufficient stripping force are substantially mitigated. This is made possible by using a follower assembly wherein a portion thereof (one of two followers thereof) may pass through the narrower two column region of the magazine to facilitate the advancement of cartridges within the magazine.

The common M16/M4 magazine well was originally designed for a straight 20 cartridge magazine. The standard 5.56 cartridge case has a 1° included taper, the result is such that in a 20 cartridge double column magazine the follower must change its angle relative to the aft wall as the magazine is loaded and/or unloaded (such as when feeding cartridges during firing) by 10°. The cartridges adjacent to the follower must go through this same 10° angle shift.

To extend this straight design to 30 cartridges would result in the follower and the cartridges adjacent to the follower going through a 15° shift for a full magazine. This angle shift and resulting friction of the cartridges sliding on each other adds friction and thus results in unreliable function.

If a tapered cartridge is rolled across a flat surface, then the cartridge tends to roll in a substantially curved path. If the magazine has that same curve, then each cartridge contained within the magazine follows the same curved path as its neighbors without shifting fore or aft against one another. However, if those cartridges are confined to a straight magazine section, then each cartridge must slide against its neighbors to change angle as they advance. Since the cartridges are pressed hard against one another by the magazine spring force, the cartridges tend not to shift or change angle smoothly or far enough. In the straight section, some of the cartridges may shift and some of the cartridges may not shift. The result may be a sluggish magazine because of the friction of shifting. Further, there may be a tendency to present the top cartridge nose down in a manner that may cause nose-dives.

Contemporary metallic 30 cartridge magazines are straight where they fit in the magazine well and then have a curved portion below the straight portion. The curve is such that it is tighter than the natural curve created by the 1° per cartridge taper. Thus, once 30 cartridges are loaded into the magazine, then the follower and cartridges adjacent to it are relatively perpendicular to the aft and front wall of the magazine. This results in a relatively reliable 30 cartridge magazine where the follower is relatively perpendicular to the aft wall when full (and empty) and as the cartridges are removed it gradually angles nose up until reaching the straight section. The shift in angle of the follower and/or adjacent cartridges are approximately 6.5° (3.5° less than the straight 20 cartridge magazine). The follower and adjacent cartridges are approximately perpendicular to the aft wall when the magazine is full and when the magazine is empty, but are at approximately 6.5° nose up when approximately half full.

For a high capacity magazine, it is desirable to mitigate friction. Eliminating the follower changing angle and keeping the follower and the majority of cartridges relatively perpendicular to the aft wall (reducing sliding friction between cartridges as they change angle) does substantially mitigates friction and improves cartridge flow.

According to an embodiment, a substantial portion of the magazine has the correct curve for the 1° included angle of the cartridges. Between the straight section and the portion with the correct curve there may be a short section, such as between cartridge 13 and cartridge 16, that has a catch up curve. The result is that all cartridges beyond 16 the cartridges and the follower remain relatively perpendicular to the aft wall, thus substantially eliminating the sliding friction between these cartridges while the follower is advancing most of the cartridges.

Examples of embodiments are discussed below with reference to the figures. As those skilled in the art will appreciate, other embodiments, which may use other features or combinations of features, may likewise fall within the scope of the claims.

FIG. 1 illustrates a weapon system that comprises a firearm 1000 and a high capacity magazine 100, in accordance with an embodiment. The magazine 100 may be removably attached to the firearm 1000. In an embodiment, the magazine 100 may attach to the firearm 1000 using a latch, such as in the manner that a contemporary magazine attaches to an M-16 rifle. The latch may be released using a magazine release 105 to facilitate removal of the magazine 100 from the firearm 1000. In other embodiments, the magazine 100 may attach to and be released from any desired firearm in any desired manner.

The firearm 1000 may be any desired repeating fire (non-single shot) firearm. The magazine 100 may be adapted for any desired caliber and may have any desired capacity, as discussed in detail below.

FIGS. 2-9 are various views of a high capacity, e.g., 60 cartridge, magazine, according to an embodiment of the disclosure. FIGS. 10-17 are various views of a high capacity, e.g., 100 cartridge, magazine, according to an embodiment of the disclosure.

Figure 18:
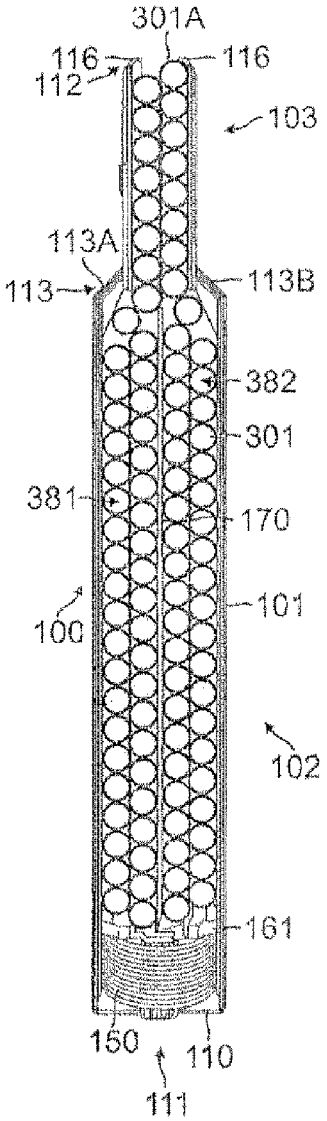
FIG. 18 is a cross-sectional view of a high capacity magazine that is substantially filled with cartridges, in accordance with an embodiment of the disclosure.
Figure 19:
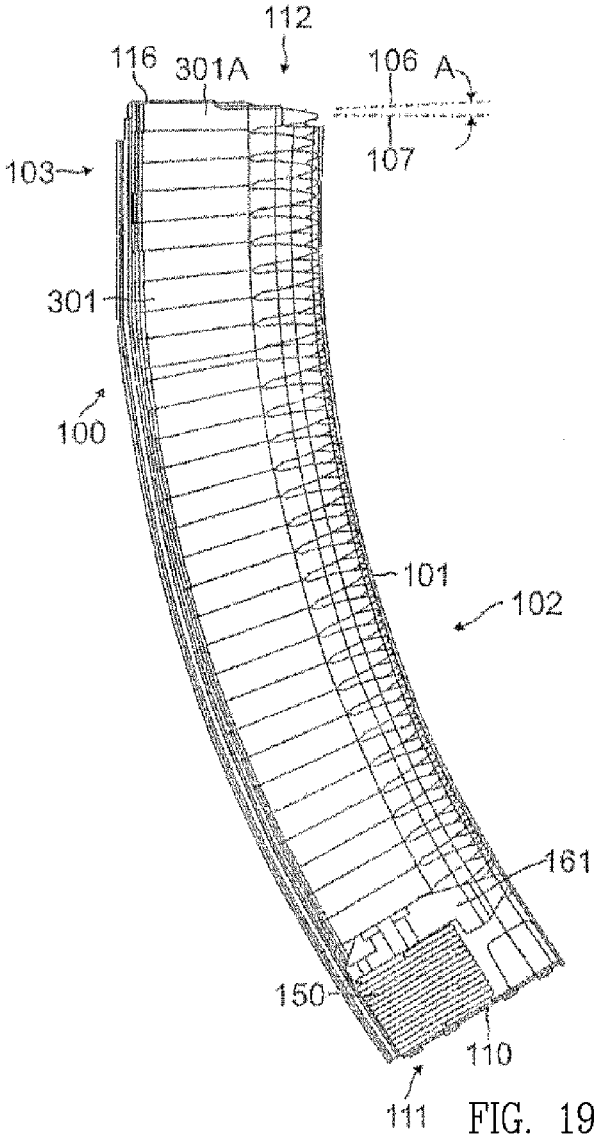
FIG. 19 is a cross-sectional view of the high capacity magazine of FIG. 18 rotated approximately 90°, in accordance with an embodiment of the disclosure.

FIGS. 18 and 19 show a magazine 100 that is substantially full of cartridges 301, according to an embodiment of the disclosure. A lower region 102 of the housing 101 may be adapted to hold cartridges 301 in a generally four across configuration and an upper region 103 of the housing 101 adapted to hold cartridges 301 in a generally two across configuration, according to an embodiment. Thus, the lower region 102 of the housing 101 may be substantially wider than the upper region 103 of the housing 101.

In the four across configuration and/or in the two across configuration, the cartridges 301 may be staggered (as shown in FIG. 18). Thus, all of the cartridges 301 in a particular row of the four across configuration and/or in a particular row of the two across configuration may be at different heights or levels with respect to one another.

Although the housing 101 may be adapted to hold cartridges 301 generally four across in a lower region 102 thereof and generally two across in an upper region 103 thereof as illustrated and discussed herein, this is by way of example only and not by way of limitation. Any desired number of regions, holding any desired number of cartridges 301 thereacross, may be used.

According to an embodiment, a tapered portion 113 may connect the lower region 102 of the housing 101 to the upper region 103 of the housing 101. The tapered portion 113 may be formed into the housing 101. The upper region 103 of the housing 101 may be adapted to be received within a magazine well 109 of the firearm 1000 (as shown in FIG. 1) and the lower region 102 may be adapted to extend outwardly, away from the firearm 1000 (as also shown in FIG. 1).

The housing 101 may comprise a bottom end 111 and a top end 112. Lips 116 may be formed at the top end 112 of the housing. The lips 116 may be adapted to keep cartridges 301 held within the housing 101 until the cartridges 301 are fed from the magazine 100, such as by action of the firearm's bolt during cocking or shooting of the firearm 1000. The lips 116 may also define one or more inner follower stops 122 that limit movement of an inner follower 162 (see FIGS. 26 and 27) away from the bottom end 111 of the housing 101.

The lips 116 may be adapted to provide an approximately 2° up angle in addition to the cartridge taper (0.5° per side for 5.56 cartridges) of the uppermost cartridge 301A to enhance feeding, prevent nosedives, and reduce stripping force of the uppermost cartridge, according to an embodiment. Thus, a longitudinal axis 106 of the uppermost cartridge 301A may form an angle, angle A, of approximately 2.5° with respect to an axis 107 that is parallel with respect to a bore of the firearm 1000.

According to an embodiment, the upper region 103 of the magazine 100 may be adapted to urge the cartridges 301 together as the cartridges 301 approach the top end of the housing 101. Thus, the cartridges 301 may be moved so that they tend to be in more of a staggered single file configuration as shown in FIG. 66 (rather than the substantially double column configuration shown in FIGS. 18 and 65). This urging of the cartridges 301 may be facilitated by making the upper region 103 more narrow as the cartridges 301 move further upward and/or by applying inward spring pressure to the cartridges 301 as the cartridges 301 move upward within the upper region 103. Such spring pressure may be applied by the housing 101 at the upper region 103 and/or by springs 150 and 151 (see FIGS. 20 and 21). Such urging of the cartridges 301 may be facilitated by applying force to the body of the cartridges 301, or alternately by applying force to any other area of the cartridge 301 (i.e. to the neck, shoulder or projectile thereof).

Urging the cartridges 301 together as the cartridges 301 approach the top end of the housing 101 tends to accelerate upward movement of the cartridges 301 as the cartridges 301 approach the top end 112 of the magazine 100. That is, within the upper region 103 the cartridges 301 closer to the top end 112 may tend to move faster than cartridges 301 further from the top end 112. This upward acceleration of the forward part of the cartridges 301 using the forward guide channel is shown in FIGS. 65-67B, 69 and 70 and insures that the foreword part of the cartridges 301 is moved to engage with the feed lips 116 and may substantially inhibit undesirable nose diving of the cartridges 301 as the cartridges 301 are fed to the firearm 1000.

Figure 24:
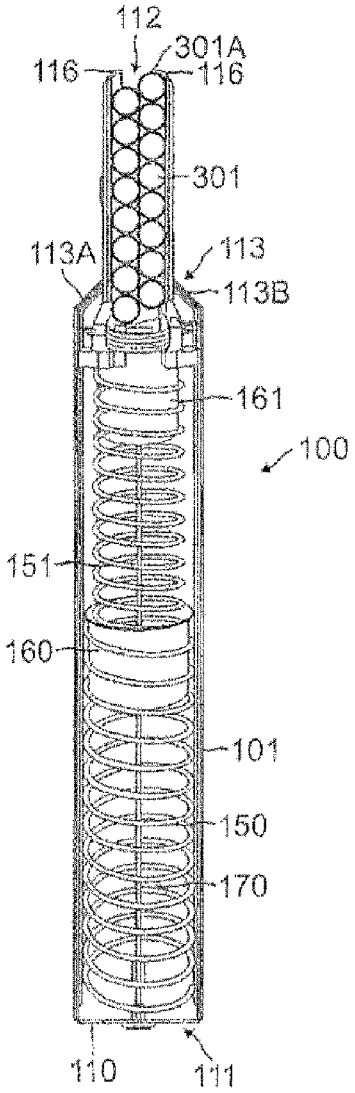
FIG. 24 is a cross-sectional view of a high capacity magazine shown holding 16 cartridges, in accordance with an embodiment of the disclosure.

The tapered portion 113 may define one or more outer follower stops 121 (see FIG. 26) inside the magazine 100. The outer follower stops 121 may limit movement of the outer follower 161 away from the bottom end 111 of the housing 101 as the outer follower 161 moves upwardly (as shown in FIG. 24). For example, one or more portions of the outer follower 161 may abut the outer follower stops 121 as the outer follower 161 moves upwardly. Inner guide surfaces (such as 146 of FIG. 53) of the magazine 100 may be used as follower stops for the outer follower 161.

According to an embodiment, the housing 101, the outer follower 161, and the inner follower 162 may be made of metal, plastic, carbon fiber, fiberglass, and/or epoxy resin. For example, the housing 101 may be made of sheet metal or plastic. As a further example, the housing 101 may be made of any desired combination of aluminum, steel, and/or titanium. Any other suitable material or combination of materials may similarly be used. The housing 101 may be made by forming, e.g., bending and stretching, and/or by machining, e.g., milling. The housing 101 may be made by any desired method.

With particular reference to FIGS. 18 and 19, cross-sectional views of the magazine 100 completely filled with cartridges 301 are illustrated, in accordance with an embodiment. For example, the magazine 100 may be configured in this manner when it has been completely loaded and none of the cartridges 301 have been fired or otherwise removed therefrom.

Figure 30A:
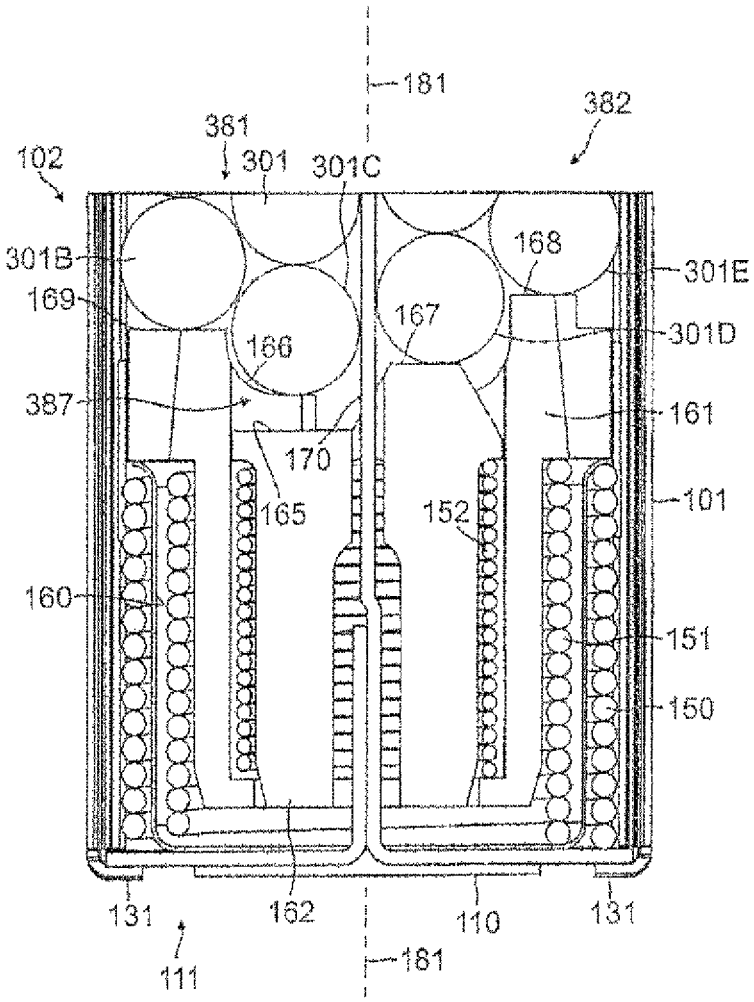
FIGS. 30A-30C are views the inner follower and outer follower of a capacity magazine in accordance with an embodiment of the disclosure.

It will be noted that the first spring 150, the second spring 151, and the third spring 152 may be substantially fully compressed when the magazine 100 is fully loaded. This configuration of the first spring 150, the second spring 151, and the third spring 152 is shown in FIG. 30A and is discussed in further detail with respect thereto. With the magazine 100 completely filled with cartridges 301 as shown in FIGS. 18, 19 and 30, or with the magazine partially filled with cartridges 301 as shown in FIGS. 20-25, the uppermost cartridge 301A, and consequently the other cartridges 301, may be held in place by the lips 116.

FIGS. 18-27 show the magazine in various different states, i.e., loaded with different numbers of the cartridges 301 or loaded with none of the cartridges 301. Inside of the housing 101 may be held a mechanism for feeding cartridges 301 upwardly, toward the top end 112 of the housing 101. This mechanism may comprise the first spring 150, the spring cup 160, the second spring 151, the outer follower 161, the third spring 152, the inner follower 162, and a dividing wall 170.

The housing 101 may substantially define an enclosure for the magazine 100. In an embodiment, substantially all of the components of the magazine 100, as well as any cartridges 301 held therein, may be disposed within the housing 101. In another embodiment, the housing 101 may be more frame-like. For example, the housing 101 may have substantial openings such that the housing 101 does not completely enclose all of the components of the magazine 100, as well as any cartridges 301 held therein. In another embodiment, portions or entire components of the magazine 100 may be disposed outside of the housing 101. Accordingly, the housing 101 may have any desired configuration.

According to an embodiment, the first spring 150 may be disposed substantially between the spring cup 160 and the bottom end 111 of the housing 101. The spring cup 160 may be disposed substantially between the first spring 150 and the second spring 151. The second spring 151 may be disposed substantially between the spring cup 160 and the outer follower 161. The outer follower 161 may be disposed substantially between the second spring 151 and the third spring 152. The third spring 152 may be disposed substantially between the outer follower 161 and the inner follower 162. The inner follower 162 may be disposed substantially between the third spring 152 and the top end 112 of the housing 101.

According to an embodiment, the dividing wall 170 may extend upwardly from the bottom end 111 of the housing 101 and may be attached to the housing 101 only at the bottom end 111 of the housing 101. Thus, the dividing wall 170 may be adapted such that it is not supported along the length thereof or at the top end thereof and is freestanding, flexible, and self-centering. The dividing wall 170 may be supported and centered by the cartridges 301 on either side thereof when the magazine 100 is at least partially filled with the cartridges 301.

The dividing wall 170 may extend through the first spring 150, the spring cup 160, the second spring 151, the outer follower 161, the third spring 152, and the inner follower 162. The dividing wall 170 may extend through the first spring 150 and the second spring 151, such as through the entire lengths thereof, when the first spring 150 and the second spring 151 are fully expanded within the housing 101. The dividing wall 170 may extend substantially along a central (e.g. longitudinal) axis 181 of the first spring 150 and the second spring 151.

The dividing wall 170 may extend through a portion of the third spring 152 when the third spring 152 is fully expanded within the housing 101 and may extend along the entire length of the third spring 152 when the third spring 152 is at least partially compressed (as shown in FIG. 24). The dividing wall 170 may extend substantially along the central axis 181 of the first spring 150 and the second spring 151.

The outer follower 161 and the inner follower 162 may move or slide within the housing 101 and along the dividing wall 170. A bore 163 and an opening 164 (shown in FIG. 35) within the outer follower 161 and the inner follower 162, respectively, may receive the dividing wall 170 and facilitate such movement.

Figure 26:
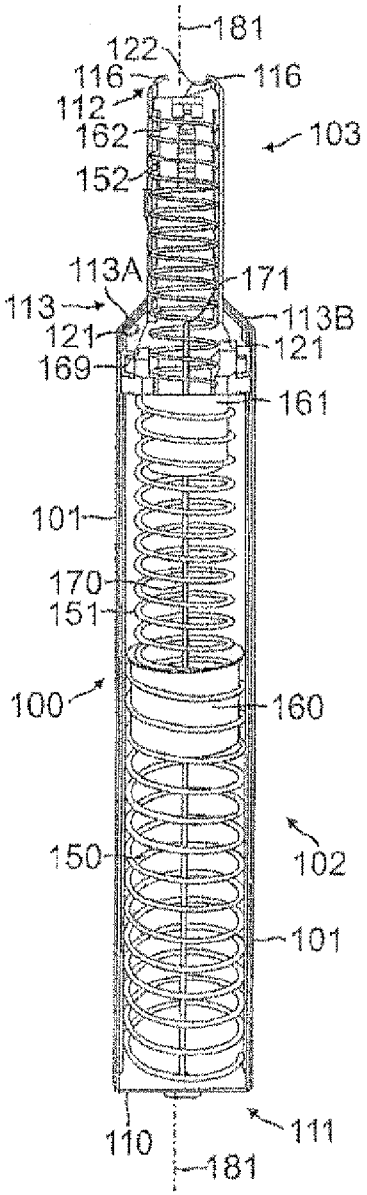
FIG. 26 is a cross-sectional view of a high capacity magazine that has no cartridges held therein, in accordance with an embodiment of the disclosure.
Figure 27:
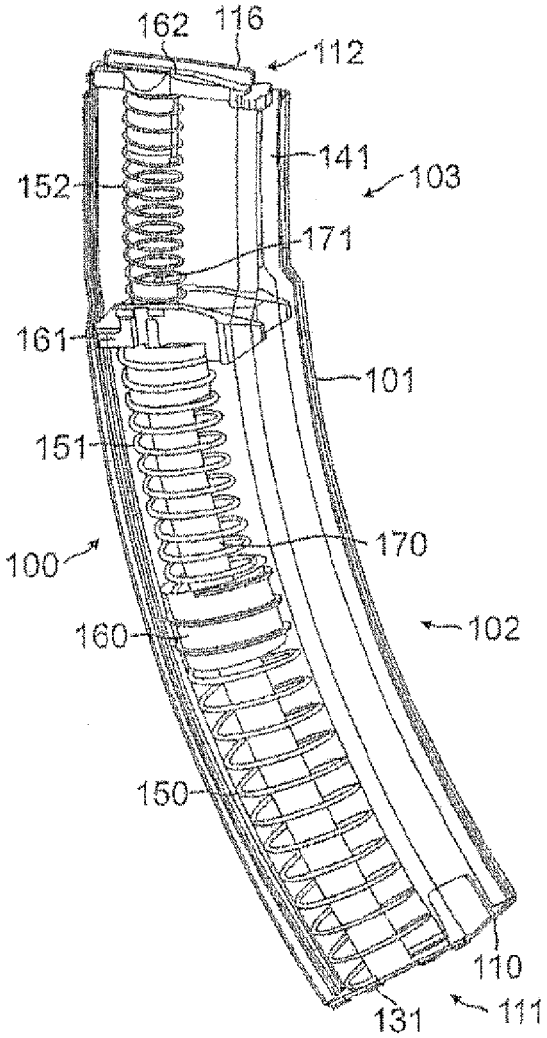
FIG. 27 is a perspective, cross-sectional view of the empty high capacity magazine of FIG. 26 rotated approximately 90°, in accordance with an embodiment of the disclosure.

FIGS. 26 and 27 illustrate the magazine 100 having no cartridges 301 held therein, in accordance with an embodiment. Thus, the magazine 100 is empty as it would be prior to loading with cartridges 301 and as it would be after all of the cartridges 301 have been fed therefrom (such as after shooting of the firearm 1000).

Thus, the magazine 100 may comprise the housing 101, within which the cartridges 301 may be disposed (as shown in FIGS. 18-25). The cartridges 301 disposed within housing 101 may be fed from the magazine 100 into the firearm 1000, as discussed in detail herein. The housing 101 may be adapted to hold a larger number of the cartridges 301 as compared to typical contemporary magazines, particularly contemporary box magazines of approximately the same length.

For example, the housing 101 may be adapted to hold 30, 50, 100, 150, or more of the cartridges 301. The housing 101 may be adapted to hold any desired number of cartridges 301. Thus, although the housing 101 illustrated in FIGS. 18-27 is adapted to hold 100 of the cartridges 301, this is by way of example only and not by way of limitation.

The housing 101 may be adapted to hold any desired type of the cartridges 301. For example, the housing 101 may be adapted to hold any desired caliber of rifle or pistol cartridges. More particularly, the housing 101 may be adapted to hold 0.223, 5.56×45 NATO, 7.62×39 mm, or 7.62×51 NATO, for example.

Figure 28:
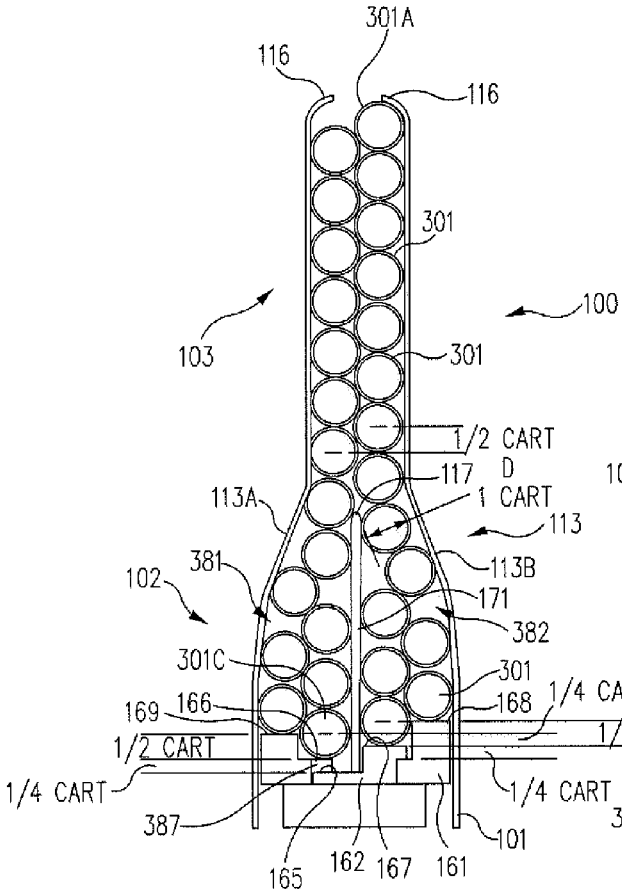
FIG. 28 is an enlarged cross-sectional view of a high capacity magazine showing merging of cartridges at a tapered portion thereof, in accordance with a symmetric housing embodiment of the disclosure.

FIG. 28 is an enlarged cross-sectional view of the high capacity magazine 100 showing merging of the cartridges 301 at a tapered portion 113 thereof, in accordance with an embodiment of the disclosure. According to this embodiment, the tapered portion 113 is substantially symmetric (has portions 113A and 113 B which are substantially symmetric with respect to one another) and a ¼ cartridge diameter gap 387 is provided between the lowermost cartridge 301 and the inner follower 162. The two sets of cartridges that form the 4 column section may be mirror images of each other and offset to each other by ¼ cartridge diameter.

Figure 29:
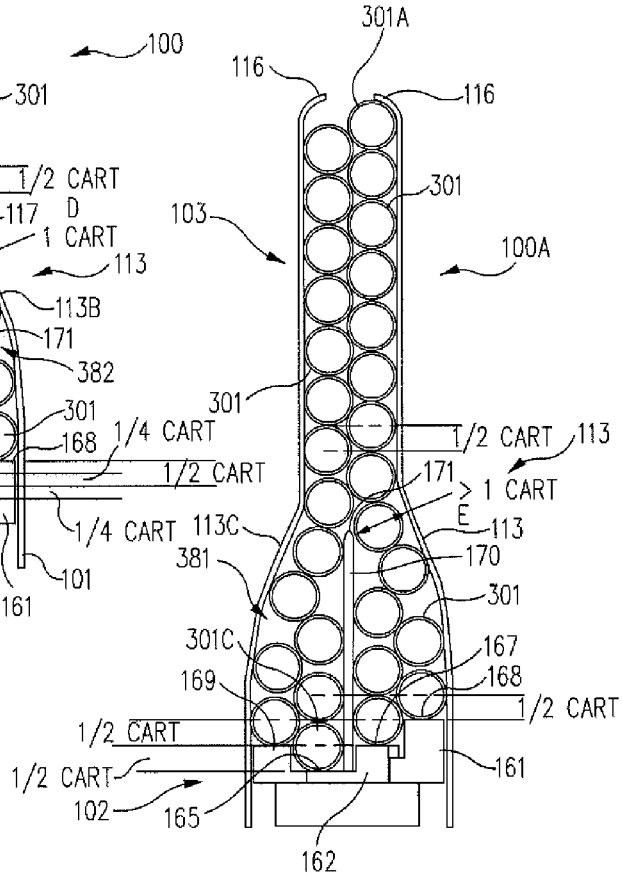
FIG. 29 is an enlarged cross-sectional view of a high capacity magazine showing merging of cartridges at a tapered portion thereof, in accordance with an asymmetric housing embodiment of the disclosure.

FIG. 29 is an enlarged cross-sectional view of the high capacity magazine 100 showing merging of cartridges at a tapered portion 113 thereof, in accordance with another embodiment of the disclosure. According to this embodiment, the tapered portion 113 is substantially asymmetric (has portions 113A and 113 B which are substantially asymmetric with respect to one another) and no gap is provided between the lowermost cartridge 301 and the inner follower 162.

Figure 30B:
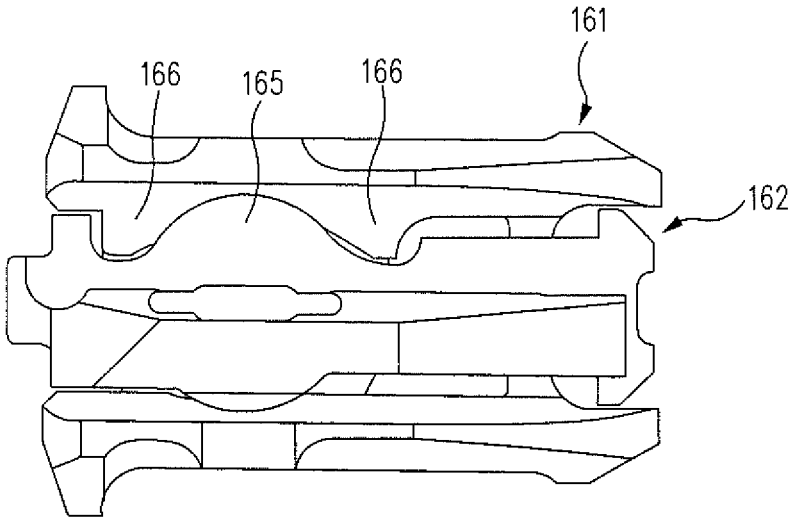
Figure 30C:
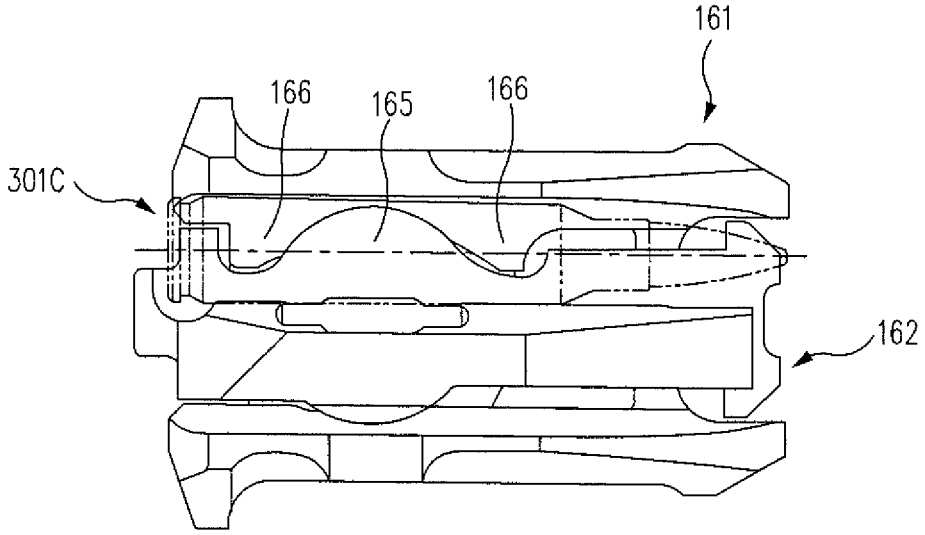

With particular reference to FIGS. 30A-30C, an enlarged, cross-sectional view of the bottom end 111 of a full high capacity magazine 100 is illustrated in accordance with an embodiment. As mentioned above, when the magazine 100 is fully loaded with cartridges 301, then the first spring 150, the second spring 151, and the third spring 152 may be fully compressed. In this configuration, the spring cup 160 may be substantially nested within the first spring 150, the second spring 151 may be substantially nested within the spring cup 160, the outer follower 161 may be substantially nested within the second spring 151, the third spring 152 may be substantially nested within the outer follower 161, and the inner follower 162 may be substantially nested within the third spring 152.

By substantially nesting or telescoping the first spring 150, the second spring 151, and the third spring 152, the use of a shorter spring assembly may be facilitated. For example, approximately twice the number of spring coils may be used as could otherwise be done.

According to an embodiment, cartridge 301B may be substantially supported by surface 169 of the outer follower 161. Cartridge 301C may be substantially supported by surface 166 of the outer follower 161, cartridge 301D may be substantially supported by surface 167 of the inner follower 162, and cartridge 301E may be substantially supported by surface 168 of the outer follower 161. An approximately ¼ cartridge diameter gap 387 may be formed between cartridge 301C and surface 165 of the inner follower 162 so as to better facilitate the merging of cartridges, when using a symmetrical transition section 113 as discussed herein. The inner follower 162 may accommodate an offset of a distance of approximately ½ of a diameter of the cartridges 301 to properly advance cartridges through the upper two column section.

Figure 31:
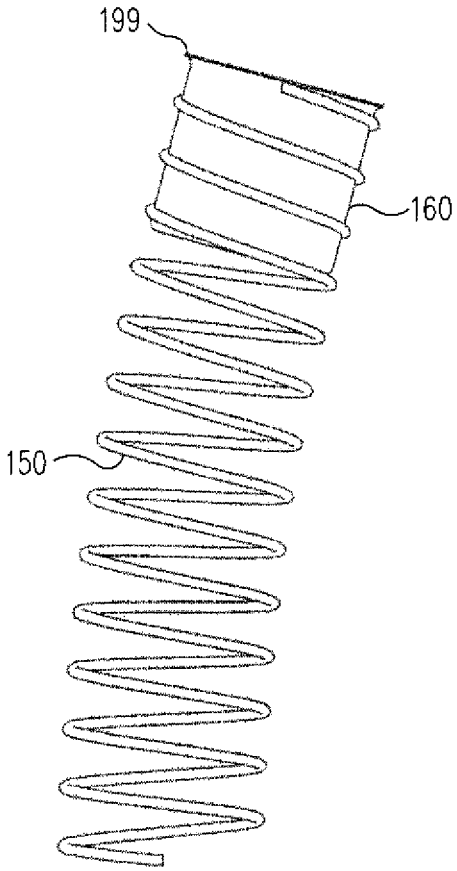
FIG. 31 is a side view of a first spring and a spring cup of a high capacity magazine, in accordance with an embodiment of the disclosure.

FIG. 31 is a side view of the first spring 150 and the spring cup 160 of the high capacity magazine 100, in accordance with an embodiment. The spring cup 160 is shown nested within a portion of the first spring 150.

Figure 32:
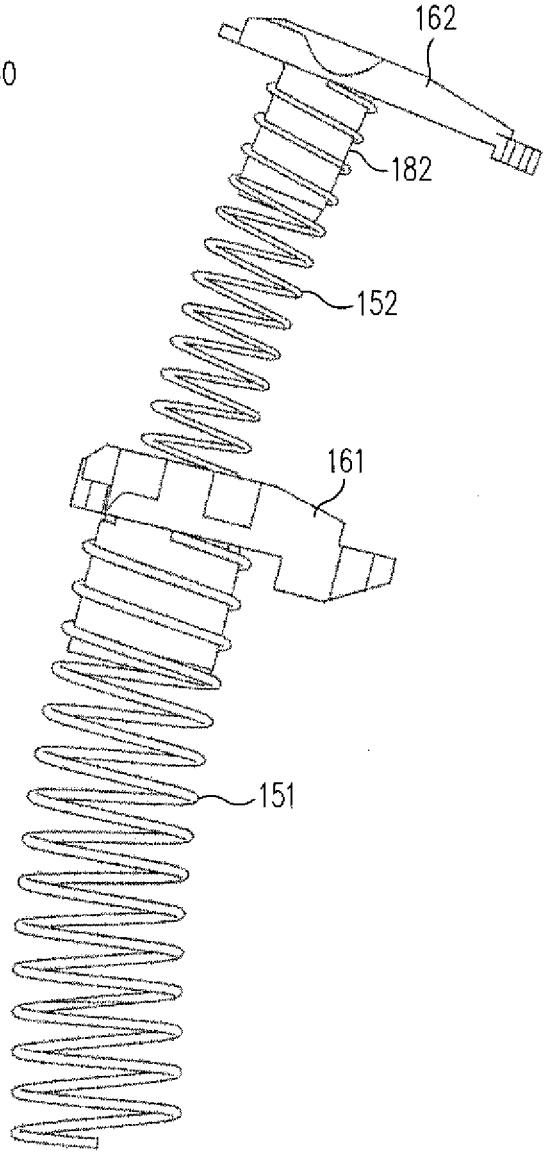
FIG. 32 is a side view of a second spring, an outer follower, a third spring, and an inner follower of a high capacity magazine, in accordance with an embodiment of the disclosure.

FIG. 32 is a side view of the second spring 151, the outer follower 161, the third spring 152, and the inner follower 162 of the magazine 100, in accordance with an embodiment. A portion of outer follower 161 is shown nested within a portion of the second spring 151, a portion of the third spring 152 is shown nested within a portion of the outer follower 161, and a portion of the inner follower 162 is shown nested within a portion of the third spring 152.

Figure 35:
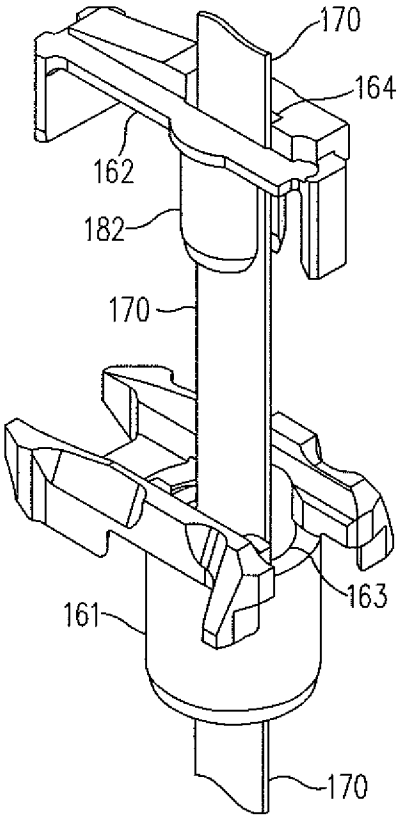
FIG. 35 is a perspective view of the inner follower and the outer follower of FIGS. 33 and 34, also showing a dividing wall, in accordance with an embodiment of the disclosure.
Figure 34:
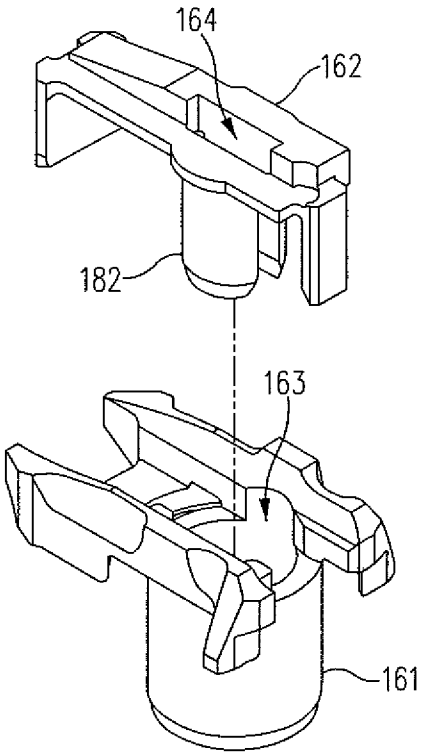
FIGS. 33 and 34 are perspective views of an inner follower and an outer follower positioned such that the inner follower may move downwardly so as to nest at least partially within the outer follower, in accordance with an embodiment of the disclosure.
Figure 33:
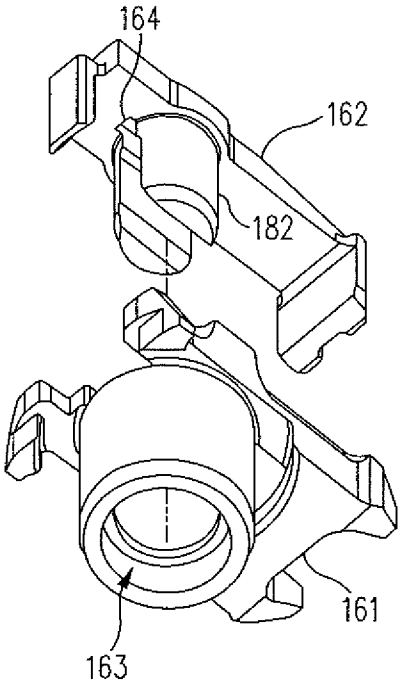

FIGS. 33 and 34 are perspective views of the inner follower 162 and the outer follower 161 positioned such that the inner follower 162 may move so as to nest at least partially within the outer follower 161, in accordance with an embodiment of the disclosure. FIG. 35 is a perspective view of the inner follower 162 and the outer follower 161 of FIGS. 33 and 34, also showing the dividing wall 170, in accordance with an embodiment of the disclosure.

Figure 36:
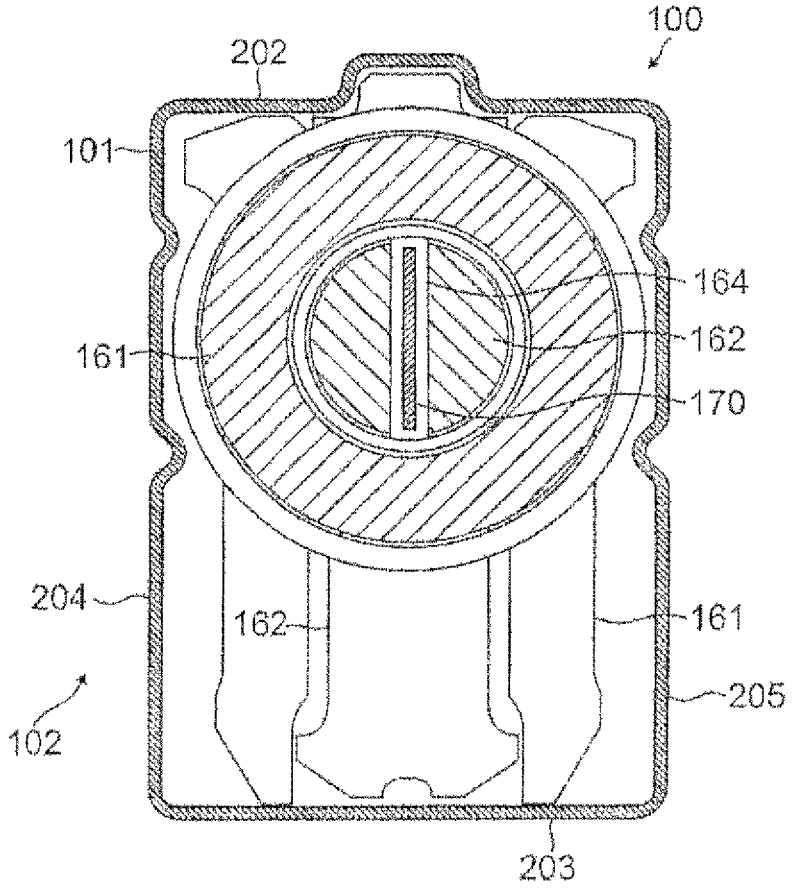
FIG. 36 is a cross-section view showing an inner follower nested within an outer follower, in accordance with an embodiment of the disclosure.
Figure 37:
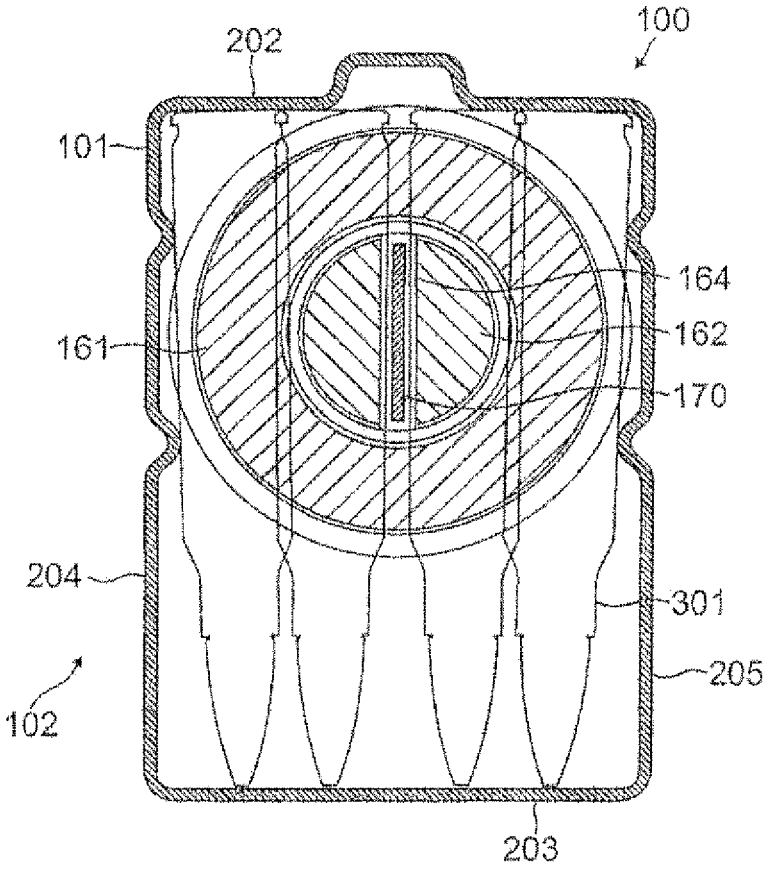
FIG. 37 is a cross-sectional view of the inner follower and the outer follower of FIG. 36, also showing four cartridges disposed above the inner follower and the outer follower, in accordance with an embodiment of the disclosure.

FIG. 36 is a cross-section view showing the inner follower 162 nested within the outer follower 161, in accordance with an embodiment of the disclosure. FIG. 37 is a cross-sectional view of the inner follower 162 and the outer follower 161 of FIG. 36, also showing four cartridges 301 disposed above the inner follower 162 and the outer follower 161, in accordance with an embodiment of the disclosure. The inner follower 162 may nest either completely or partially within the outer follower 161.

Figure 38:
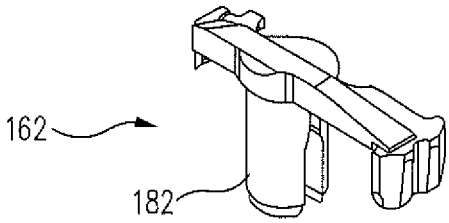
FIG. 38 is a perspective view of an inner follower, in accordance with an embodiment of the disclosure.
Figure 39:
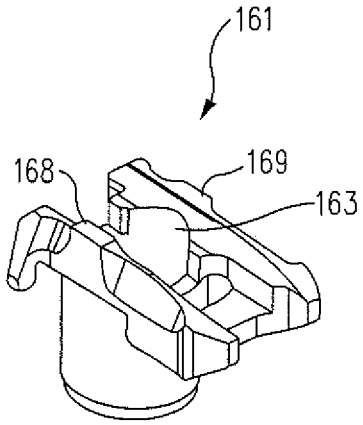
FIG. 39 is a perspective view of an outer follower, in accordance with an embodiment of the disclosure.
Figure 40:
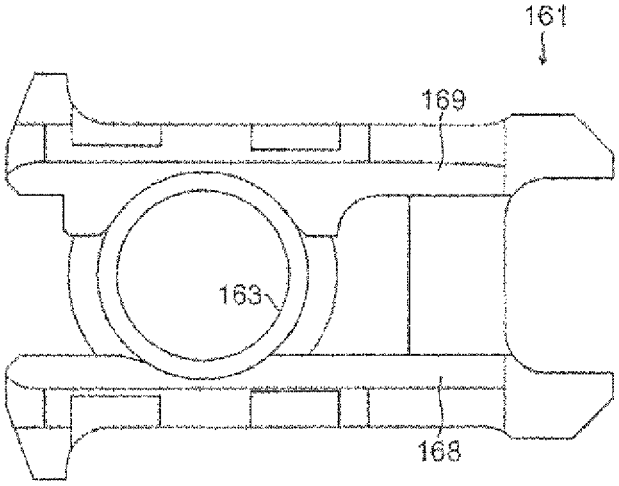
FIG. 40-42 are various views of an outer follower, in accordance with an embodiment of the disclosure.
Figure 41:
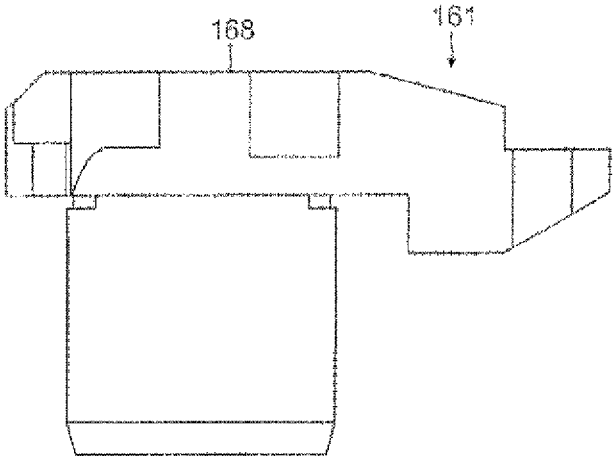
Figure 42:
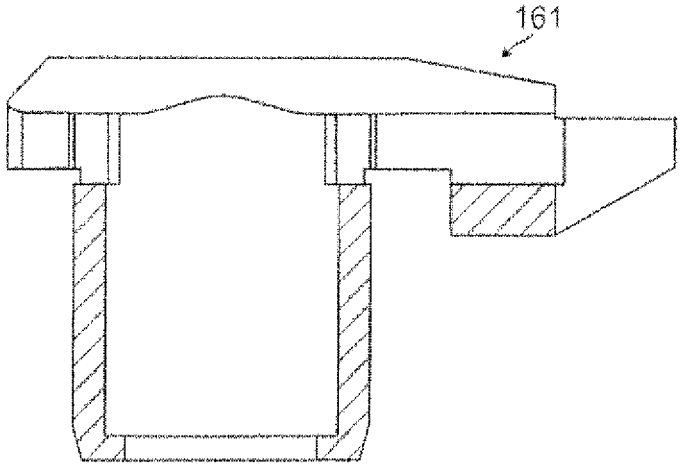
Figure 43:
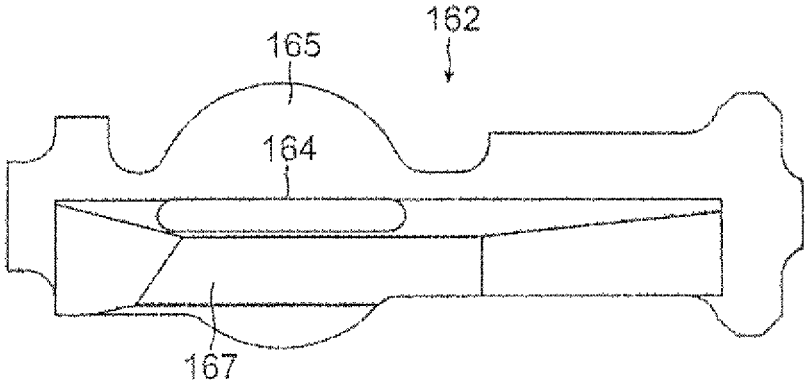
FIG. 43-44 are various views of an inner follower, in accordance with an embodiment of the disclosure.
Figure 44:
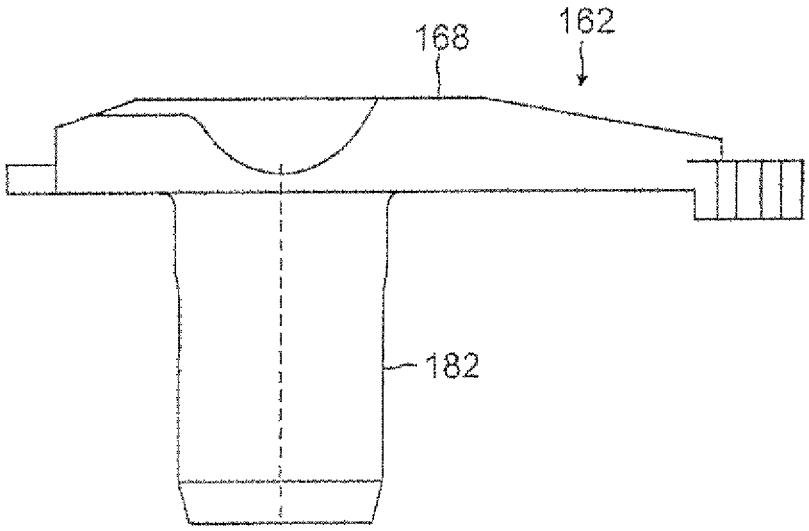

FIG. 38 is a perspective view of the inner follower 162, in accordance with an embodiment of the disclosure. FIG. 39 is a perspective view of the outer follower 161, in accordance with an embodiment of the disclosure. FIG. 40-42 are various views of the outer follower 161, in accordance with an embodiment of the disclosure. FIG. 43-44 are various views of the inner follower 162, in accordance with an embodiment of the disclosure.

Figure 46:
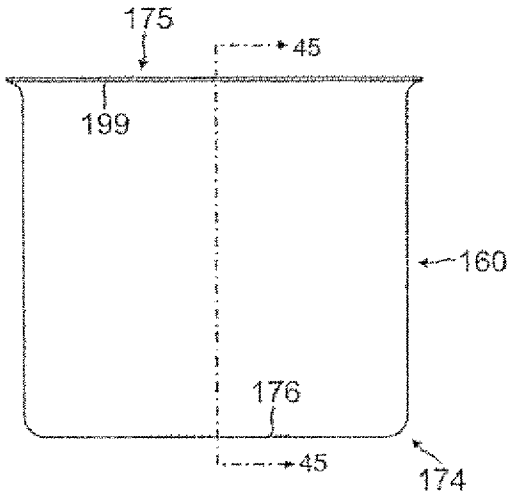
FIG. 45-46 are various views of a spring cup, in accordance with an embodiment of the disclosure.
Figure 45:
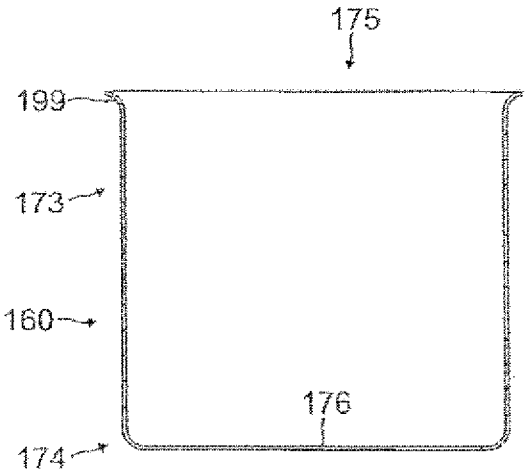
Figure 47:
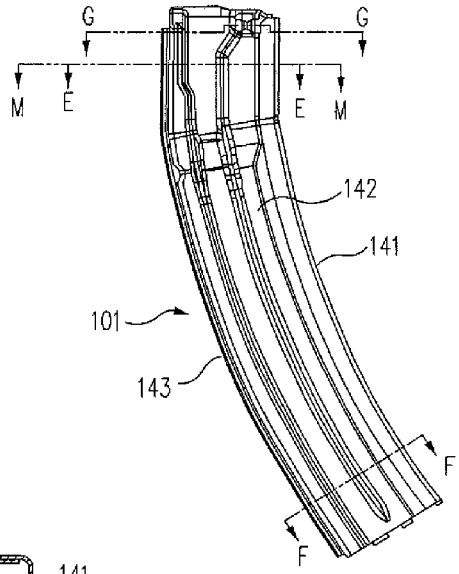
FIG. 47-58 are various views of a housing, in accordance with an embodiment of the disclosure.
Figure 48:
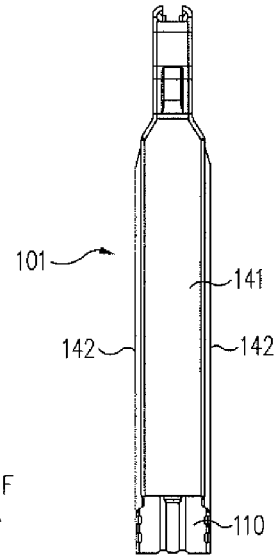
Figure 49:
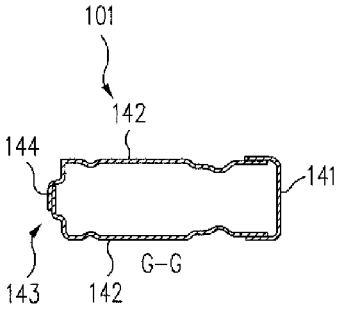
Figure 50:
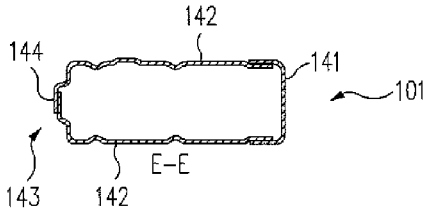
Figure 51:
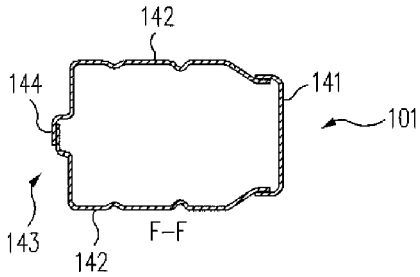

FIGS. 45 and 46 illustrate a side view of the spring cup 160, in accordance with an embodiment. The spring cup 160 may be shaped generally like a cup. A flare or lip 199 may be formed along an upper end 173 of the spring cup 160. The spring cup 160 may be substantially hollow. The spring cup 160 may have an opening 175 formed at the upper end thereof and may have a floor 176 formed at a lower end 174 thereof. The floor 176 may extend across the entire lower end 174 or may be define by a lip that extends only partially across the lower end 174. Thus, the floor 176 may have an opening, such as a central opening, formed therein.

The spring cup 160 may be adapted to receive and at least partially nest the second spring 151 therein. Thus, the spring cup 160 may have sufficient room therein to accommodate at least a portion of the second spring 151.

The spring cup 160 may be adapted to be received within and at least partially nest within at least a portion of the first spring 150. Thus, the first spring 150 may have at least a portion thereof that is large enough to accommodate the spring cup 160.

The spring cup 160 may be formed of metal, such as steel, aluminum, or titanium. The spring cup 160 may be formed by machining or by forming. For example, the spring cup 160 may be formed by drawing steel through a shaping die. As a further example, the spring cup 160 may be made by forming the outwardly extending lip 199, as well as an inwardly extend lip sufficient to define the floor 176, upon a section of steel tubing.

In any of the embodiments disclosed herein, round springs having round cross-sections may be used. As those skilled in the art will appreciate, round springs typically weigh less that non-round, e.g., rectangular, springs of the same strength. However, any desired shape and/or cross-sectional configuration of springs may be used in any desired combination.

More than three springs may be used if desired. As many springs as desired may be used. The use of more nested springs may, at least in some instances, facilitate the construction of a more compact magazine.

FIG. 47-58 are various views of the housing 101, in accordance with one or more embodiments of the disclosure. These views show the housing 101 of a 100 cartridge magazine 100. A similar housing 101, generally having a different length, may be used for magazines having different capacities. Generally, magazines having different capacities will also have a first spring 150, a second spring 151, and a third spring 152 of different lengths to accommodate the different length of the housing 101.

Figure 59:
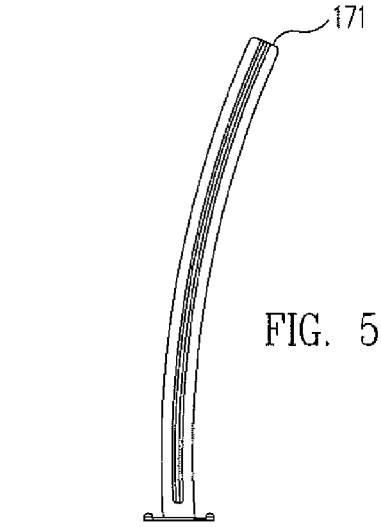
FIG. 59-61 are various views of a dividing wall, in accordance with an embodiment of the disclosure.
Figure 60:
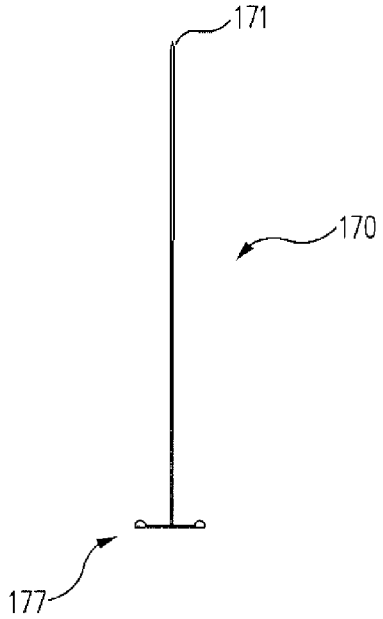
Figure 61:
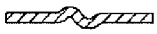

FIG. 59-61 show the dividing wall 170 of the magazine 100, in accordance with an embodiment. The dividing wall 170 may have a tip 171 and a bottom end 177. The dividing wall 170 may or may not guide the first spring 150, the second spring 151, and/or the third spring 152. The housing 101 may guide the first spring 150, the second spring 151, and/or the third spring 152. The dividing wall 170 and the housing 101 may cooperate to guide the first spring 150, the second spring 151, and/or the third spring 152.

The dividing wall 170 may separate cartridges 301 within the lower region 102 of the housing 101 into a first set 381 or column and a second set 382 set or column thereof (as shown in FIG. 18). In an embodiment, the dividing wall 170 may be only attached to the housing 101 at the bottom end 177 of the dividing wall 170, which may attach to a bottom plate 110 (FIGS. 18 and 19) of the housing 101. The dividing wall 170 may attach to the bottom plate 110 in any desired manner. For example, the dividing wall 170 may attach to the bottom plate 110 using spot welding, fasteners (such as screws), and/or adhesive bonding or may be held to the bottom by the force of the spring 150.

The tip 171 of the dividing wall 170 may be disposed within the tapered portion 113 of the housing 101, such that the tip 171 of the dividing wall 170 is located proximate where the four column configuration of cartridges 301 merge into the two column configuration of cartridges 301 (see FIGS. 18 and 19). The tip 171 of the dividing wall 170 may facilitate separation of the cartridges 301 being loaded into the magazine 100 into the first 381 and second 382 sets thereof, as discussed in detail below. The tip 171 of the dividing wall 170 may facilitate merging of the cartridges 301 being fed from the lower region 102 into the upper region 103, as discussed in detail below.

Figure 62:
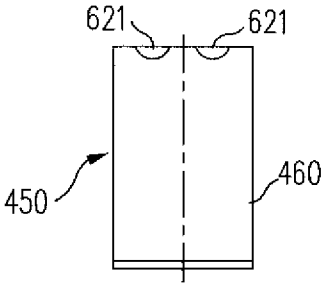
FIG. 62-63 are various views of a doubler (which doubles the thickness of the front wall) with ramps, in accordance with an embodiment of the disclosure.
Figure 63:
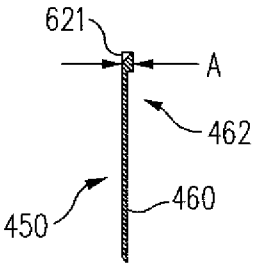
Figure 64:
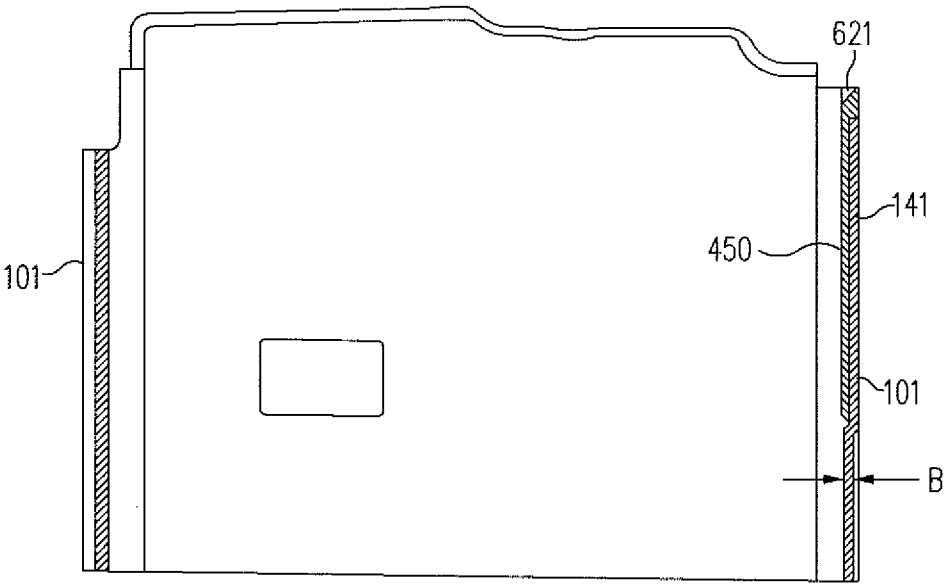
FIG. 64 is a cross-sectional view of the upper end of a magazine, showing the doubler with feed ramp of FIGS. 62-63, in accordance with an embodiment of the disclosure.

FIG. 62-64 are various views of a doubler (so name because it may approximately double a thickness of a portion, e.g., a front wall 141, of the housing 101) or ramp assembly 450, in accordance with an embodiment of the disclosure. Two ramps 621 may comprise two substantially cylindrical cutouts formed in a ramp body 460. The two ramps 621 may be beveled or slanted portions of the ramp assembly 450 (such as beveled or slanted portions defined by the two cylindrical cutouts or otherwise defined). The two ramps 621 may tend to guide a cartridge 301 from the magazine 100 into a chamber of a firearm 1000. The ramp assembly 450 may be attached to the front wall 141 (FIG. 64) of the magazine, in accordance with an embodiment.

The ramps 621 may be adapted to enhance feeding of cartridges 301 from the magazine 100 to the firearm 1000. More particularly, the ramps 621 may be angled or adapted such that cartridges 301 slide thereover and may be thus guided thereby from the magazine 100 to the firearm 1000. The ramps 621 may extend entirely across the ramp body 460 (as shown in FIG. 63). Alternatively, the ramps 621 may extend partially across the ramp body 460.

Thus, the ramps 621 may tend to ease cartridges 301 upwardly from the magazine 100 to the firearm 1000. The use of such a ramps 621 may reduce failures/nosedives associated with the feeding process. The use of such ramps 621 may better, e.g., more precisely, guide cartridges 301 from magazine 100 to the firearm 1000.

The ramps 621 may comprise a hardened material, such as hardened steel, for durability. The ramps may comprises any desired material.

According to an embodiment, two ramps 621 may be provided. The use of two ramps 621 facilitates feeding of the cartridges 301 from either side (e.g. either one of the two upper columns) of the magazine 100.

The ramp assembly 450 may cooperate with the approximately 2° angle of the lips 116, and/or the urging of cartridges 301 into a more single file configuration by the upper region 103 of the housing 101, so as to inhibit nose diving of cartridges 301 as the cartridges 301 are fed from the magazine 100. The approximately 2° angle and the more single file configuration better position the cartridges 301 for feeding and the ramp assembly 450 better facilitate movement of the cartridges 301 as the cartridges 301 are fed. Each of the approximately 2° angle, the more single file configuration of the cartridges 301, and the ramp assembly 450 may be used alone, without the other(s), if desired.

According to an embodiment (such as the embodiment of FIGS. 62-64), the ramp body 460 may have a thickness, Dimension A of FIG. 63, that may be approximately twice the thickness, dimension B of FIG. 64, of the front wall 141 of the magazine 100. Thus, the ramp body 460 may receive the front wall 141 within a cutout portion 462 of the ramp body 460 so as to better facilitate attachment of the ramp assembly 450 to the front wall 141. The ramp assembly 450 may be attached to the front wall 141 by any desired method. For example, the ramp assembly 450 may be spot welded, attached using one or more fasteners (such as screws or rivets), or adhesively bonded to the front wall 141.

Figure 65:
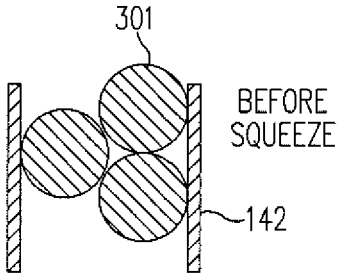
FIG. 65 shows three cartridges before being squeezed by the magazine (such as taken from sectional line 65 of FIG. 67A), in accordance with an embodiment of the disclosure.
Figure 66:
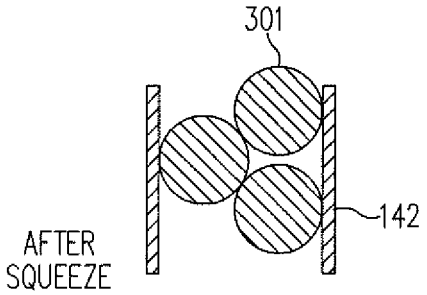
FIG. 66 shows three cartridges after being squeezed by the magazine (such as taken from sectional line 66 of FIG. 67B), in accordance with an embodiment of the disclosure.

FIG. 65 shows three cartridges before being squeezed by the magazine 100, in accordance with an embodiment of the disclosure. Each of the cartridges 301 touches each of the other two cartridges 301 before the cartridges 301 are squeezed.

FIG. 66 shows three cartridges after being squeezed by the magazine 100, in accordance with an embodiment of the disclosure. The two cartridges 301 on the right only touch one other of the cartridges 301 (the cartridge on the left). The two cartridges 301 on the right do not touch on another. The cartridges 301 are in more of a staggered, single column configuration as compared to the cartridges 301 of FIG. 65. This squeezing and/or staggering of the cartridges 301 may continue (and thus be further exaggerated) until the cartridges are in a single column or are almost in a single column. This squeezing and/or staggering of the cartridges 301 may continue to any desired amount.

Figure 67A:
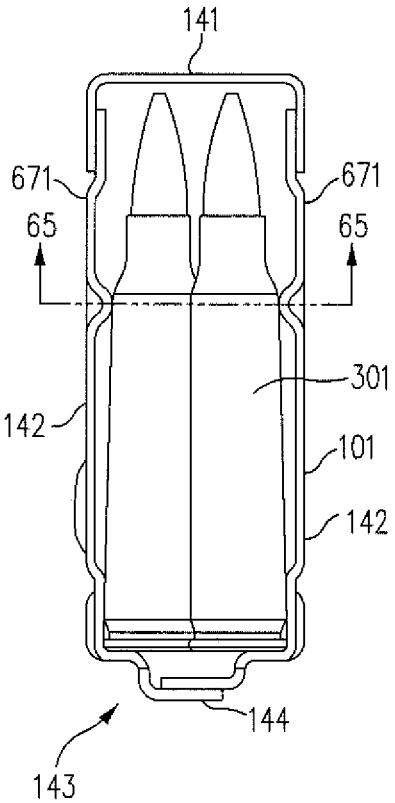
FIG. 67A shows a portion of the magazine that is adapted to squeeze cartridges, in accordance with an embodiment of the disclosure.

FIG. 67A shows a portion of the magazine 100 that may potentially squeeze the cartridges 301 together, in accordance with an embodiment of the disclosure. The two forward portions 671 of the side walls may be spring biased inwardly so that they may apply inward pressure to the cartridges 301. As shown in FIG. 67A, the forward portions 671 have not yet squeezed the cartridges 301 inwardly.

Figure 67B:
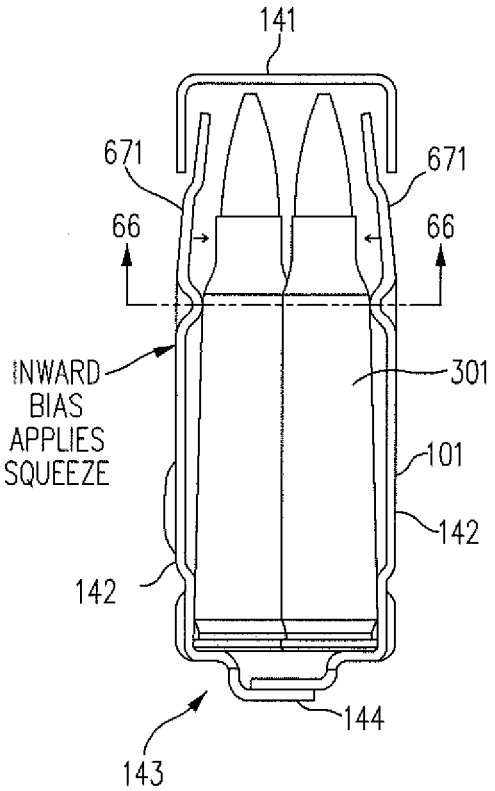
FIG. 67B shows a portion of the magazine that is squeezing cartridges, in accordance with an embodiment of the disclosure.

FIG. 67B shows the two forward portions 671 of the magazine 100 that squeeze the cartridges 301 together, in accordance with an embodiment of the disclosure. The portions 671 have moved inwardly so as to squeeze the cartridges 301 inwardly and thus cause the cartridges 301 to criss-cross somewhat, thus angling the nose of the uppermost cartridge 301 upwardly so as to enhance feeding of the uppermost cartridge 301 from the magazine 100. For example, angling the nose of the uppermost cartridge 301 upwardly may mitigate the occurrence of nose dives.

Figure 67C:
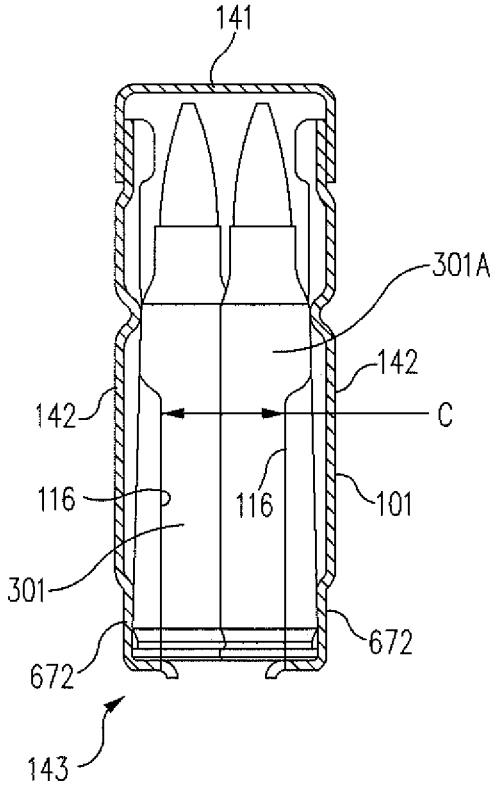
FIG. 67C is a top view of a magazine having wide feed lip opening, according to an embodiment.
Figure 68A:
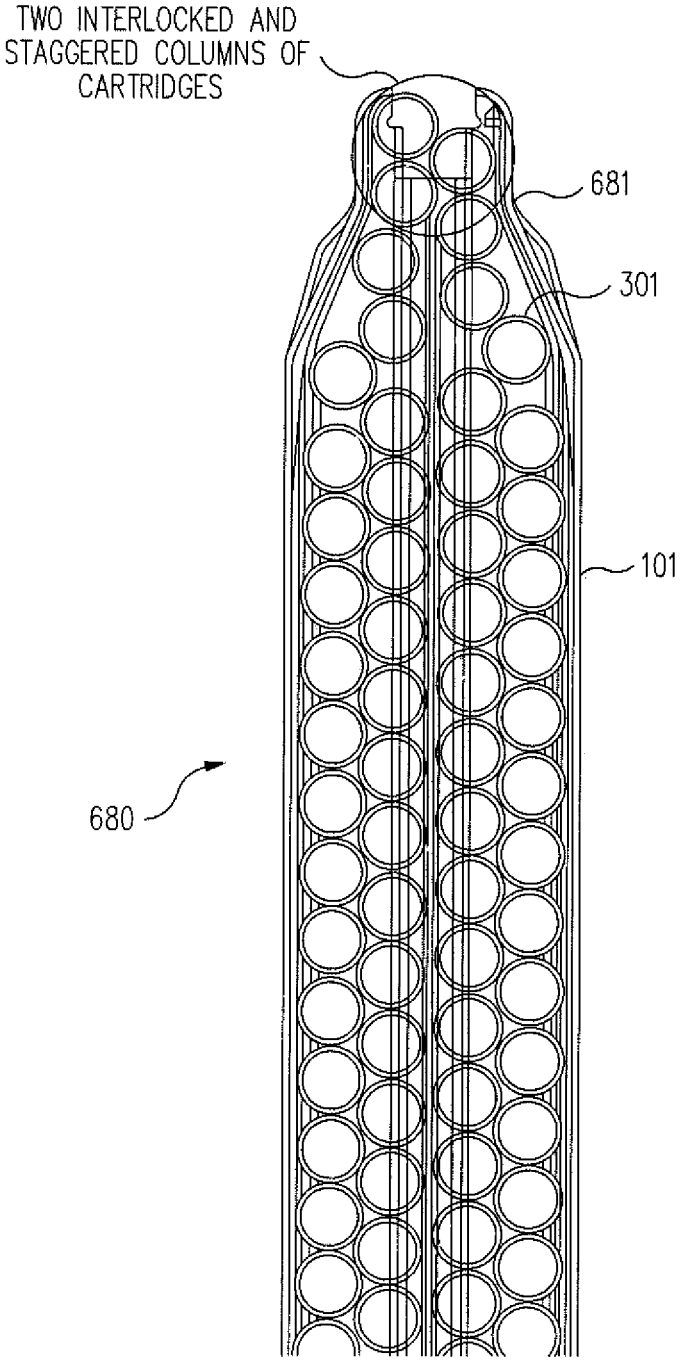
FIGS. 68A-68K show a magazine having a short neck, in accordance with an embodiment of the disclosure.
Figure 68D:
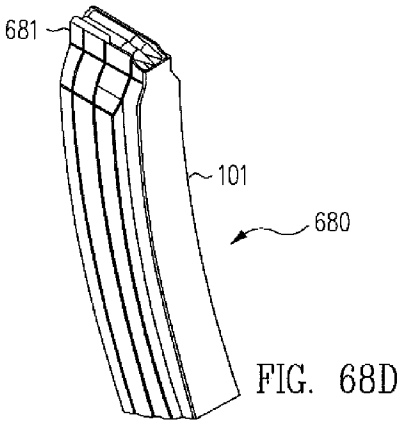
Figure 68E:
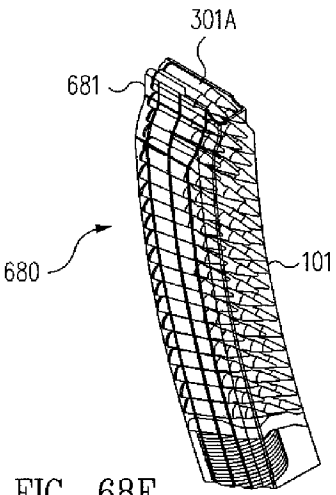
Figure 68C:
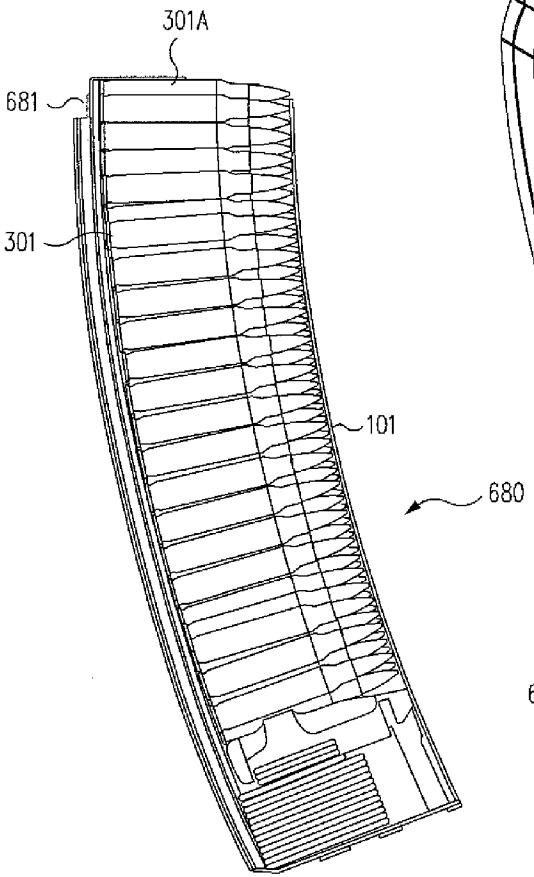
Figure 68B:
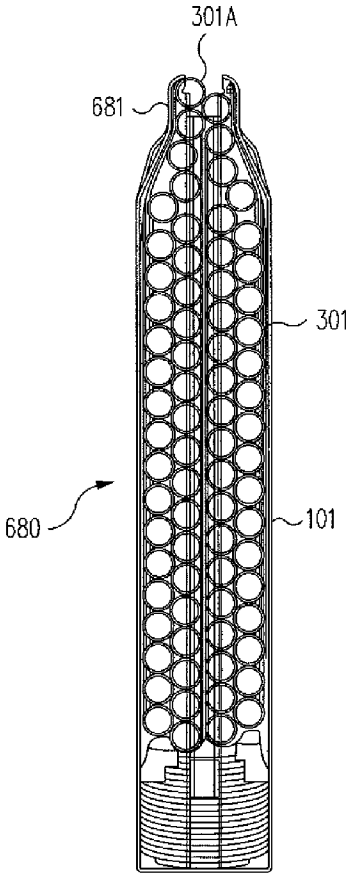
Figure 68H:
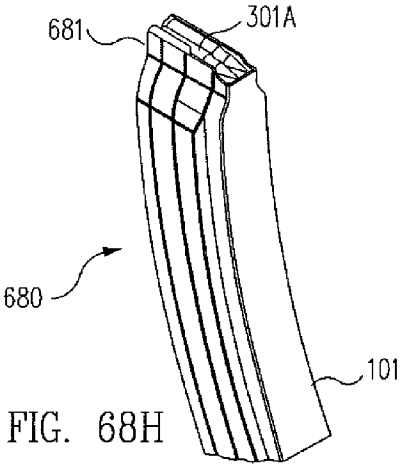
Figure 68I:
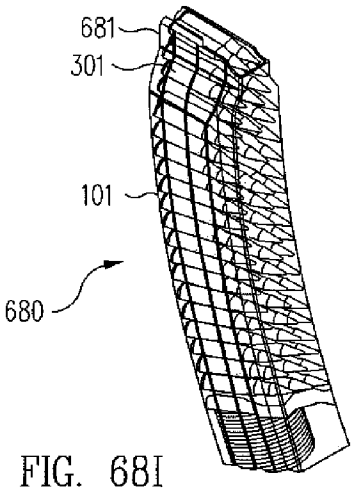
Figure 68G:
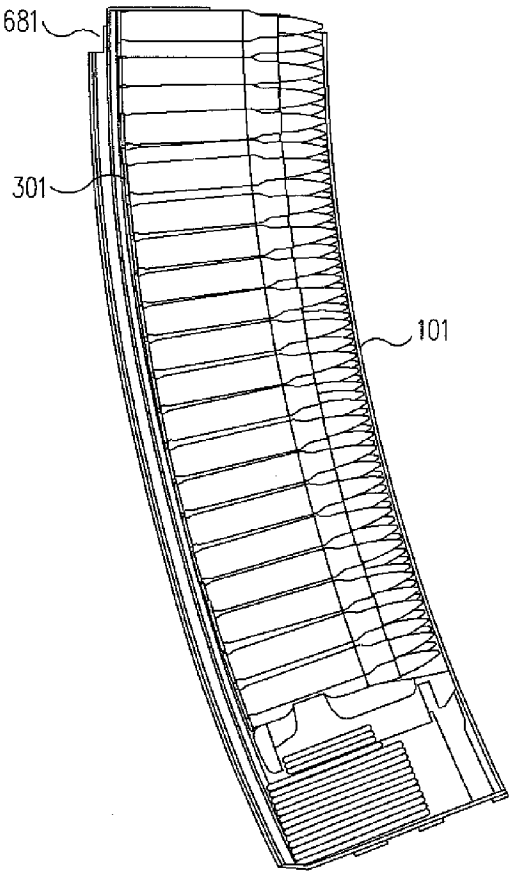
Figure 68F:
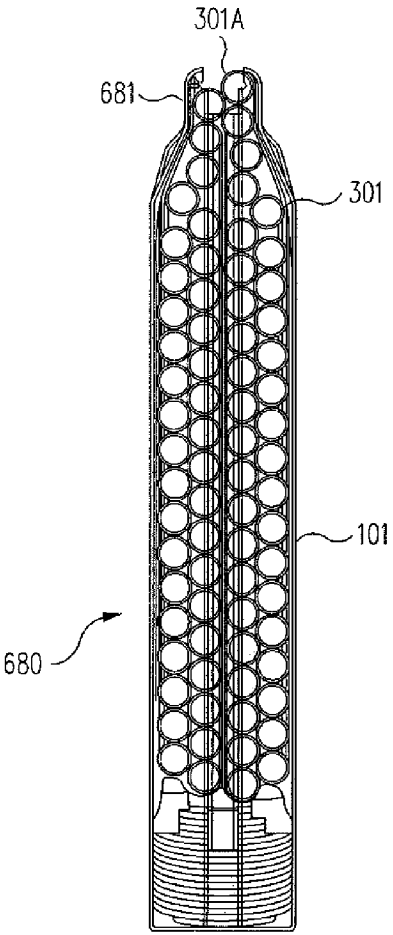
Figure 68J:
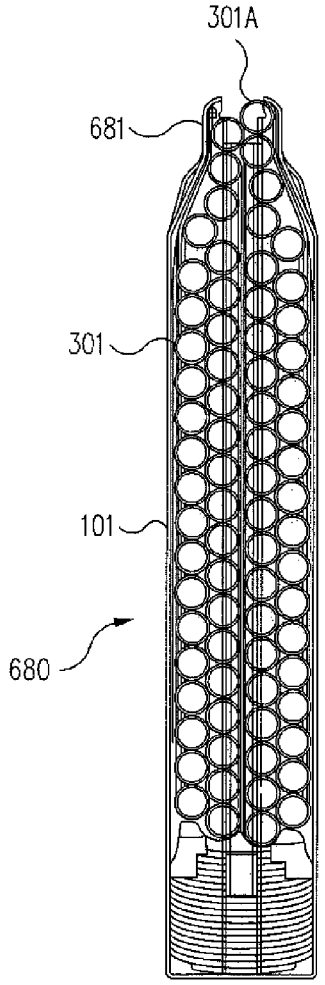
Figure 68K:
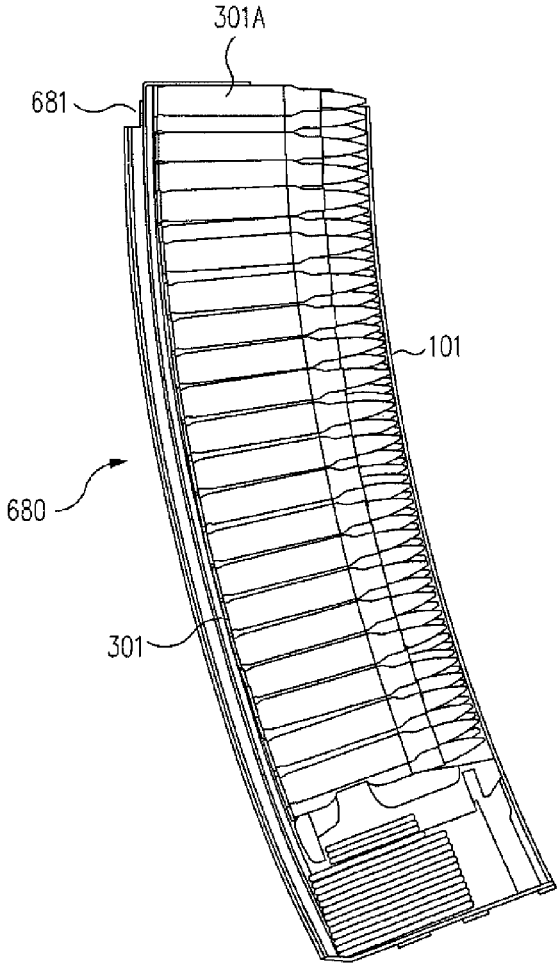

Referring now to FIG. 67C, the width of the feed lip opening may be increased according to an embodiment. To further reduce the stripping force it is desirable to increase the width, Dimension C, of the feed lip opening for a box magazine designed for 5.56 cartridges to something greater than the maximum 0.476 inches that has been used on the M4/M16 magazines and recommended to NATO as a dimension not to exceed for reliable interchange of magazines between the various guns. According to contemporary practice, if this 0.476 inch dimension is exceeded, the cartridges will tend to stand up (a misfeed that is sometimes called a stove pipe) and or become dislodged from the magazine. In either case the result will be a feed malfunction. This is a result of the drag of the bolt on the top cartridge as it moves to the rear which tends to pivot the cartridge on the aft rib moving the forward part of the case body over the adjacent cartridge and away from the forward part of the feed lip allowing the forward part of the body to pivot upwards.

As shown in FIG. 67C, the aft rib 672, where it engages the top cartridge 301A, extends to the back wall 673, thus preventing the cartridge 301A from pivoting on the aft rib as the bolt moves to the rear. Thus, according to an embodiment, the width of the feed lip opening, dimension C, may be greater than 0.480 inches (or 1.27 cartridge diameters), thereby substantially reducing the stripping force.

FIG. 68A-K show a magazine 680 having a short neck 681 in accordance with one or more embodiments of the disclosure. Three of the cartridges 301 that define two interlocked and staggered columns of the cartridges 301 are circled (in FIG. 68A). Embodiments of the magazine 680 having a short neck 680 may operate substantially the same as the longer neck embodiments described herein. The neck of the magazine may have any desired length.

A full width (four column width all of the way to the top of the magazine 680 or substantially all of the way to the top of the magazine 680) may use a single four column follower that advances all of the cartridges all of the way to the top of the magazine 680. Alternatively, nested followers may be used as discussed herein.

Either a symmetrical housing or a non-symmetrical housing may be used, e.g., for the transition from substantially four columns to substantially two columns, as discussed herein. The substantially two column portion of the magazine 680 may hold three cartridges. Alternatively, the substantially two column portion of the magazine 608 may hold more than three of the cartridges 301. For example, the substantially two column portion of the magazine 680 may hold three cartridges, four cartridges, or more than four cartridges. The substantially two column portion of the magazine may hold any desired number of the cartridges 301.

Figure 69:
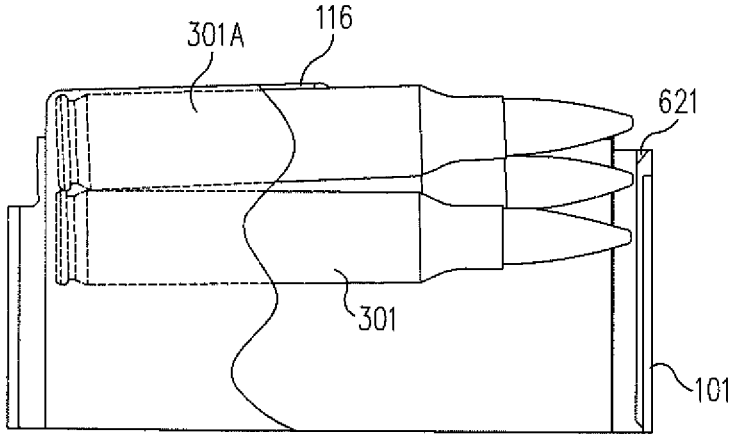
FIG. 69 is a side view showing the three uppermost cartridges being squeezed to accelerate the forward part of the top cartridge to insure it is positioned against the 2° feed lips, in accordance with an embodiment of the disclosure.
Figure 70:
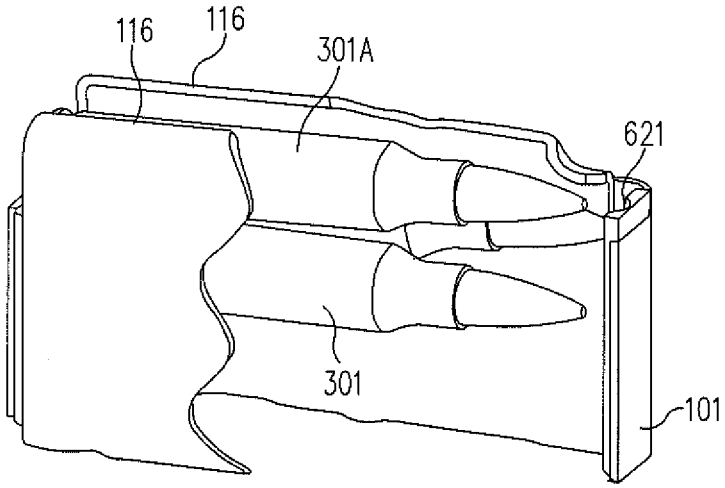
FIG. 70 is a perspective view showing the three uppermost cartridges being squeezed to accelerate the forward part of the top cartridge to insure it is positioned against the 2° feed lips, in accordance with an embodiment of the disclosure.

FIGS. 69 and 70 show the three uppermost cartridges 301 being squeezed to accelerate the forward part of the top cartridge to insure it is positioned against the 2° feed lips 116, in accordance with an embodiment of the disclosure. Such squeezing may generally be done in either longer or short neck embodiments.

Figure 71:
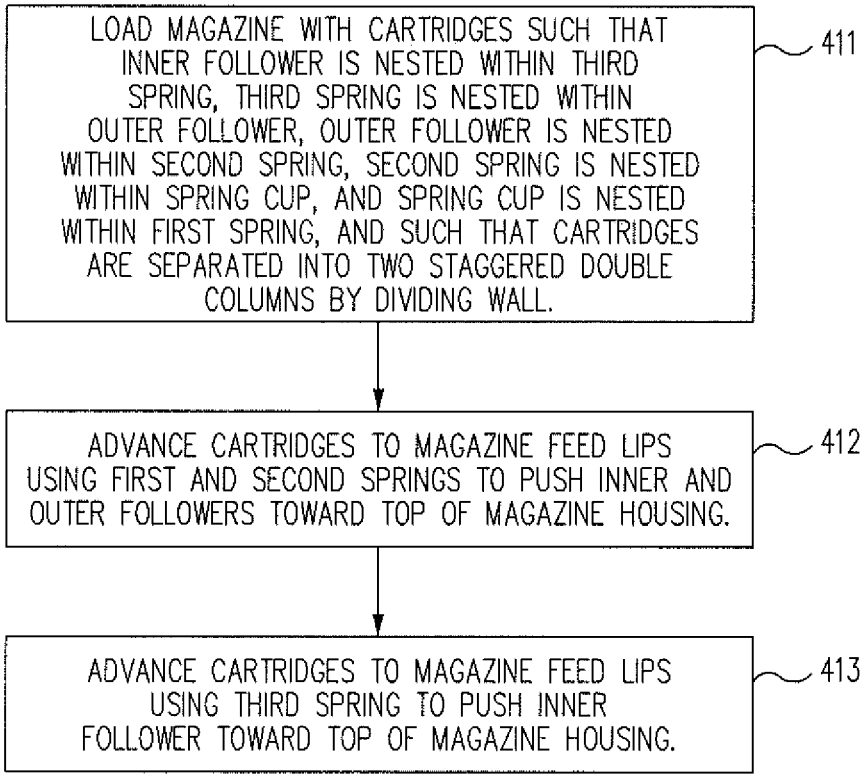
FIG. 71 is a flow chart showing operation of the high capacity magazine, in accordance with an embodiment of the disclosure.

FIG. 71 is a flow chart that illustrates use and operation of the magazine 100, in accordance with an embodiment. With particular reference to block 411 of the flow chart, the magazine 100 may be loaded with cartridges 301 such that the inner follower 162 may be substantially nested within the third spring 152, the third spring 152 may be substantially nested within the outer follower 161, the outer follower 161 may be substantially nested within the second spring 151, the second spring 151 may be substantially nested within the spring cup 160, and the spring cup 160 may be substantially nested within the first spring 150, as shown in FIGS. 18, 19, and 30. The cartridges 301 may be separated into two sets, 381 and 382, by dividing wall 170.

With particular reference to block 412 of the flow chart, cartridges 301 may be fed from the magazine 100 to the firearm 1000 as the firearm 1000 is fired. As the cartridges 301 are fed, the cartridges 301 within the magazine 100 advance therethrough, e.g., toward the lips 116 thereof. Such feeding typically occurs after a cartridge 301 held within a chamber of the firearm 1000 is fired so as to cause the bolt of the firearm 1000 to retract. As the bolt moves back toward the chamber, it strips the uppermost cartridge 301A from the magazine 100 and moves the uppermost cartridge 301A into the chamber.

After the uppermost cartridge 301A has been fed to firearm 1000 and when one or more cartridges 301 remain within the lower region 102 of the magazine 100, then the outer follower 161 and the inner follower 162 move together, substantially as a unit, toward the top end 112 of the magazine 100. First spring 150 and second spring 151 expand to move the outer follower 161 and the inner follower 162 toward the top end 112 of the magazine 100. As the outer follower 161 and the inner follower 162 move toward the top end 112 of the magazine 100, they move cartridges 301 held within the magazine 100 upward as well.

In this manner, a new uppermost cartridge 301A is defined. This new uppermost cartridge 301A may be held within the magazine 100 by one of the lips 116 until the firearm 1000 is again fired and the uppermost cartridge 301A is again fed to the firearm 1000. Generally, each successive uppermost cartridge 301A will be on a different side of the magazine 100. That is, the uppermost cartridges 301A will alternate from left to right and visa versa, as is done according to contemporary practice in the M4/M16 family of firearms. This process maybe repeated until all of the cartridges 301 have been fed from lower region 102 of the magazine 100 to the firearm 1000.

With particular reference to block 413 of the flow chart, after all of the cartridges 301 have been fed from lower region 102 of the magazine 100 to the firearm 1000, then cartridges 301 may be fed from the upper region 103 of the magazine 100 to the firearm 1000. The cartridges 301 may be fed from the upper region 103 of the magazine 100 by the inner follower 162, which may separate substantially from the follower 161 when the outer follower 161 contacts the outer follower stops 121 and is thus prevented from further upward movement.

As the inner follower 162 moves cartridges 301 upwardly within the magazine 100, new cartridges 301 become the uppermost cartridge 301A and may thus be available to be fed into the firearm 1000, as discussed above. The inner follower 162 may continue to move cartridges 301 upwardly until the last cartridge 301 is fed to the firearm 1000.

FIGS. 20-25 are cross-sectional views of the magazine 100 that show the magazine 100 partially filled with cartridges 301, in accordance with an embodiment. For example, magazine 100 may be configured in this manner when it has been partially loaded or has previously been fully loaded and some of the cartridges 301 have been fired. The various states or configurations of the magazine 100 as it is loaded and/or fired are further discussed in detail herein with reference to FIGS. 20-27.

Figure 52:
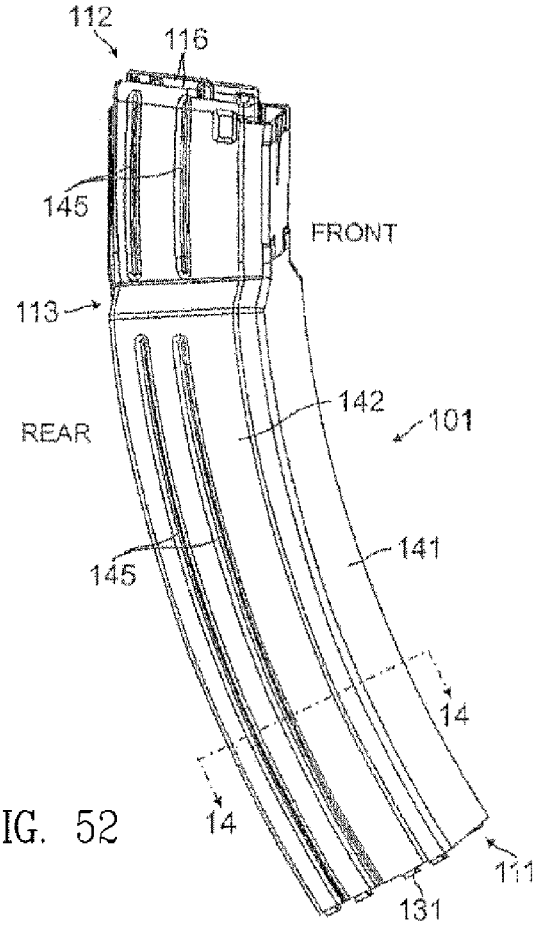
Figure 53:
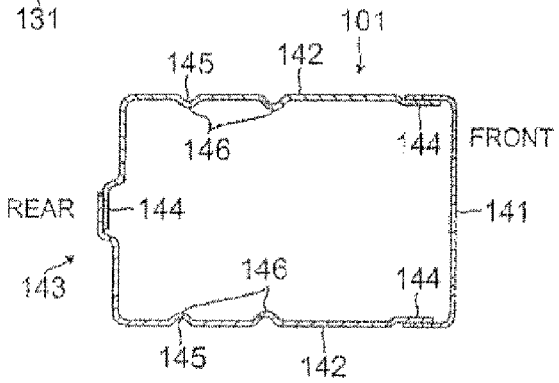
Figure 54:
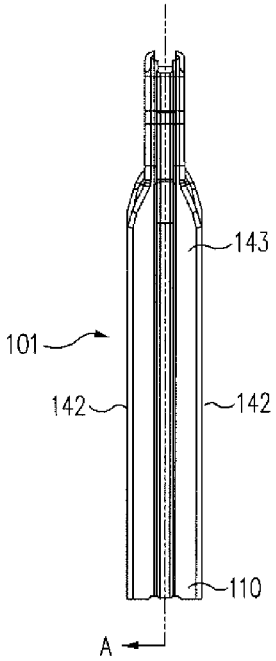
Figure 55:
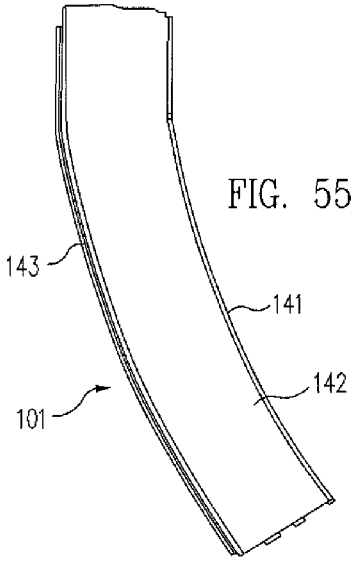
Figure 56:
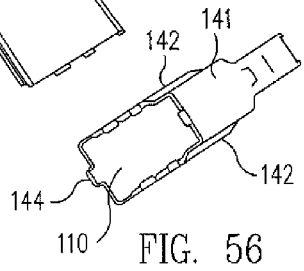
Figure 57:
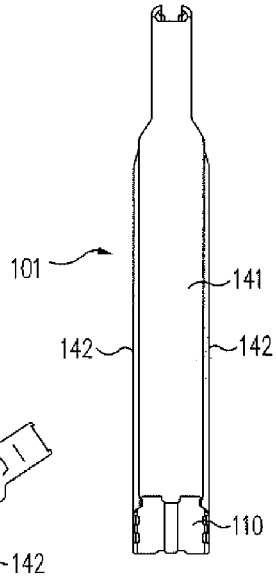
Figure 58:
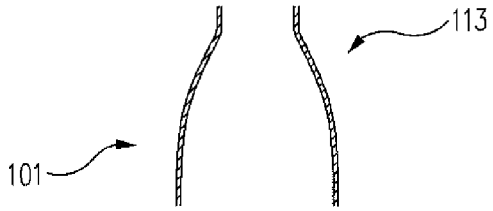

FIGS. 2-17 and 47-57 show the housing 101 of the magazine 100, in accordance with various embodiments. As mentioned above, the housing 101 may comprise sheet metal. With particular reference to FIG. 53, the housing 101 may be formed so as to comprise a sheet metal wrap around portion or front wall 141 that wraps at least partially around side walls 142. The wrap around may define either a portion or substantially the entire a front wall 141 of the housing 101.

According to an embodiment, the side walls 142 may extend to the rear of the housing 101 and cooperate to define a rear wall 143. The front wall 141 and the side walls 142 may be attached together at overlaps 144. The front wall 141 and the side walls 142 may be attached together using any desired method. For example, the front wall 141 and the side walls 142 may be attached together using spot welding, using fasteners (such as screws), and/or using adhesive bonding. Various other configures of the housing 101 are contemplated.

According to an embodiment, depressions 145 may be formed in the housing 101. Such depressions may define rails 146 inside of the housing 101. The rails 146 may be adapted such that cartridges 301 roll thereover. In this manner, friction associated with the movement of the cartridges 301 inside of the housing 101 may be substantially mitigated. Various configurations of the rails 146 are contemplated. For example, the depressions 145, and consequently the rails 146, may be generally parallel as shown in FIGS. 52 and 53 which are also located both in the upper two column section and lower four column section to confine and guide the round springs of both sections. Alternatively, the rails may be completely non-parallel or may have non-parallel portions.

The rails 146 may be adapted to make the upper region 103 more narrow as the cartridges 301 move further upward and/or may be adapted to applying inward pressure to the cartridges 301 as the cartridges 301 move upward with the upper region 103. Thus the rails 146 may urge the substantially two columns of cartridges 301 of the upper region 103 into a substantially single column configuration, as discussed above.

The inner follower 162 may comprise surfaces 165 and 167 (shown in FIGS. 28 and 30) upon which cartridges 301 may be substantially supported. The inner follower 162 may comprise a post 182 (FIGS. 33-35) which may be adapted to be received within complimentary bore 163 of the outer follower 161.

The outer follower 161 may comprise surfaces 168 and 169 (shown in FIGS. 28 and 30) upon which cartridges 301 may be supported. The outer follower 161 may comprise a bore 163 which may be adapted to receive complimentary post 182 of the inner follower 162.

According to an embodiment, the four across cartridge configuration of the lower region 102 may be divided into two sets 381 and 382, by the dividing wall 170. Each of the two sets, 381 and 382, may be substantially two cartridges 301 across. In order for cartridges 301 from the two sets, 381 and 382, to merge readily and reliably, the two sets, 381 and 382, may be offset by approximately ¼ cartridge diameter with respect to one another. In this manner, each individual cartridge 301 may be offset by approximately ½ of a cartridge diameter where the two sets, 381 and 382, merge. Such merging assures that two cartridges 301, one from each set, 381 and 382, do not enter the upper region 103 at substantially the same time so as to result in a jam. Instead, the cartridges 301 alternate between sets, 381 and 382, as the cartridges 301 merge into the upper region 103 of the magazine 100.

The approximately ¼ cartridge diameter offset between sets, 381 and 382, may be provided by positioning the surfaces 166, 168 and 169 of the outer follower 161, as well as the surface 167 of the inner follower 162 so as to provide this offset. Thus, as the cartridges 301 rest upon surfaces 166, 167, 168 and 169 there is approximately a ¼ cartridge diameter offset between sets, 381 and 382 and approximately a ½ cartridge diameter offset between cartridges 301 within sets 381 and 382.

Note that a ¼ cartridge diameter gap 387 may be formed between surface 165 of the inner follower 162 and the cartridge 301C immediately thereabove. Thus, cartridge 301C does not rest upon surface 165 until the inner follower 162 moves upward away from the outer follower 161 proximate the upper region 103 of the magazine 100. The last cartridge support surface 165 of the inner follower and the last cartridge support surfaces 166 of the outer follower can independently lift the last cartridge 301C and are configured to pass through each other.

The ¼ cartridge diameter nested step/gap 387 allows for the ¼ cartridge diameter offset between sets 381 and 382 and makes it possible for the opposing walls 113A and 113B of the tapered portion 113 to be substantially symmetric with respect to one another. In this instance, the opposing walls 113A and 113B work in conjunction with the followers to control and coordinate the spacing of the cartridges 301 as the two sets 381 and 382 merge. Approximately one cartridge diameter of clearance, Dimension D, is provide where the cartridges 301 pass between the dividing wall 170 and the housing 101 at the transition 113.

FIG. 29 illustrates another configuration of a magazine 100A, in accordance with an embodiment. The left hand side of both sets, 381 and 382, of cartridges 301 are in line with each other and right hand side of both sets, 381 and 382, are in line with each other, surface 169 of the four column follower and surface 167 of the two column follower are not offset with respect to one another (they are substantially in line with each other). To insure that the cartridges 301 merge into the two column section with a ½ cartridge diameter offset, the required ½ cartridge diameter offset to merge into the upper two column section is accomplished by an asymmetric configuration of the tapered portion 113 according to this embodiment. Thus, the opposing walls 113A and 113B are offset by ½ cartridge diameter and cooperate with the followers to control and coordinate the spacing of the cartridges 301 as the two sets, 381 and 382, merge.

This embodiment of the magazine 100A may be contrasted with the embodiment of FIG. 28 as follows. The approximately ¼ cartridge diameter offset between sets, 381 and 382, does not exist in the embodiment of FIG. 29, and by adapting generally opposed walls 113C and 113D so as to be offset or asymmetric with respect to one another the two sets 381 and 382 are in line with each other. For example, the wall 113C may be approximately ½ cartridge diameter lower than the opposed wall 113D. In this manner, cartridges 301 from the two columns may be guided by the opposed walls 113C and 113D such that the cartridges 301 merge in the fashion of engaging gear teeth and thus may be substantially less likely to jam. The additional height of wall 113D results in additional clearance between it and the dividing wall (in this instance 0.19 cartridge diameter more of clearance) to provide Dimension E resulting in less cartridge control in this area.

The walls 113C and 113D may define camming symmetrically surfaces that move or cam cartridges 301 inwardly (toward the dividing wall 170) so as to cause the four columns of cartridges 301 of the lower region 102 to become the two columns of cartridges 301 of the upper region 103.

As the cartridges 301 rest upon surfaces 165, 167, 168, and 169 the cartridges 301 need not be positioned with an approximately ¼ cartridge diameter offset between sets, 381 and 382, but rather may be substantially in line with respect to one another. In this instance, no gap (corresponding to gap 387 of FIG. 28) need be formed between surface 165 of the inner follower 162 and the cartridge 301G immediately thereabove. Thus, cartridge 301C may rest upon surface 165 before the inner follower 162 moves away from the outer follower 161 proximate the upper region 103 of the magazine 100. In this case, the camming surfaces may be at different heights above the bottom end 111 of the magazine 100 (and consequently with respect to the tip 171 of the dividing wall 170) by approximately ½ cartridge diameter so as to effect the desired positioning of the cartridges 301 as the cartridges 301 merge.

Aspects of both the embodiment of FIG. 28 and the embodiment of FIG. 29 may be combined to provide desired spacing of the cartridges 301 as the two sets, 381 and 382, merge. For example, both the positioning of surfaces 165, 169, 167, and 168 and the position of opposing walls 113A and 113B may contribute to providing the desired ½ cartridge diameter offset as the cartridges 301 merge.

Referring again to FIGS. 18-27, operation of the magazine 100 is discussed in further detail below. FIGS. 26 and 27 show the magazine 100 empty, e.g., holding no cartridges 301, FIGS. 18-19 show the magazine 100 full of cartridges 301, and FIGS. 20-25 show the magazine partially full of cartridges 301.

The magazine 100 may be filled with cartridges 301 by hand, either with or without the use of a tool (e.g., such as a contemporary tool for loading magazines with cartridges 301) or by a machine. The magazine 100 may be filled with cartridges 301 either by the provider of the magazine 100 (e.g., such as an armory, depot, or factory), in the field, or at any other desired location.

Figure 20:
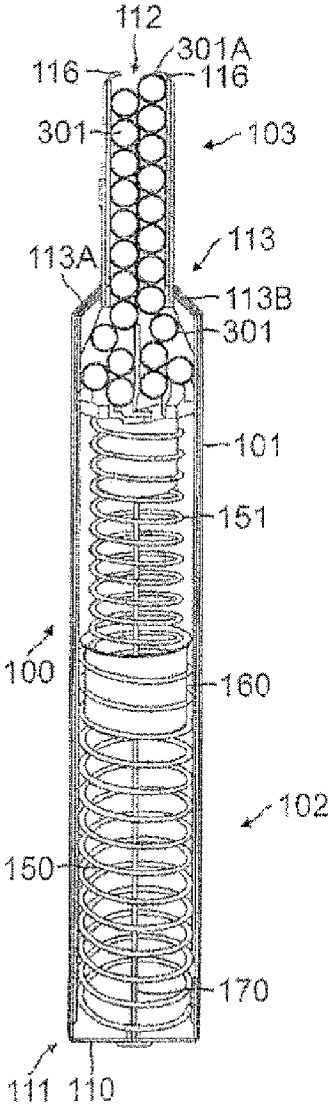
FIG. 20 is a cross-sectional view of a high capacity magazine shown holding 24 cartridges, in accordance with an embodiment of the disclosure.
Figure 21:
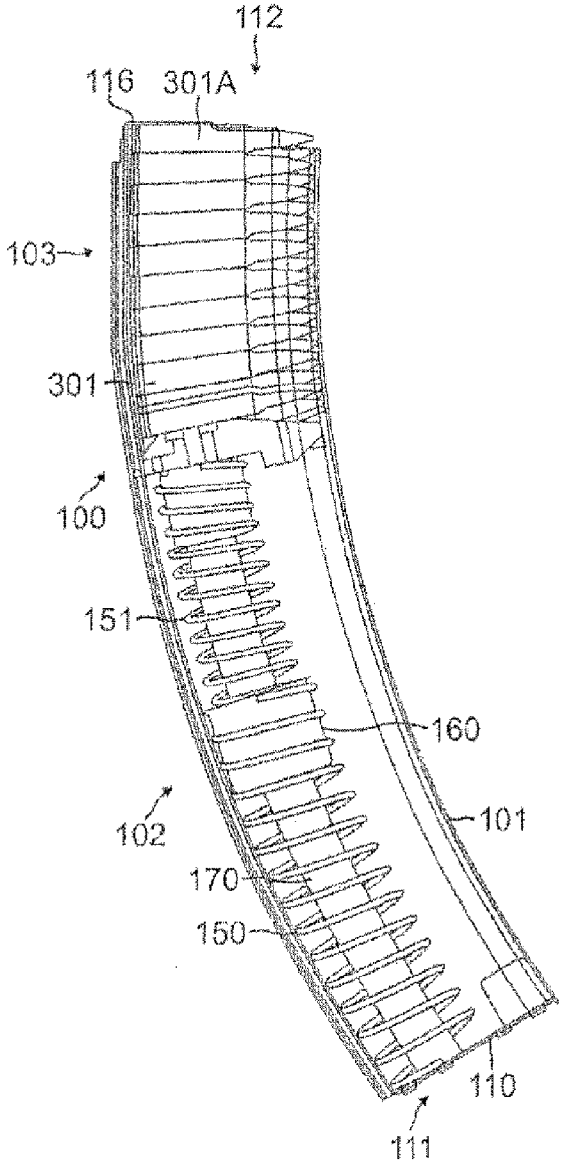
FIG. 21 is a cross-sectional view of the high capacity magazine of FIG. 20 rotated approximately 90°, in accordance with an embodiment of the disclosure.
Figure 22:
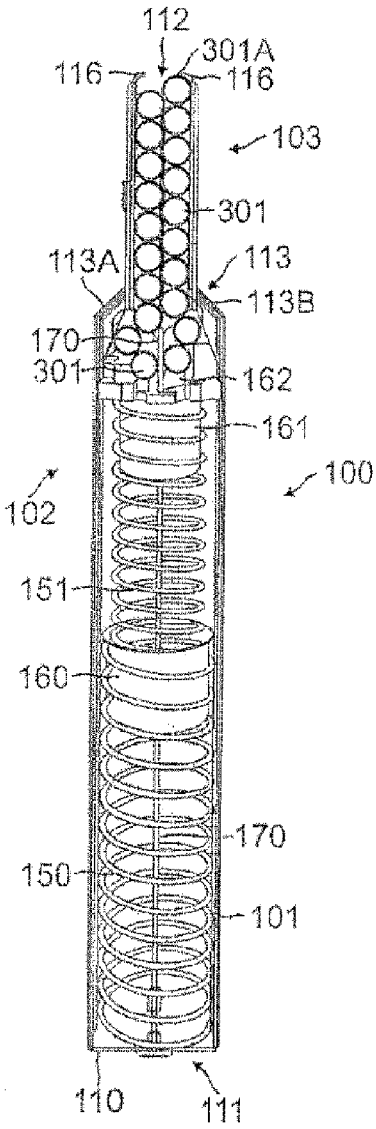
FIG. 22 is a cross-sectional view of a high capacity magazine shown holding 20 cartridges, in accordance with an embodiment of the disclosure.
Figure 23:
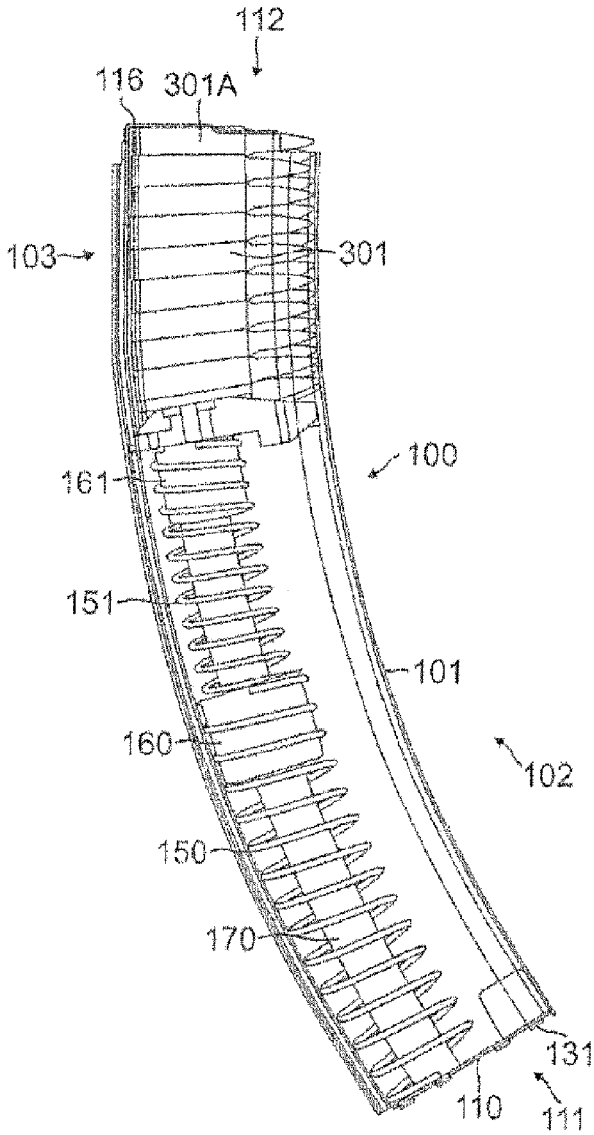
FIG. 23 is a cross-sectional view of the high capacity magazine of FIG. 22 rotated approximately 90°, in accordance with an embodiment of the disclosure.

As cartridges 301 are loaded into the magazine 100, the cartridges 301 may be positioned first upon the inner follower 162. The cartridges 301 may be positioned only upon the inner follower 162 and not upon the outer follower 161 before the inner follower 162 has been pushed downwardly a sufficient distance so as to engage (nest substantially with) the outer follower 161. FIGS. 20 and 21 show the outer follower 161 and the inner follower at approximately the position where this engagement occurs.

Before engagement of the inner follower 162 and the outer follower 161, the configurations (particularly the heights) of the staggered upper surfaces 165 and 167 (shown in FIG. 30A) of the inner follower 162 may determine the configuration of the cartridges 301 disposed within the magazine 100.

With particular reference to FIGS. 20 and 21, after engagement of the inner follower 162 with the outer follower 161 and as more cartridges 301 are loaded, the cartridges 301 may be positioned upon both the inner follower 162 and the outer follower 161. Thus, after engagement of the inner follower 162 with the outer follower, both the inner follower 162 and the outer follower 161 may cooperate to determine the relative heights or vertical relationships of the cartridges 301 with respect to one another. During engagement of the inner follower and the outer follower, the last cartridge support surface 165 of the inner follower passes through the last cartridge support surfaces 166 of the outer follower, thus transferring the support of the last cartridge 301C from the inner follower to the outer follower. After engagement of the inner follower 162 and the outer follower 161, the configurations (particularly the heights) of the staggered upper surfaces 166, 168 and 169 of the outer follower 161 and the upper surface 167 of the inner follower 162 may determine the configuration of the cartridges 301 disposed within the magazine 100. After the inner follower 162 engages the outer follower 161, then the cartridges 301 begin to be divided into two staggered sets, 381, 382, (shown in FIG. 18) thereof by the dividing wall 170.

With particular reference to FIGS. 20 and 21, as cartridges 301 are loaded into the magazine 100, the cartridges 301 may be guided by the dividing wall 170 into one of the two sets, 381, 382, or columns of cartridges 301 on either side of the dividing wall 170. Cartridges 301 that are biased to the left of the dividing wall 170 may be guided to the left of the dividing wall 170 as these cartridges 301 contact the tip 171 of the dividing wall 170. Cartridges 301 that are biased to the right of the dividing wall 170 may be guided to the right of the dividing wall 170 as these cartridges 301 contact the tip 171 of the dividing wall 170. Whether a particular cartridge 301 is biased to the left or to the right may depend upon its position (whether it is positioned to the left or to the right) as that cartridge 301 approaches the tip 171 of the dividing wall 170.

With particular reference to FIGS. 18-27, the magazine 100 may be filled with cartridges 301 so as to compress the first spring 150, the second spring 151 and the third spring 152. When the magazine 100 is completely filled with cartridges 301, the inner follower 162 may be substantially nested within the third spring 152, the third spring may be substantially nested within the outer follower 162, the outer follower 162 may be substantially nested within the second spring 151, the second spring 151 may be substantially nested within the spring cup 160, and the spring cup 160 may be substantially nested within the first spring 150. Because of these various features, such as the nesting aspects of the embodiment, the length of the magazine 100 required so as to accommodate the first spring 150, the second spring 151, and the third spring 152 is substantially reduced and need not be as long as would otherwise be required for such a high capacity magazine.

Nesting of the inner follower 162 at least partially within the outer follower 161 facilitates cooperation of the inner follower 162 and the outer follower 161 to define a single combined follower assembly that moves cartridges 301 toward the top end 112 of the housing 101. Nesting of the inner follower 162 at least partially within the outer follower 161 also facilitates independent functioning of the inner follower 162 to move cartridges 301 toward the top end 112 of the housing 101 without corresponding movement of the outer follower 161.

An uppermost cartridge 301A, and consequently all of the other cartridges 301, may be held in place by the lips 116. The uppermost cartridge 301A may be moved such that it slides from the magazine 100 as the uppermost cartridge 301 is fed to the firearm 1000.

When the firearm 1000 is cocked and each time that the firearm 1000 is fired, the uppermost cartridge 301A may be fed from the magazine 100 to the firearm 1000. When there are cartridges 301 held within the lower region 102 of the housing 101 and the uppermost cartridge 301A is fed from the magazine 100, then the first spring 150 and/or the second spring 151 expand so as to push all of the remaining cartridges 301 away from the bottom end 111 of the housing 101 and toward the top end 112 thereof, so that the next uppermost cartridge 301A (e.g., the cartridge 301 following after the previously fed uppermost cartridge 301A) may be again held in place by the lips 116.

As the firearm 1000 is fired, first spring 150 and/or the second spring 151 may continue to expand and push all of the cartridges 301 toward the top end 112 of the magazine until the staggered upper surfaces 168 and 169 of the outer follower 161 contact the outer follower stops 121. When the staggered upper surface 168 and 169 of the outer follower 161 contact the outer follower stops 121, all of the cartridges 301 from the lower region 102 of the housing 101 will have moved out of the lower region 102. Some of the cartridges 301 from the lower region 102 may remain in the upper region 103, as shown in FIG. 24.

After the staggered upper surfaces 168 and 169 of the outer follower 161 contact the outer follower stops 121 and some cartridges 301 still remain in the upper region 103, then the third spring 152 may expand so as to move the remaining cartridges 301 away from the bottom end 111 of the housing 101 and toward the top end 112 of the housing 101. The third spring 152 may continue to expand and move the cartridges 301 toward the top end 112 until the last cartridge 301 is fed to the firearm 1000 and the inner follower 162 contacts the inner follower stops 122. During separation of the inner follower from the outer follower the last cartridge support surface 165 of the inner follower passes through the last cartridge support surface 166 of the outer follower thus transferring the support of the last cartridge 301C from the outer follower to the inner follower.

Figure 25:
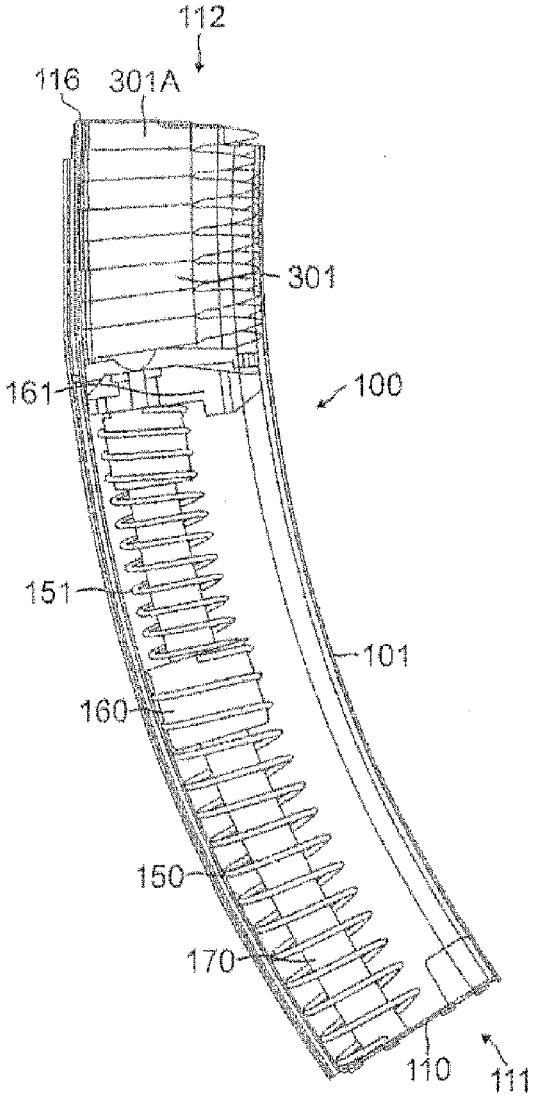
FIG. 25 is a cross-sectional view of the high capacity magazine of FIG. 24 rotated approximately 90°, in accordance with an embodiment of the disclosure.

With particular reference to FIGS. 24 and 25, the magazine 100 is shown when all of the cartridges 301 have been emptied from the lower region 102 of the housing 101 and the upper region 103 is still filled with cartridges 301 (which had previously been in the lower region 102). In this configuration, the outer follower 161 has ceased upward movement and the inner follower 162 may now continue to move cartridges 301 toward the top end 112 of the housing 101.

More particularly, the outer follower 161 has ceased upward movement because staggered upper surfaces 168 and 169 thereof have contacted the outer follower stops 121. The inner follower 162 is still free to move upwardly, toward the top end 112 of the housing 101.

The combination of the first spring 150 and the second spring 151 may be stronger than the third spring 152. Therefore, the third spring 152 may remain substantially fully compressed until upward movement of the outer follower 161 is halted by outer follower stops 121. After upward movement of the outer follower 161 has been halted, then the third spring 152 may be free to expand so as to continue to move cartridges 301 toward the top end 112 of the housing 101 and thus feed the cartridges 301 to the firearm 1000.

According to an embodiment, the third spring 152 may be substantially weaker than the first spring 150 and/or the second spring 151 such that the strongest force provided by the third spring 152, such as when compressed, may be less than the weakest force provided by the first spring 150 and/or the second spring 151, such as when fully expanded. In this manner, the third spring 152 may expand only after the first spring 150 and/or the second spring 151 has ceased expansion.

The first spring 150 and the second spring 151 may have substantially equal strengths. Alternatively, the first spring 150 and the second spring 151 may have substantially unequal strengths. The third spring 152 may be substantially weaker than the combined strength of the first spring 150 and the second spring 151.

As may be seen in FIGS. 18-25, the dividing wall 170 separates the cartridges 301 into two sets, 381 and 382. One set 381 may be to the left of the dividing wall 170 and one set 382 may be to the right of the dividing wall 170, as discussed above. Cartridges 301 from the two sets, 381, 382, may merge proximate the tapered portion 113 after passing by a tip 171 (e.g., upper end) of the dividing wall 170. The tip 171 defines the point at which the two sets, 381, 382, merge with one another. Thus, cartridges 301 from the lower region 102 move to the upper region 103 such that cartridges 301 from the four across cartridge configuration merge to form the two across cartridge configuration.

Moreover, the cartridges 301 on one side of the dividing wall 170 may move along with the cartridges 301 on the other side of the dividing wall 170 such that both sets of cartridges 301 may be at least somewhat synchronized in their motion. This synchronization may better facilitate merging of the two sets of cartridges 301. One set of cartridges 301 may be offset with respect to the other set of cartridges 301 by staggered upper surfaces 166, 168 and 169 as to further enhance the merging thereof, as discussed herein. In this manner, the misfeeding or jamming of cartridges 301 as they merge may be substantially mitigated.

The interlocking of the staggered double columns of cartridges 301 above the substantially nested outer follower 161 and inner follower 162 inhibits independent upward movement of the outer follower 161 and inner follower 162 prior to the outer follower 161 ceasing expansion As shown in FIG. 30A, the housing 101 may comprise the bottom plate 110 that defines a bottom of the housing. The bottom plate 110 may be removable to facilitate maintenance, e.g., cleaning, lubrication, removal and replacement of parts, of the internal components of the magazine 100. For example, tabs 131 form proximate the bottom end 111 of the housing 101 may be formed so as to hold the bottom plate 110 in position.

Other embodiments are also contemplated. For example, although the upper region 103 of the magazine 100 is illustrated in the figures and described herein as having a staggered two column configuration, the upper region 103 may have a single column configuration in another embodiment. For example, the two columns may be urged into a single column prior to the cartridges 301 reaching the top end 112 of the housing 101. The upper region 103 of the magazine 100 may be configured to have any desired number of columns.

As another example, rather than implementing the dividing wall 170 as a freestanding dividing wall as illustrated in the figures and described herein, the dividing wall 170 may alternatively be a non-free standing dividing wall configured for separating the cartridges 301 into two sets. For example, the dividing wall may comprise two separate portions. One portion of the dividing wall may be attached to the front wall 203 of the housing 101 and extend substantially therealong within the lower region 102 of the housing 101, and another portion of the dividing wall may be attached to the rear wall 202 of the housing 101 and extend substantially therealong within the lower region 102 of the housing. A gap may be formed between the two portions such that the springs and followers move within the gap in a fashion similar to that of the magazine disclosed in U.S. Pat. No. 4,589,218.

Advantageously, the high capacity magazines implemented in accordance with the various embodiments described herein typically require less frequent reloading than conventional lower capacity magazines and thus tend to better assure that a firearm will be ready to use when needed. Of course, having a firearm that is ready to use may save lives in many battlefield, police, and other situations.

Also, the high capacity magazine embodiments disclosed herein may provide higher capacities than conventional box magazines without sacrificing reliability. In this regard, substantially stronger springs are not required, and the springs are not compressed to a point where they are likely to interfere with desired operation of the firearm. The round springs disclosed herein are less likely to take a set when the magazine remains fully loaded for an extended period of time. Thus, a high capacity magazine that is reliable, simple in construction, and comparatively inexpensive is provided.

Where applicable, the various components set forth herein may be combined into composite components and/or separated into sub-components without departing from the spirit of the present disclosure. Similarly, where applicable, the ordering of various steps described herein may be changed, combined into composite steps, and/or separated into sub-steps to provide features described herein.

Columns of cartridges may be referred to herein as having "substantially" a given width because the columns may be overlapping or staggered such that the widths are not necessarily well defined. For example, "substantially four columns of cartridges" may refer to four columns of cartridge that do not overlap at all or that overlap with one another substantially such that the columns are staggered.

Columns of cartridges and/or cartridges themselves may be referred to herein as being interlocked and/or staggered when there is some overlap among the columns and/or cartridges. When two cartridges in one column and one cartridge in another column are configured such that each cartridge contacts the other two cartridges, then there is some overlap among the columns and the cartridges. Thus the columns and the cartridges may be referred to as being interlocked and/or staggered.

When a number of columns is referred to herein (such as when referring to the "two column region" and the "four column region"), such reference may be inferred to be with respect to "substantially" that number of columns due to the staggering and/or interlocking thereof. Thus, referring to a "two column region" or referring to a "four column region" may be the same as referring to a "substantially two column region" or referring to a "substantially four column region". That is, the terms a "two column region" and "four column region" may be used interchangeable with a "substantially two column region" and a "substantially four column region" and may have the same meaning.

As used herein, the term "stripping force" may refer to the force that is applied by a bolt of a firearm to a cartridge of a magazine so as to feed the cartridge from the magazine to the firearm. When insufficient stripping force is provided, a stoppage may result.

Various embodiments may use various features described herein. Thus, a given embodiment may use any desired combination of such features.

According to an embodiment, the lower section that may accommodate two staggered double columns and a dividing wall between the cartridge contact surfaces of the side walls.

The upper section that may accommodate a staggered double column with no dividing wall and terminate in either a single or double feed position. The transition section may guide all cartridges to a single feed position without forming them into a staggered double column. The transition section may have cartridge contact surfaces shaped so that the upward flow of the staggered double columns of cartridges reform from two staggered double columns into two single columns which then form into a staggered double column and then terminate in either a single or double feed position.

The front and rear walls of at least the lower section may be curved to approximately fit the cartridge taper. The cartridge contact surfaces on the side walls of one or all sections of the magazine may contact the body of the cartridge. The cartridge contact surfaces on the side walls of one or all sections of the magazine may be configured such that the shoulders, the necks, or projectiles of the cartridges do not generally contact the side walls of the magazine.

According to an embodiment, a magazine can comprise a plurality of followers and at least three springs adapted to move the followers. The followers and the springs can be adapted to facilitate merging of substantially four columns of cartridges into substantially two interlocked and staggered columns of the cartridges to accelerate movement of the cartridges and mitigate force required for stripping of the cartridges from the magazine.

The plurality of springs can comprise three springs. The plurality of followers can comprise two followers. The magazine can further comprise a spring cup disposed substantially intermediate a bottom two of the springs. The spring cup can be adapted to facilitate at least partial nesting of the bottom two springs.

The substantially two interlocked and staggered columns can comprise at least one of the cartridges in one column and at least two of the cartridges in another column. The followers can be adapted to nest at least partially together and at least two of the springs can be adapted to nest at least partially together. The three springs can be adapted to nest at least partially together.

The magazine can further comprise a housing and a dividing wall having a bottom and adapted to separate the cartridges into two sets of cartridges. The dividing wall can be held to the housing only at the bottom of the dividing wall (such as via one of the springs).

The magazine can further comprise a housing within which the followers and the springs are substantially disposed. The housing can have a wider lower region and a narrower upper region. A dividing wall can have a bottom and can be adapted to separate the cartridges into two sets thereof in the lower region, wherein the dividing wall can be held to the housing only at the bottom of the dividing wall. The followers can comprise an outer follower and an inner follower and the inner follower can be adapted to nest at least partially within the outer follower. The inner follower can be adapted to separate from the outer follower to enter the upper region of the housing. The springs can be adapted to at least partially nest one within the other. One spring can move the inner follower and the outer follower when the inner follower and the outer follower are in the lower region and the other spring can move the inner follower when the inner follower is in the upper region. The housing, the followers, the springs, and the dividing wall can be adapted to cooperate to merge the substantially four columns of cartridges into the substantially two interlocked and staggered columns of cartridges.

According to an embodiment, a magazine can comprise at least three springs adapted to nest at least partially one within the other. The magazine can further comprise a dedicated follower for each one of two of the springs. Each dedicated follower can be adapted to be moved by its associated spring.

The magazine can further comprise a dividing wall. The springs can be adapted to receive the dividing wall therethrough. The springs can comprise round springs. The springs can comprise an inner spring and an outer spring that is adapted to nest at least partially within the inner spring. The outer spring can be substantially stronger than the inner spring.

According to an embodiment, a weapon system can comprise a firearm and a magazine for providing cartridges to the firearm. The magazine can be removably attachable to the firearm. The magazine can comprise a housing having a top end and a bottom end substantially opposite the top end. An outer follower can be movably disposed within the housing. An inner follower can be movably disposed within the housing and adapted to nest at least partially within the outer follower. A first spring and a second spring can be disposed within the housing and can be adapted to move the outer follower away from the bottom end of the housing. A third spring can be disposed within the housing and adapted to move the inner follower away from the outer follower and toward the top end of the housing. The third spring can be adapted to nest at least partially within the outer follower. The first spring, the second spring, and the third spring can be adapted to expand to move the cartridges to the firearm.

The weapon system can further can comprise a spring cup disposed substantially between the first spring and the second spring. The spring cup can be adapted to facilitate at least partial nesting of the first spring and the second spring. According to an embodiment, a box magazine can have three or more springs.

According to an embodiment, a four into two column magazine can have a four column follower that bridges both sides of a dividing wall and the transition zone can be symmetrical. According to an embodiment, a four column magazine (having two staggered double columns) can merge cartridges into two columns, wherein the four column section the two staggered double columns of cartridges are offset by ¼ of a cartridge diameter.

According to an embodiment, a four into two column magazine can have a two column follower that advances the two columns of ammunition in the two column portion of the magazine, wherein the follower only supports/advances one column when the two column follower is in the four column section. According to an embodiment, in a four into two column magazine the cartridges are offset by ½ of a cartridge diameter in the upper two column section and in the four column section there are two interlocked double columns that are offset from each other by ¼ of a cartridge diameter.

According to an embodiment, a double column box magazine has spring loaded surfaces that force the columns together as they approach the feed lips. According to an embodiment, a double column box magazine has spring loaded surfaces that force the front of the two columns together as they approach the feed lips. According to an embodiment, a double column box magazine has spring loaded surfaces that force the columns together as they approach the feed lips, and feed lips are angled approximately two degrees with respect to a perpendicular to an aft wall of the magazine.

According to an embodiment, a box magazine has hardened surface feed ramps formed into an insert attached to the front wall. The feed ramps are durable and can enhance feeding reliability.

According to an embodiment, a box magazine can have a straight section adapted to fit the M4/M16 straight magazine well. The magazine can include two curved sections. The first curved section can be adjacent to the straight section and can be substantially smaller (have a tighter curve) than curve defined by a column of the tapered cartridges. When this curve catches up to the natural angle of the ammunition such that the cartridges are generally perpendicular to the aft wall of the magazine, a second curve that matches the natural curve of the tapered cartridge cases can be provided so that all rounds in this section are generally perpendicular to the back wall. The first curve can be tangent to both the straight section and the second curve.

According to an embodiment, a box magazine has one or more round springs that are guided by ribs of the box. According to an embodiment, a box magazine is adapted to fit a 5.56 cartridge M4/M16 magazine well having a feed lip opening that is greater than 0.480 inches. According to an embodiment, a box magazine is adapted to fit a 5.56 cartridge M4/M16 magazine well and a cartridge guide surface extends to the back wall for the top round in the feed location.

According to an embodiment, a magazine has a cartridge guide surface that extends to the back wall for the top round in the feed location and the feed lip opening is greater than 1.27 cartridge diameters. According to an embodiment, a magazine comprises a housing adapted to facilitate merging of four columns of cartridges into two interlocked and staggered columns of the cartridges and the magazine terminates in a double or single feed position.

According to an embodiment, a magazine comprises a housing adapted to facilitate merging of four columns of cartridges into two divided single columns of the cartridges and terminate in a double feed position. According to an embodiment, a magazine comprises a housing adapted to facilitate merging of four columns of cartridges into two divided single columns of the cartridges and terminate in a single feed position and the transition section is symmetrical.

According to an embodiment, a magazine comprises a housing adapted to facilitate merging of four columns of cartridges into two divided single columns of the cartridges and then form the cartridges into a staggered double column that terminates in a double feed position. According to an embodiment, a magazine comprises a housing adapted to facilitate merging of four columns of cartridges into two divided single columns of the cartridges and then forms the cartridges into a staggered double column that terminates in a single feed position. According to an embodiment, a magazine comprises a housing adapted to facilitate merging of four columns of cartridges into a single feed position without forming the cartridges into a staggered double column, wherein the four column follower bridges both sides of dividing wall.

According to an embodiment, a magazine comprises a plurality of rails and a round spring that is at least partially guided by the rails. According to an embodiment, a box magazine has cartridge contact surfaces on the side walls of one or all sections thereof that contact the body diameter of the cartridge and the shoulders, necks, and/or projectiles of the cartridges do not contact the side walls. A section of the magazine can be configured to hold substantially four columns of cartridges.

According to an embodiment, a box magazine has cartridge contact surfaces on the side walls of one or all sections thereof that contact the body diameter of the cartridge and do not contact the shoulders, necks, or projectiles of the cartridges, and the cartridges are bottle necked. A section of the magazine can be configured to hold substantially four columns of cartridges.

Embodiments described above illustrate but do not limit the disclosure. It should also be understood that numerous modifications and variations are possible in accordance with the principles of the present disclosure. Accordingly, the scope of the invention is defined only by the following claims.

What is claimed is:

1. A magazine comprising:

an outer follower;

an inner follower adapted to nest at least partially within the outer follower;

wherein the outer follower is adapted to cooperate with the inner follower to support four columns of cartridges when the outer follower and the inner follower are nested so that the outer follower supports three of the four columns of cartridges and the inner follower supports one of the four columns of cartridges when the outer follower and the inner follower are nested; and wherein the inner follower is adapted to support two columns of cartridges when the outer follower and the inner follower are not nested.

2. The magazine of claim 1, wherein when the outer follower and the inner follower are nested:

one of the columns of cartridges supported by the outer follower is held by the outer follower above a first surface of the inner follower by a gap of approximately ¼ of a cartridge diameter.

3. The magazine of claim 2, wherein when the outer follower and the inner follower are not nested:

the first surface of the inner follower is adapted to close the gap and contact at least one of the cartridges.

4. The magazine of claim 1, wherein two of the four columns of cartridges are offset relative to a remaining two of the four columns of cartridges by a distance of approximately ¼ of a cartridge diameter.

5. The magazine of claim 1, wherein one of the two columns of cartridges is offset relative to a remaining one of the two columns of cartridges by a distance of approximately ½ of a cartridge diameter.

6. The magazine of claim 1, further comprising a housing configured to facilitate merging of the four columns of cartridges into the two columns of cartridges.

7. The magazine of claim 6, wherein the housing includes a short neck portion and wherein the two columns of cartridges each include only one cartridge interlocked on each side of the short neck portion.

8. The magazine of claim 6, wherein the housing includes a short neck portion adapted such that the cartridges terminate in a double feed position in which the two columns include at least one cartridge in one column and at least one cartridge in another column.

9. The magazine of claim 8, further comprising a dividing wall having a top end, wherein minimum distances between the top end of the dividing wall and opposing sides of the housing are equal and approximately a cartridge diameter and wherein the two columns of cartridges each include only one cartridge interlocked on each side of the short neck portion.

10. The magazine of claim 6, further comprising a dividing wall having a top end, wherein minimum distances between the top end of the dividing wall and opposing sides of the housing are equal and approximately a cartridge diameter, and wherein the two columns of cartridges each include a plurality of interlocked cartridges in a two column portion of the housing.

11. The magazine of claim 1, further comprising:

a housing having a top end and a bottom end;

a spacer movably disposed within the housing;

a first spring having at least a portion disposed between the bottom end of the housing and the spacer and adapted to move the spacer away from the bottom end of the housing;

a second spring having at least a portion disposed between the spacer and the outer follower and adapted to move the outer follower away from the spacer;

a third spring having at least a portion disposed between the inner follower and the outer follower and adapted to move the inner follower away from the outer follower; and wherein the third spring is adapted to nest at least partially within the second spring, the second spring is adapted to nest at least partially within the first spring, and the first, second, and third springs are adapted to expand to move the cartridges.

12. A firearm comprising the magazine of claim 1.

13. A method comprising:

nesting an inner follower of a magazine at least partially within an outer follower of the magazine;

during the nesting, supporting four columns of cartridges with the outer follower and the inner follower, wherein the outer follower supports three of the four columns of cartridges and the inner follower supports one of the four columns of cartridges;

moving the inner follower away from the outer follower; and following the moving, supporting two columns of cartridges with the inner follower.

14. The method of claim 13, wherein the supporting four columns of cartridges comprises holding, with the outer follower, one of the columns of cartridges supported by the outer follower above a first surface of the inner follower by a gap of approximately ¼ of a cartridge diameter.

15. The method of claim 14, wherein the moving comprises closing the gap and contacting at least one of the cartridges with the first surface of the inner follower.

16. The method of claim 13, wherein two of the four columns of cartridges are offset relative to a remaining two of the four columns of cartridges by a distance of approximately ¼ of a cartridge diameter.

17. The method of claim 13, wherein one of the two columns of cartridges is offset relative to a remaining one of the two columns of cartridges by a distance of approximately ½ of a cartridge diameter.

18. The method of claim 13, further comprising merging the substantially four columns of cartridges into the two columns of cartridges using a housing of the magazine.

19. The method of claim 18, wherein the housing includes a short neck portion and wherein, following the merging, the two columns of cartridges each include only one cartridge interlocked on each side of the short neck portion.

20. The method of claim 18, further comprising terminating the cartridges in a double feed position using the housing, wherein the two columns include at least one cartridge in one column and at least one cartridge in another column.

21. The method of claim 20, wherein the magazine includes a dividing wall having a top end and wherein minimum distances between the top end of the dividing wall and opposing sides of the housing are equal and approximately a cartridge diameter and wherein the two columns of cartridges each include only one cartridge interlocked on each side of the short neck portion.

22. The method of claim 18, wherein the magazine includes a dividing wall having a top end and wherein minimum distances between the top end of the dividing wall and opposing sides of the housing are equal and approximately a cartridge diameter and wherein the two columns of cartridges each include a plurality of interlocked cartridges in a two column portion of the housing.

23. The method of claim 13, wherein the magazine includes a housing having a top end and a bottom end, a spacer, a first spring having at least a portion disposed between the bottom end of the housing and the spacer, a second spring having at least a portion disposed between the spacer and the outer follower, and a third spring having at least a portion disposed between the inner follower and the outer follower, the method further comprising:

moving the spacer away from the bottom end of the housing with the first spring;

moving the outer follower away from the spacer with the second spring;

nesting the third spring at least partially within the second spring;

nesting the second spring at least partially within the first spring;

expanding the first, second, and third springs to move the cartridges; and wherein the moving the inner follower away from the outer follower comprises moving the inner follower away from the outer follower with the third spring.

24. The method of claim 13, further comprising providing the cartridges to a firearm using the outer follower and the inner follower.

* * * * *